US010220271B2

(12) United States Patent
Larson et al.

(10) Patent No.: US 10,220,271 B2
(45) Date of Patent: Mar. 5, 2019

(54) GOLF CLUB AND GOLF CLUB HEAD STRUCTURES

(71) Applicant: Karsten Manufacturing Corporation, Phoenix, AZ (US)

(72) Inventors: Eric A. Larson, Arlington, TX (US); Robert Boyd, Flower Mound, TX (US); Kenneth W. Brown, Tolland, CT (US); Sherry L. Jones, Pataskala, OH (US); John T. Stites, Sallisaw, OK (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

(21) Appl. No.: 15/960,215

(22) Filed: Apr. 23, 2018

(65) Prior Publication Data

US 2018/0236322 A1 Aug. 23, 2018

Related U.S. Application Data

(63) Continuation of application No. 14/859,508, filed on Sep. 21, 2015, now Pat. No. 9,950,219, which is a continuation of application No. 13/665,844, filed on Oct. 31, 2012, now Pat. No. 9,149,693, which is a continuation-in-part of application No. 13/593,253, filed on Aug. 23, 2012, now Pat. No. 9,433,834, (Continued)

(51) Int. Cl.

| | |
|---|---|
| ***A63B 53/04*** | (2015.01) |
| ***A63B 53/06*** | (2015.01) |
| ***A63B 60/00*** | (2015.01) |
| ***A63B 53/02*** | (2015.01) |
| ***A63B 60/52*** | (2015.01) |

(52) U.S. Cl.

CPC ..... *A63B 53/0466* (2013.01); *A63B 53/02* (2013.01); *A63B 53/04* (2013.01); *A63B 53/06* (2013.01); *A63B 60/00* (2015.10); *A63B 60/52* (2015.10); *A63B 53/047* (2013.01); *A63B 53/0487* (2013.01); *A63B 2053/023* (2013.01); *A63B 2053/0408* (2013.01); *A63B 2053/0412* (2013.01); *A63B 2053/0433* (2013.01); *A63B 2053/0491* (2013.01); *A63B 2060/002* (2015.10); *A63B 2225/01* (2013.01)

(58) Field of Classification Search

USPC ..... 473/324–350

See application file for complete search history.

(56) References Cited

U.S. PATENT DOCUMENTS 3,976,299 A * 8/1976 Lawrence ..... A63B 53/04 473/327
5,271,622 A * 12/1993 Rogerson ..... A63B 53/04 473/234

(Continued)

FOREIGN PATENT DOCUMENTS

GB 2304591 A * 3/1997 ..... A63B 53/04
JP 07275407 10/1995

(Continued)

*Primary Examiner* — Alvin Hunter

(57) ABSTRACT

A golf club head has a body defining a ball striking face. The body further has a first leg extending away from the ball striking face and a second leg extending away from the ball striking face wherein a void is defined between the first leg and the second leg. The body further defines a crown that extends over the void.

19 Claims, 43 Drawing Sheets

Related U.S. Application Data which is a continuation-in-part of application No. 13/250,051, filed on Sep. 30, 2011, now Pat. No. 8,668,595, which is a continuation-in-part of application No. 12/723,951, filed on Mar. 15, 2010, now abandoned, which is a continuation-in-part of application No. 12/356,176, filed on Jan. 20, 2009, now Pat. No. 7,922,603.

(60) Provisional application No. 61/598,832, filed on Feb. 14, 2012, provisional application No. 61/526,326, filed on Aug. 23, 2011, provisional application No. 61/480,322, filed on Apr. 28, 2011.

(56) References Cited

U.S. PATENT DOCUMENTS

D354,103 S * 1/1995 Allen ..... D21/752
D363,749 S * 10/1995 Kenmi ..... D21/752
5,464,217 A * 11/1995 Shenoha ..... A63B 53/04 473/350
5,497,995 A * 3/1996 Swisshelm ..... A63B 53/04 473/350
D392,007 S * 3/1998 Fox ..... D21/752
D397,387 S * 8/1998 Allen ..... D21/733
D398,946 S * 9/1998 Kenmi ..... D21/733
5,888,148 A * 3/1999 Allen ..... A63B 53/04 473/290
D414,234 S * 9/1999 Darrah ..... D21/759
D465,251 S * 11/2002 Wood ..... D21/752
D556,214 S 11/2007 Fretwell
D566,214 S * 4/2008 Evans ..... D21/752
7,431,663 B2 * 10/2008 Pamias ..... A63B 53/007 473/288
D650,876 S * 12/2011 Llewellyn ..... D21/752
D675,691 S * 2/2013 Oldknow ..... D21/759
D675,692 S * 2/2013 Oldknow ..... D21/759
D676,512 S * 2/2013 Oldknow ..... D21/759
D676,909 S * 2/2013 Oldknow ..... D21/752
D676,913 S * 2/2013 Oldknow ..... D21/759
D676,914 S * 2/2013 Oldknow ..... D21/759
D676,915 S * 2/2013 Oldknow ..... D21/759
D677,353 S * 3/2013 Oldknow ..... D21/759
D678,964 S * 3/2013 Oldknow ..... D21/752
D678,965 S * 3/2013 Oldknow ..... D21/752
D678,968 S * 3/2013 Oldknow ..... D21/759
D678,969 S * 3/2013 Oldknow ..... D21/759
D678,970 S * 3/2013 Oldknow ..... D21/759
D678,971 S * 3/2013 Oldknow ..... D21/759
D678,972 S * 3/2013 Oldknow ..... D21/759
D678,973 S * 3/2013 Oldknow ..... D21/759
D679,354 S * 4/2013 Oldknow ..... D21/759
8,449,406 B1 * 5/2013 Frame ..... A63B 53/04 473/329
8,628,433 B2 * 1/2014 Stites ..... A63B 53/0466 473/327
8,734,265 B2 * 5/2014 Soracco ..... A63B 53/0466 473/245
D707,768 S * 6/2014 Oldknow ..... D21/752
D707,769 S * 6/2014 Oldknow ..... D21/752
D707,773 S * 6/2014 Oldknow ..... D21/759
D708,281 S * 7/2014 Oldknow ..... D21/759
D709,575 S * 7/2014 Oldknow ..... D21/759
9,149,693 B2 * 10/2015 Stites ..... A63B 53/0466
9,155,944 B2 * 10/2015 Stites ..... A63B 53/0466
9,950,219 B2 * 4/2018 Larson ..... A63B 53/0466
2003/0045371 A1 * 3/2003 Wood ..... A63B 53/0466 473/328

FOREIGN PATENT DOCUMENTS

JP 07275407 A * 10/1995
JP 08155063 A * 6/1996
JP 10277180 A * 10/1998
JP 2003230642 A * 8/2003

* cited by examiner

GOLF CLUB AND GOLF CLUB HEAD STRUCTURES

RELATED APPLICATIONS

This is a continuation of U.S. patent application Ser. No. 14/859,508 filed Sep. 21, 2015, which is a continuation of U.S. patent application Ser. No. 13/665,844, filed on Oct. 31, 2012, now U.S. Pat. No. 9,149,693 issued on Oct. 6, 2015, which is a continuation-in-part of U.S. patent application Ser. No. 13/593,253, filed on Aug. 23, 2012, now U.S. Pat. No. 9,433,834 issued on Sep. 6, 2016, which claims the benefit of U.S. Patent Application No. 61/526,326, filed on Aug. 23, 2011, and U.S. Patent Application No. 61/598,832, filed on Feb. 14, 2012, and which further is a continuation-in-part of U.S. patent application Ser. No. 13/250,051, filed on Sep. 30, 2011, now U.S. Pat. No. 8,668,595, issued on Mar. 11, 2011, which claims the benefit of U.S. Patent Application No. 61/480,322, filed Apr. 28, 2011, and is also a continuation-in-part of U.S. patent application Ser. No. 12/723,951, filed on Mar. 15, 2010, which is a continuation-in-part of U.S. patent application Ser. No. 12/356,176, filed on Jan. 20, 2009, now U.S. Pat. No. 7,922,603 issued Apr. 12, 2011, all of which mentioned above are incorporated fully herein by reference.

TECHNICAL FIELD

Aspects of this invention relate generally to golf clubs and golf club heads, and, in particular, to golf clubs and golf club heads having a portion of the club head removed or open, thereby creating a void in the club head, in order to reduce or redistribute weight associated with the club head to enhance performance.

BACKGROUND

Golf is enjoyed by a wide variety of players, players of different genders and players of dramatically different ages and/or skill levels. Golf club designers have successfully advanced the technology incorporated in golf clubs in response to the constant demand of golfers for improved performance. In one aspect, golfers tend to be sensitive to the "feel" of a golf club. The "feel" of a golf club comprises the combination of various component parts of the club and various features associated with the club that produce the sensations experienced by the player when a ball is swung at and/or struck. Club weight, weight distribution, swing weight, aerodynamics, swing speed, and the like all may affect the "feel" of the club as it swings and strikes a ball. "Feel" also has been found to be related to the sound produced when a club head strikes a ball to send the ball in motion. If a club head makes an unpleasant, undesirable, or surprising sound at impact, a user may flinch, give up on his/her swing, decelerate the swing, lose his/her grip, and/or not completely follow-through on the swing, thereby affecting distance, direction, and/or other performance aspects of the swing and the resulting ball motion. User anticipation of this unpleasant, undesirable, or surprising sound can affect a swing even before the ball is hit.

Also, the performance of a golf club can vary based on several factors, including weight distribution about the club head, which affects the location of the center of gravity of the golf club head. When the center of gravity is positioned behind the point of engagement on the contact surface, the golf ball follows a generally straight route. When the center of gravity is spaced to a side of the point of engagement, however, the golf ball may fly in an unintended direction and/or may follow a route that curves left or right, including ball flights that often are referred to as "pulls," "pushes," "draws," "fades," "hooks," or "slices." Similarly, when the center of gravity is spaced above or below the point of engagement, the flight of the golf ball may exhibit more boring or climbing trajectories, respectively.

Weight distribution about the club head can also affect moment of inertia associated with the club head. Thus, altering the moment of inertia can affect how the golf club performs including how the golf club head design impacts heel and toe mishits. Similarly, other factors such as point of impact and launch angle can also affect how the ball travels once it has been struck.

Club designers are often looking for new ways to distribute or redistribute weight associated with a golf club and/or golf club head. For instance, club designers are often looking to distribute weight to provide more forgiveness in a club head, improved accuracy, a desired ball spin and ball flight and the like. Club designers also seek to optimize the center of gravity location of the club head. In pursuit of such designs, club designers also face a challenge of maintaining a club head having a traditional aesthetic look desired by most golfers. Club designers further face the challenge of providing a club head having desirable sound characteristics upon ball impact. While certain golf club and golf club head designs according to the prior art provide a number of advantageous features, they nevertheless have certain limitations. Accordingly, it would be advantageous to provide a golf club and golf club head having a reduced weight characteristic and improved weight distribution throughout the club head to enhance club performance. The present invention is provided to overcome certain of the limitations and drawbacks of the prior art, and to provide new features not heretofore available.

SUMMARY

At least some aspects of the disclosure relate to golf clubs and golf club heads having enhanced weight distribution about the club head. In one aspect, the golf club utilizes a geometric weight feature in the form of a void formed in the golf club head. The golf club head may include a cover extending over the void such that the void may not be visible from a top of the golf club head at an address position. In some examples, the golf club head may include certain support structures that enhance performance characteristics of the golf club head. In some additional examples, the golf club head may further include one or more adjustable weight arrangements.

According to another aspect of the invention, the golf club head is structured to maintain high moment of inertia properties and an enhanced center of gravity location. The structure of the golf club head further provides more pleasing acoustic characteristics.

According to another aspect of the invention, the golf club head has a body defining a ball striking face, a crown and a sole. The body further has a first leg extending away from the ball striking face and a second leg extending away from the ball striking face wherein a void is defined between the first leg and the second leg. The crown extends over the void. The void defines a first perimeter proximate an underside surface of the crown and the void defines a second perimeter proximate the sole, wherein the second perimeter is different from the first perimeter. In an exemplary embodiment, the second perimeter is greater than the first perimeter.

According to a further aspect of the invention, the golf club head has a body defining a ball striking face, a crown and a sole. The body further has a first leg extending away from the ball striking face and a second leg extending away from the ball striking face wherein a void is defined between the first leg and the second leg. The crown extends over the void. The body further defines an internal cavity. The first leg has a first wall extending between the crown and the sole, the first wall having a first inner surface facing into the internal cavity and a first outer surface facing into the void. The second leg has a second wall extending between the crown and the sole, the second wall having a second inner surface facing into the internal cavity and a second outer surface facing into the void.

According to a further aspect of the invention, the golf club head has a body defining a ball striking face, a crown and a sole. The body further has a first leg extending away from the ball striking face and a second leg extending away from the ball striking face wherein a void is defined between the first leg and the second leg. The crown extends over the void. The body further defines a bore receiving an adjustment member capable of adjusting a parameter of the golf club head. The sole defines a pathway surface positioned generally adjacent the bore, the pathway surface being void of interruption.

These and additional features and advantages disclosed herein will be further understood from the following detailed disclosure of certain embodiments.

Figure 1A:
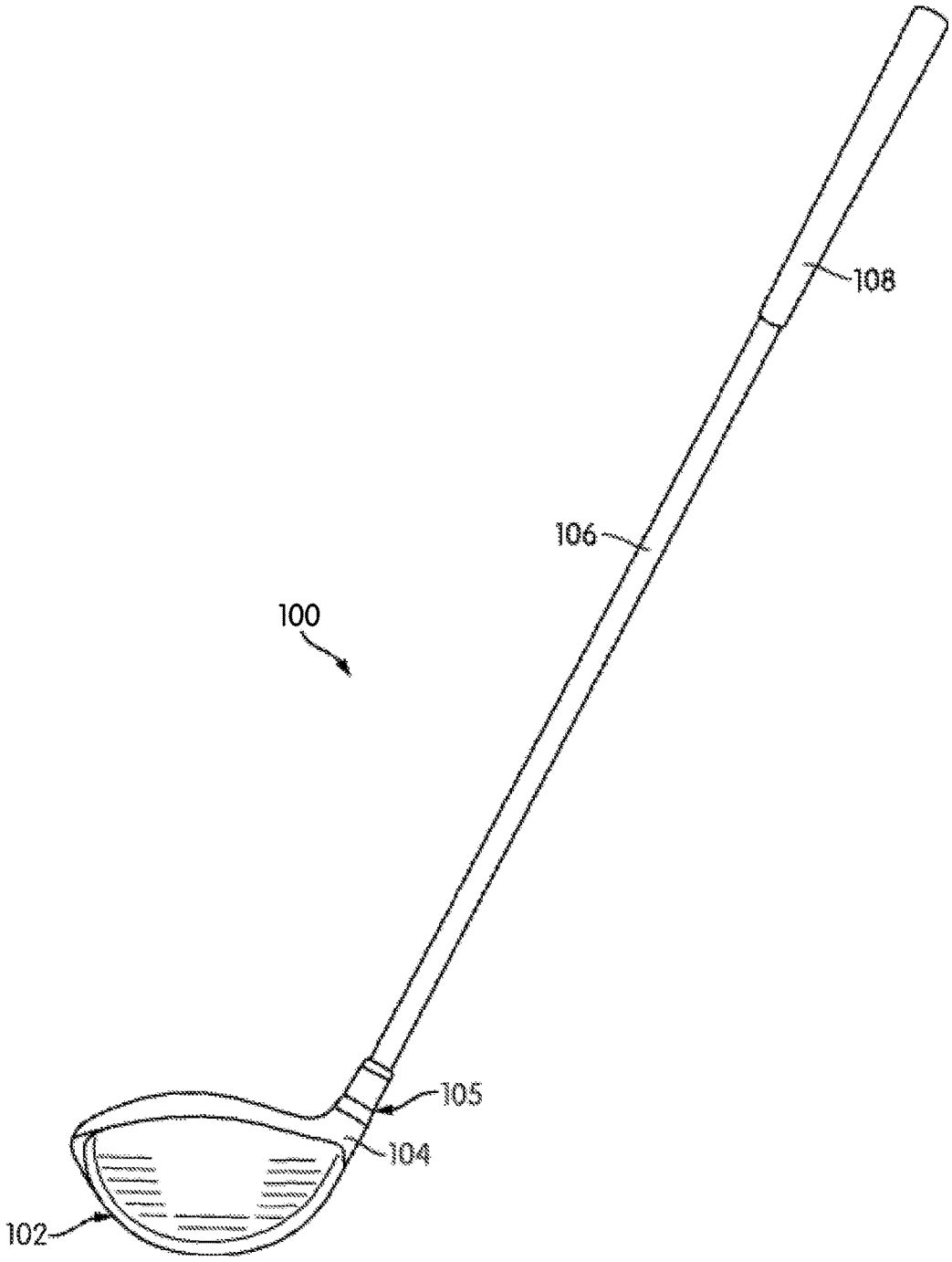
FIG. 1A is a front elevation view of an example golf club and golf club head structure according to one or more aspects described herein.

The figures referred to above are not drawn necessarily to scale, should be understood to provide a representation of particular embodiments of the invention, and are merely conceptual in nature and illustrative of the principles involved. Some features of the golf club and golf club head structures depicted in the drawings have been enlarged or distorted relative to others to facilitate explanation and understanding. In certain instances, the same reference numbers are used in the drawings for similar or identical components and features shown in various alternative embodiments. Golf clubs and golf club head structures as described herein may have configurations and components determined, in part, by the intended application and environment in which they are used.

DETAILED DESCRIPTION

In the following description of various example structures in accordance with the invention, reference is made to the accompanying drawings, which form a part hereof, and in which are shown by way of illustration various example articles, including one or more golf club or golf club head structures. Additionally, it is to be understood that other specific arrangements of parts and structures may be utilized and structural and functional modifications may be made without departing from the scope of the present invention. Also, while the terms "top," "bottom," "front," "back," "rear," "side," "underside," "overhead," and the like may be used in this specification to describe various example features and elements of the invention, these terms are used herein as a matter of convenience, e.g., based on the example orientations shown in the figures and/or the orientations in typical use. Nothing in this specification should be construed as requiring a specific three dimensional or spatial orientation of structures in order to fall within the scope of this invention. Further, the invention generally will be described as it relates to wood-type golf clubs. In particular, the club heads disclosed herein will be drivers and fairway woods in exemplary embodiments. However, aspects of the invention may be used with any of several types of golf clubs, including hybrid type golf clubs, utility clubs, putters, and the like and nothing in the specification or figures should be construed to limit the invention to use with the wood-type golf clubs described.

FIG. 1A generally illustrates an example golf club 100 and/or golf club head 102 in accordance with this invention. In addition to the golf club head 102, the overall golf club structure 100 of this example includes a hosel 104, a shaft 106 received in and/or inserted into and/or through the hosel 104, and a grip or handle 108 attached to the shaft 106. Optionally, if desired, the external hosel 104 may be eliminated and the shaft 106 may be directly inserted into and/or otherwise attached to the head 102 (e.g., through an opening provided in the top of the club head 102, through an internal hosel (e.g., provided within an interior chamber defined by the club head 102), etc.). The hosel 104 may be considered to be an integral part of the golf club head 102 or could also be a separate structure attached to the golf club head 102. As will described in greater detail below, the golf club 100 may utilize an adjustment member 105 that in one exemplary embodiment is associated with the hosel 104.

The shaft 106 may be received in, engaged with, and/or attached to the club head 102 in any suitable or desired manner, including in conventional manners known and used in the art, without departing from the invention. As more specific examples, the shaft 106 may be engaged with the club head 102 via the hosel 104 and/or directly to the club head structure 102, e.g., via adhesives, cements, welding, soldering, mechanical connectors (such as threads, retaining elements, or the like) and further including releasable adjustable members or connectors, etc.; through a shaft-receiving sleeve or element extending into the body of the club head 102; etc. The shaft 106 also may be made from any suitable or desired materials, including conventional materials known and used in the art, such as graphite based materials, composite or other non-metal materials, steel materials (including stainless steel), aluminum materials, other metal alloy materials, polymeric materials, combinations of various materials, and the like. Also, the grip or handle 108 may be attached to, engaged with, and/or extend from the shaft 106 in any suitable or desired manner, including in conventional manners known and used in the art, e.g., using adhesives or cements; via welding, soldering, adhesives, or the like; via mechanical connectors (such as threads, retaining elements, etc.); etc. As another example, if desired, the grip or handle 108 may be integrally formed as a unitary, one-piece construction with the shaft 106. Additionally, any desired grip or handle 108 materials may be used without departing from this invention, including, for example: rubber materials, leather materials, rubber or other materials including cord or other fabric material embedded therein, polymeric materials, and the like.

Figure 1B:
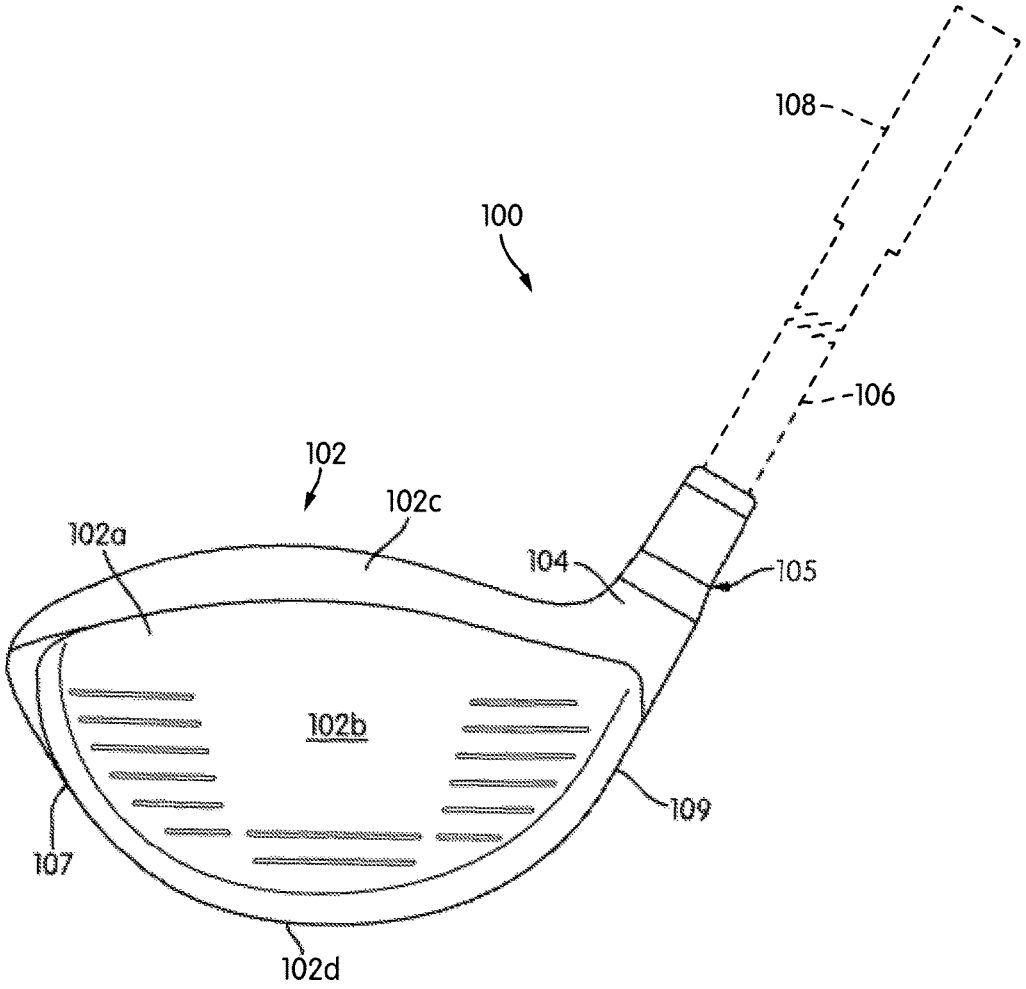
FIG. 1B is an enlarged front elevation view of an example golf club and golf club head structure according to one or more aspects described herein.
Figure 2:
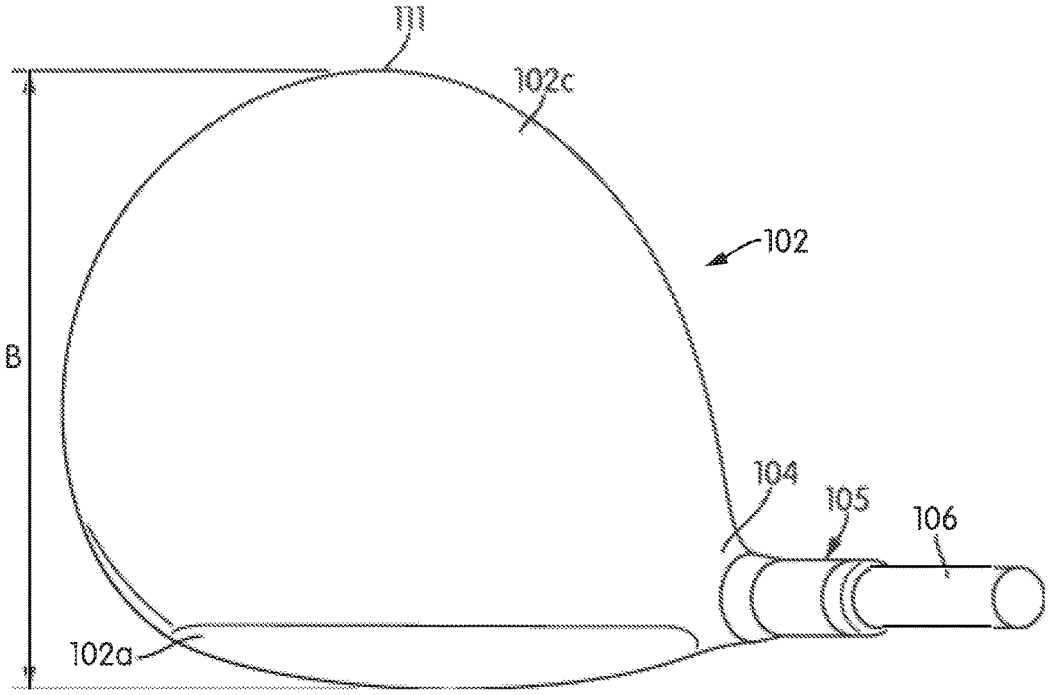
FIG. 2 is a plan view of the example golf club and golf club head structures of FIGS. 1A and 1B according to one or more aspects described herein.
Figure 3:
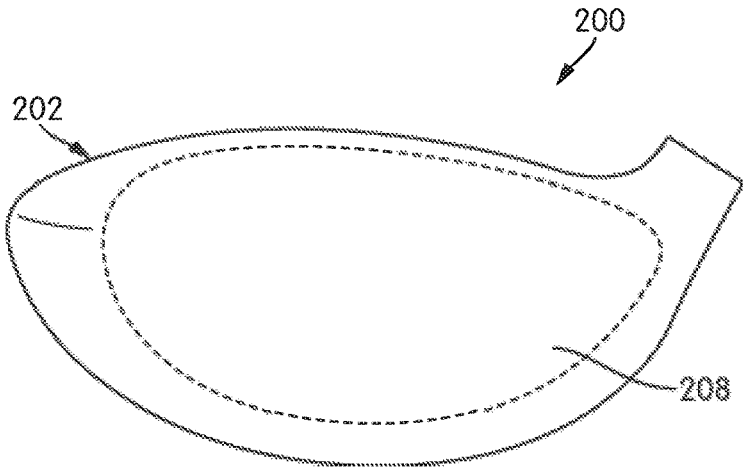
FIG. 3 illustrates a front elevation view of the example golf club head according to one or more aspects described herein.
Figure 4:
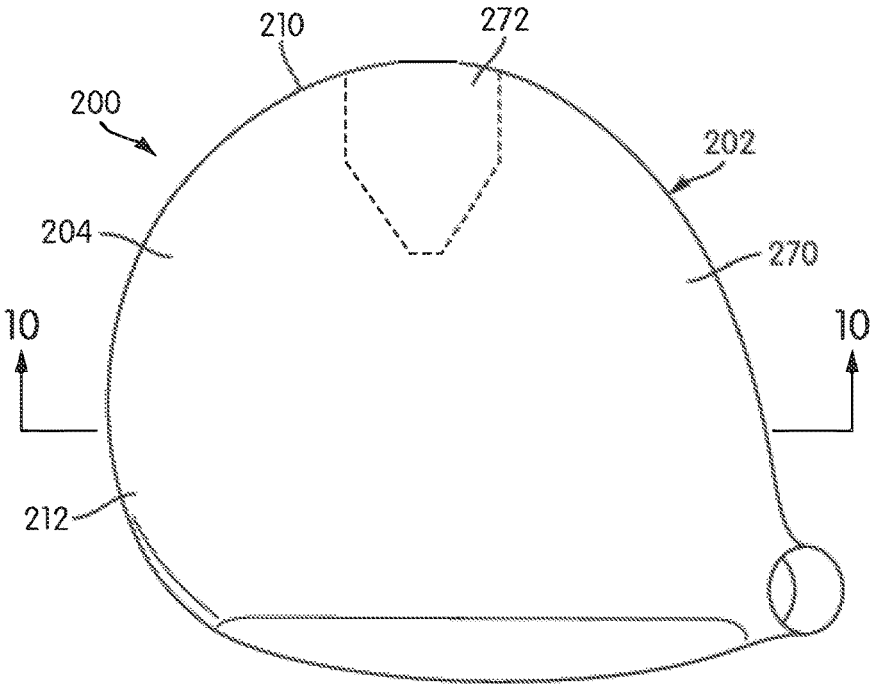
FIG. 4 is a plan view of the golf club head shown in FIG. 3.
Figure 5:
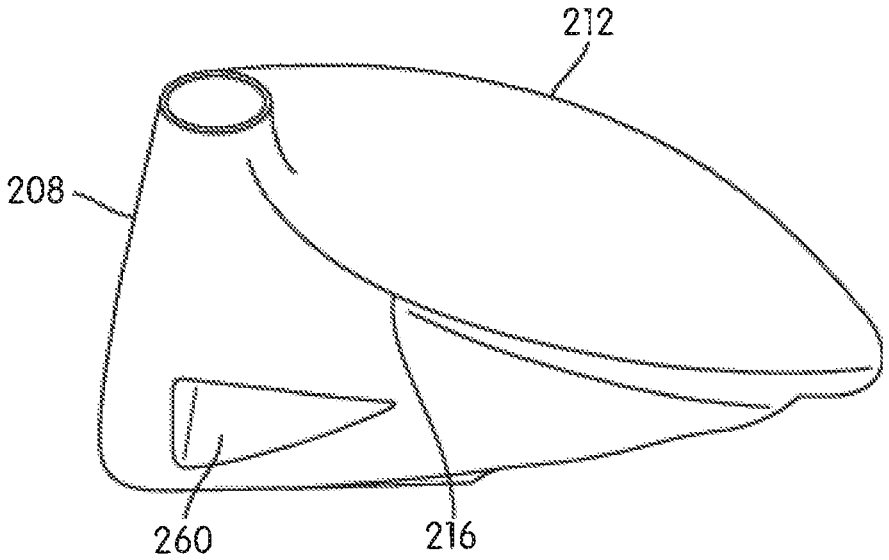
FIG. 5 is a side view of the golf club head of FIG. 3.

The club head 102 itself also may be constructed in any suitable or desired manner and/or from any suitable or desired materials without departing from this invention, including from conventional materials and/or in conventional manners known and used in the art. For example, in the example club head 102 shown in FIGS. 1A and 1B, the club head 102 includes a front face 102*a* that generally includes a ball striking surface 102*b* (optionally including a ball striking face plate integrally formed with the ball striking surface 102*a* or attached to the club head such that the face plate and a frame together constitute the overall ball striking surface 102*a*). The front face 102*a* may be considered a ball striking face 102*a*. The club head 102 may further include a top 102*c* or crown, a sole 102*d*, a toe 107 and a heel 109. The club head 102 may also include a rear 111 (FIG. 2).

A wide variety of overall club head constructions are possible without departing from this invention. For example, if desired, some or all of the various individual parts of the club head 102 described above may be made from multiple pieces that are connected together (e.g., by welding, adhesives, or other fusing techniques; by mechanical connectors; etc.). The various parts (e.g., crown, sole, front face, rear, etc.) may be made from any desired materials and combinations of different materials, including materials that are conventionally known and used in the art, such as metal materials, including lightweight metal materials, and the like. More specific examples of suitable lightweight metal materials include steel, titanium and titanium alloys, aluminum and aluminum alloys, magnesium and magnesium alloys, etc. Additionally or alternatively, the various parts of the club head may be formed of one or more composite materials. Injection molded parts are also possible. The club head 102 also may be made by forging, casting, or other desired processes, including club head forming processes as are conventionally known and used in the art. The golf club head 102 could further be formed in a single integral piece.

The various individual parts that make up the club head structure 102, if made from multiple pieces, may be engaged with one another and/or held together in any suitable or desired manner, including in conventional manners known and used in the art. For example, the various parts of the club head structure 102, such as the front face 102*a*, ball striking surface 102*b*, the top 102*c*, the sole 102*d*, etc., may be joined and/or fixed together (directly or indirectly through intermediate members) by adhesives, cements, welding, soldering, or other bonding or finishing techniques; by mechanical connectors (such as threads, screws, nuts, bolts, or other connectors); and the like. If desired, the mating edges of various parts of the club head structure 102 may include one or more raised ribs, tabs, ledges, or other engagement elements that fit into or onto corresponding grooves, slots, surfaces, ledges, openings, or other structures provided in or on the facing side edge to which it is joined. Cements, adhesives, mechanical connectors, finishing material, or the like may be used in combination with the raised rib/groove/ledge/edge or other connecting structures described above to further help secure the various parts of the club head structure 102 together.

The dimensions and/or other characteristics of a golf club head structure according to examples of this invention may vary significantly without departing from the invention, and the dimensions may be consistent with those commonly used in the art for similar club heads and clubs.

Several embodiments of golf club heads are disclosed herein. It is understood that the description of the club head and various components described above regarding FIGS. 1A, 1B and 2 will apply to the other embodiments described herein. It will be appreciated that the several different embodiments may utilize a geometric weighting feature. The geometric weighting feature may provide for reduced head weight and/or redistributed weight to achieve desired performance. For example, more weight may be positioned towards the rear ends of the heel and toe of the club head 102. In the various embodiments disclosed herein, the golf club head 102 may have a body having spaced legs defining a void, space or gap in between the legs. The club heads herein may be considered to have a portion removed to define the void, space or gap. The body may include a cover that is positioned over the void and/or the legs, and may be an integral component of the body or separately attached. Additional support members and/or weight assemblies may also be utilized with certain embodiments. The adjustment member may also be utilized with the several embodiments described herein.

FIGS. 3-33 disclose additional embodiments of the club head according to aspects of the present invention. In particular, FIGS. 3-21 disclose an embodiment of the golf club head according to at least some aspects of the invention, generally designated with the reference numeral 200. The golf club head 200 generally includes a golf club head body 202 and a cover 204. In this particular embodiment, the cover 204 is formed as an integral portion of the club head body 202, such as from a casting manufacturing process. The golf club head 200 has a geometric weighting feature associated therewith. The golf club head 200 generally has a front or ball striking face 208, a rear 210, a top 212 or crown 212, a sole 214, a heel 216, and a toe 218. It is understood that these structures correspond to structures discussed above regarding FIGS. 1A, 1B and 2, wherein the ball striking face 208 corresponds to the front face 102*a*, the rear 210 corresponds to the rear 111, the crown 212 corresponds to the crown 102*c*, the sole 214 corresponds to the sole 102*d*, the heel 216 corresponds to the heel 109 and the toe 218 corresponds to the toe 107. It is further understood that the golf club head body 202 defines an internal cavity 219.

Figure 10:
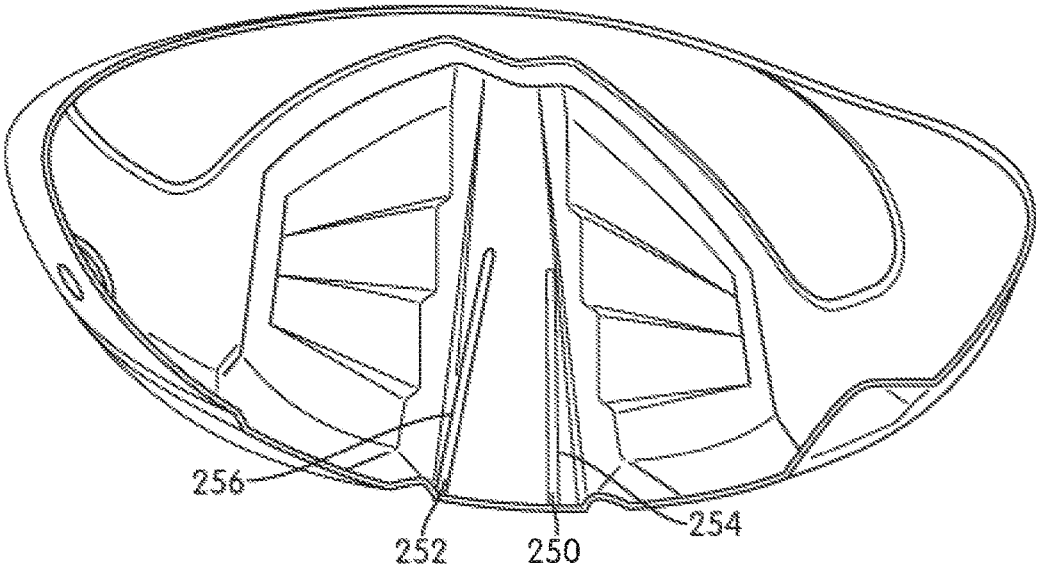
FIG. 10 is a cross-sectional view of the golf club head of FIG. 3, general taken along line 10-10 in FIG. 4.
Figure 11:
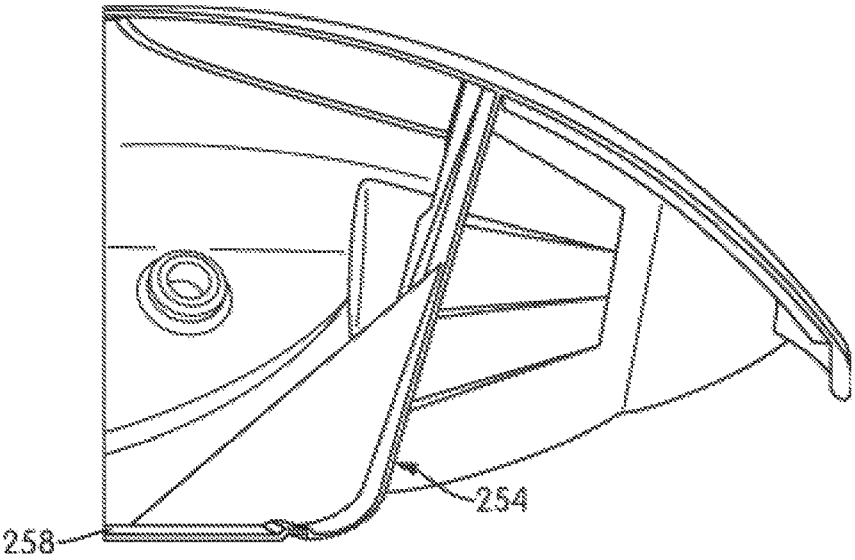
FIG. 11 is a cross-sectional view of the golf club head of FIG. 3.
Figure 12:
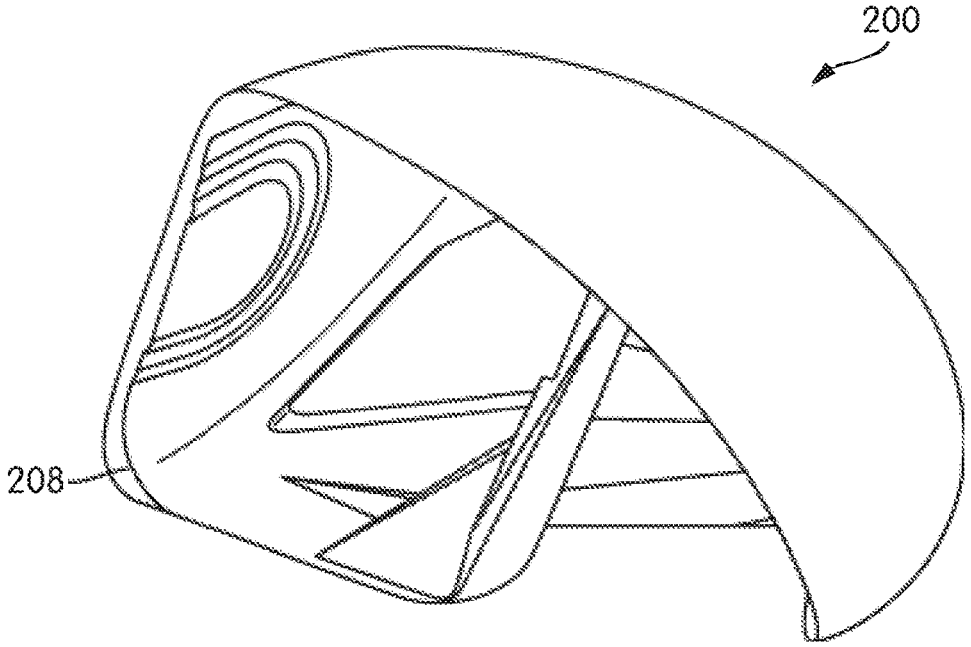
FIG. 12 is a partial cross-sectional view of the golf club head of FIG. 3 and showing a ball striking face having a variable face thickness.

As shown in FIGS. 3-14, the golf club head body 202 has a base member 220 and a first leg 222 and a second leg 224. As the club head body 202 is generally an integral structure in this embodiment, the base member 220 and legs 222, 224 may be considered to depend from the cover 204. In this manner, the cover 204, which is generally the crown 212 in this embodiment, is tied or connected to the sole 214 by additional structures as described herein. The base member 220 generally extends from the heel 216 to the toe 218 and defines the ball striking face 208 on one side. The base member 220 assists in defining a portion of the internal cavity 219 and in an exemplary embodiment, the internal cavity 219 extends from an inner surface of the ball striking face 208 and into the end of the internal areas defined by the legs 222, 224 and cover 204. As can be appreciated from the drawings, the inner surface of the ball striking face 208 faces into the internal cavity 219 and is further in communication with portions of the internal cavity 219 defined by the first leg 222 and the second leg 224. The ball striking face 208 may utilize a variable face construction and be separately connected to the club head body 202. The variable face construction may take one of the forms as disclosed and described in U.S. patent application Ser. No. 13/211,961, which is incorporated by reference herein and made a part hereof. As shown in FIG. 12, in one exemplary embodiment, the ball striking face 208 may have multiple thicknesses in a stepped configuration such that a central portion of the ball striking face 208 has a thickness of approximately 3.5 millimeters that is then stepped to an intermediate portion having a thickness of approximately 2.8 millimeters that is further stepped to an outer portion have a thickness of approximately 2.1 millimeters. Other variable face thickness configurations are also possible without departing from the principles of the present invention.

Figure 7:
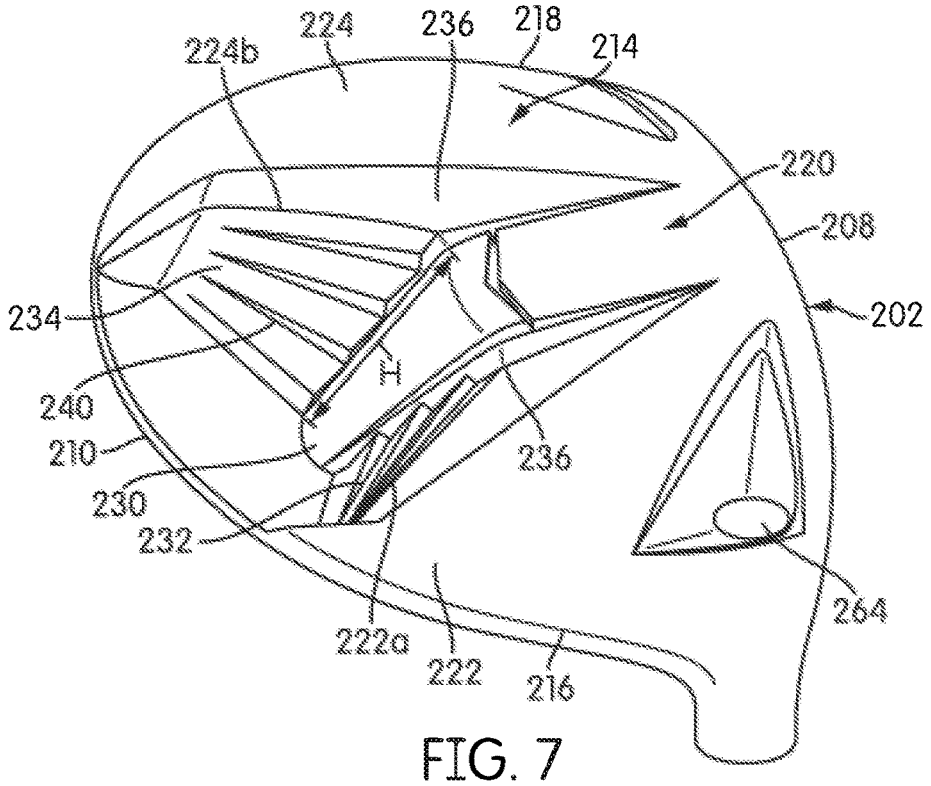
FIG. 7 is a bottom perspective view of the golf club head of FIG. 3.
Figure 8:
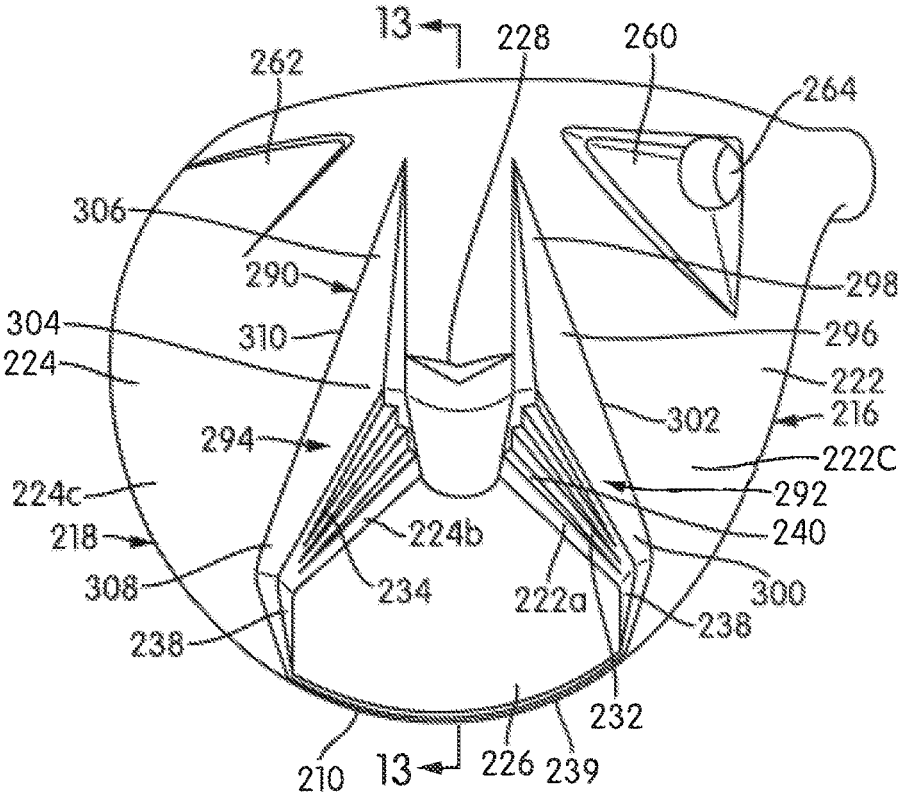
FIG. 8 is a bottom view of the golf club head of FIG. 3.

As shown in FIGS. 7-8, the first leg 222 extends away from the ball striking face 208, and the second leg 224 extends away from the ball striking face 208. The first leg 222 and the second leg 224 extend respectively towards the rear 210 of the club at the heel 216 and toe 218 of the club head 200. In an exemplary embodiment, the legs 222, 224 extend consistently from an interface area 228 to be described and towards the rear 210 at the heel 216 and the toe 218. Thus, the legs 222, 224 extend continuously from the interface area 228 outwardly towards the heel 216 and toe 218 of the club head 200, and generally in a linear configuration. The legs 222, 224 could extend in a non-linear configuration. The legs 222, 224 could also extend at different lengths to achieve further weight distribution and performance characteristics.

The club head 200 utilizes the geometric weighting feature and in an exemplary embodiment, a void 226, or space or gap, is defined between the first leg 222 and the second leg 224. Thus, it may be considered that this portion of the golf club head 200 is removed to form or define the void 226. In a further exemplary embodiment the void 226 is generally v-shaped. Thus, the first leg 222 and second leg 224 converge towards one another and generally meet at an interface area 228. The void 226 has a wider dimension at the rear 210 of the club head 200 and a more narrow dimension proximate a central region of the club head 200 generally at the interface area 228. The void 226 opens to the rear 210 of the club head 200. In one exemplary embodiment, the interface area 228 has a height H and is positioned proximate a central portion or region of the body 202 and defines a base support wall 230. The base support wall 230 may have a rounded surface that faces into the void 226. As explained in greater detail below, the first leg 222 defines a first wall 222*a*, and the second leg 224 defines a second wall 224*b*. A proximal end of the first wall 222*a* connects to one end of the base support wall 230, and a proximal end of the second wall 224*b* connects to another end of the base support wall 230. It is understood from the figures that the base support wall 230 can extend between the sole surface and the underside of the cover 204 in a general vertical configuration. In an exemplary embodiment, the base support wall 230 extends from the sole surface at an angle from a vertical axis. Thus, the base support wall 230 could extend along its length towards the rear 210 of the club head or towards the ball striking face 208. The base support wall 230 may meet a sole surface of the golf club head 200 to define a ridge location. It is understood that the legs 222, 224 and walls 222*a*, 224*b* can vary in length and can also be different lengths. External surfaces of the walls 222*a*, 224*b* face into the void 226 and may be considered to form a portion of an exterior of the golf club head 200.

An angle A is defined between the legs 222, 224 which angle can vary in degree, including a right angle, acute angles or obtuse angles. In one exemplary embodiment, the angle A can be in the general range of 30 degrees to 110 degrees, and more specifically 45 degrees to 90 degrees. It is further understood that the angle A can change from a location proximate the sole 214 to a location proximate an underside of the cover or crown 212. Accordingly, a shown in FIG. 21B, an angle A1 may be provide at an underside surface of the crown (i.e., at junction of depending walls and underside surface of crown) and an angle A2 may be provided proximate the sole. The angle A could also change along the length of the legs 222, 224. The legs 222, 224 could also extend from the interface area 228 at different angles in a non-symmetrical fashion to provide desired performance characteristics. It is further understood that the void 226 and also the legs 222, 224 could be positioned in a rotated configuration about the central region such as rotated more towards the rear heel of the club head 200 or rotated more towards the rear toe of the club head 200. It is also understood that the interface area 228 could be positioned at various locations between the heel 216 and toe 218 and the golf club head 200. While a v-shaped void 226 is formed, the void 226 could take other forms including a more u-shaped defined void wherein the interface area 228 defines a more extended base support wall 230 that separates the legs 222, 224, even if the legs 222, 224 extend at an angle or are generally transverse to the ball striking face 208. It is understood that the base support wall 230 can vary in width.

With such structures, it is understood that the internal cavity 219 does not extend completely from an inner surface of the ball striking face 208 to a rear 210 of the golf club head 200. Thus, the internal cavity 219 is interrupted proximate the central region of the club head 200. It is further understood that the geometric weighting feature described herein is generally v-shaped wherein a width of the geometric weighting feature proximate the rear 210 is greater than a width of the geometric weighting feature towards the ball striking face 208.

As further shown in FIGS. 7-8, the first leg 222 defines a first wall 222*a* having a first external side surface 232 and the second leg 224 defines a second wall 224*b* having a second external side surface 234. It is further understood that a first internal side surface 232*a* is defined opposite the first external side surface 232 and faces into the internal cavity 219. Similarly, a second internal side surface 234*b* is defined opposite the second external side surface 234 and faces into the internal cavity 219. Each side surface 232, 234 has a proximal end 236 positioned at the interface area 228 and further has a distal end 238 at the rear 210 of the club 200. In an exemplary embodiment, the distal ends 238 extend inwards from the majority portion of the side surfaces 232, 234. As can be appreciated from FIGS. 7-8, inwardly extending the distal ends 238 of the side surfaces 232, 234 shortens a length of an arc 239 of the rear 210 of the club head 210 between the distal ends 238. This can have a desired effect on the sound characteristics of the golf club head 200. In still other exemplary embodiments, such desired effects may prompt the distal ends 238 to extend outward therefore lengthening the arc 239 at the rear 210 between the distal ends 238. The distal ends 238 may also have a straightened configuration. The respective heights of the distal ends 238 further decrease towards the rear 210 of the club head 200. As can be appreciated from FIGS. 7-8, the first leg 222 and second leg 224, and first wall 222*a* and second wall 224*b* extend from the crown 212 to the sole 214 and connect the crown 212 and the sole 214. The first external side surface 232 and the first internal side surface 232*a* extend from the crown 212 to the sole 214. The second external side surface 234 and the second internal side surface 234*b* also extend from the crown 212 to the sole 214.

Figure 6:
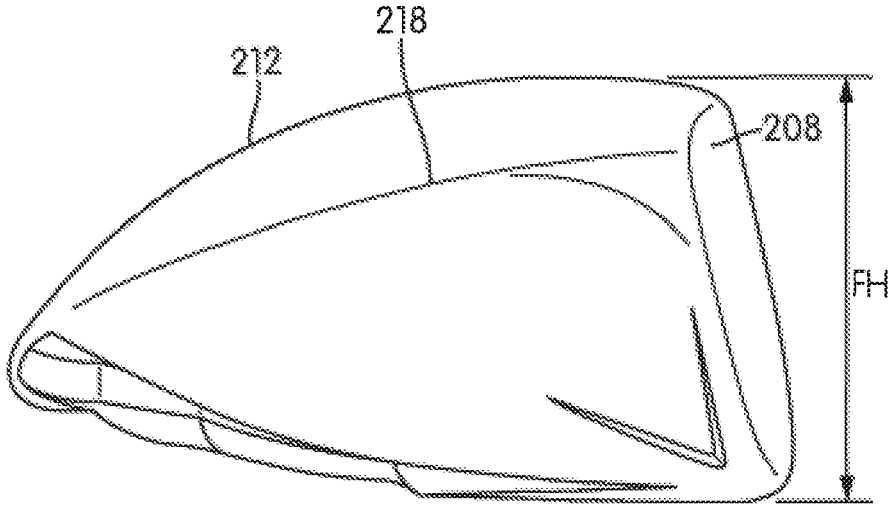
FIG. 6 is an opposite side view of the golf club head of FIG. 3.

As further shown in FIG. 7, the side surfaces 232, 234, and walls 222*a*, 224*b*, have a greater height at the proximal ends 236 wherein the surfaces extend to a lesser height towards the distal ends 238. This height generally corresponds to the height H shown schematically in FIG. 7. For example, in one exemplary embodiment for a driver type golf club head, the height of the side surfaces 232, 234 at the proximal ends 236 from an underside of the cover 204 to the sole of the club head 200 proximate the base support wall 230 is approximately 48-62 millimeters. This height can be considered the depth of the void 226 proximate the interface area 228. In one particular driver type golf club head, this height is approximately 52 millimeters while the ball striking face height at a face center of the golf club head is approximately 58 millimeters. The ball striking face height FH is generally represented in FIG. 6 with the understanding that the height is taken at a face center and from a ground plane to a face height point represented by a center of radius generally between the crown and the ball striking face. In another particular driver type golf club head, this height is approximately 60 millimeters and the ball striking face height at a face center is approximately 62 millimeters. In a fairway type golf club head, this height is approximately 33 millimeters and the ball striking face height at a face center is approximately 35 millimeters. In a hybrid type golf club head, this height is approximately 33 millimeters and the ball striking face height at a face center is approximately 38 millimeters. Generally, this height may be approximately 85%-100% of the ball striking face height at a face center of the golf club head. Such configurations allow the cover or crown geometry to be dimensioned such that the desired performance characteristics of the club head are achieved. The height of the side surfaces 232, 234 proximate the distal ends 238 from an underside of the cover 204 to the sole 214 is generally less at the distal ends 228.

In one exemplary embodiment, the side surfaces 232, 234 each have a plurality of ribs 240 or ridges extending from the proximal ends 236 towards the distal ends 238. Thus, the side surfaces 232, 234 have a stepped configuration or undulations. Such structures assist in adding a certain amount of rigidity to the body 202. It is understood that a single rib 240 could be used and only a single leg 222, 224 could have a rib 240. The rib 240 could further vary in length along the legs 222, 224 as well as be configured at an angle along the legs 222, 224 or also have a more vertical configuration. Other rigidity-enforcing structures could also be employed on the legs 222, 224 or other portions of the golf club head 200. It is further understood that in exemplary embodiments, the first leg 222 is generally defined by the first side surface 232 and the club head body 202 forming the heel 216 of the club head 200, and the second leg 224 is generally defined by the second side surface 224 and the club head body 202 forming the toe 218 of the club head 200. As can be appreciated from the figures, the sole 214 of the club head body 202 may be defined as adjacent the ball striking face 208, towards the central region of the club head 200 at the interface area 228 and to the distal ends of the first leg 222 and the second leg 224.

Figure 9:
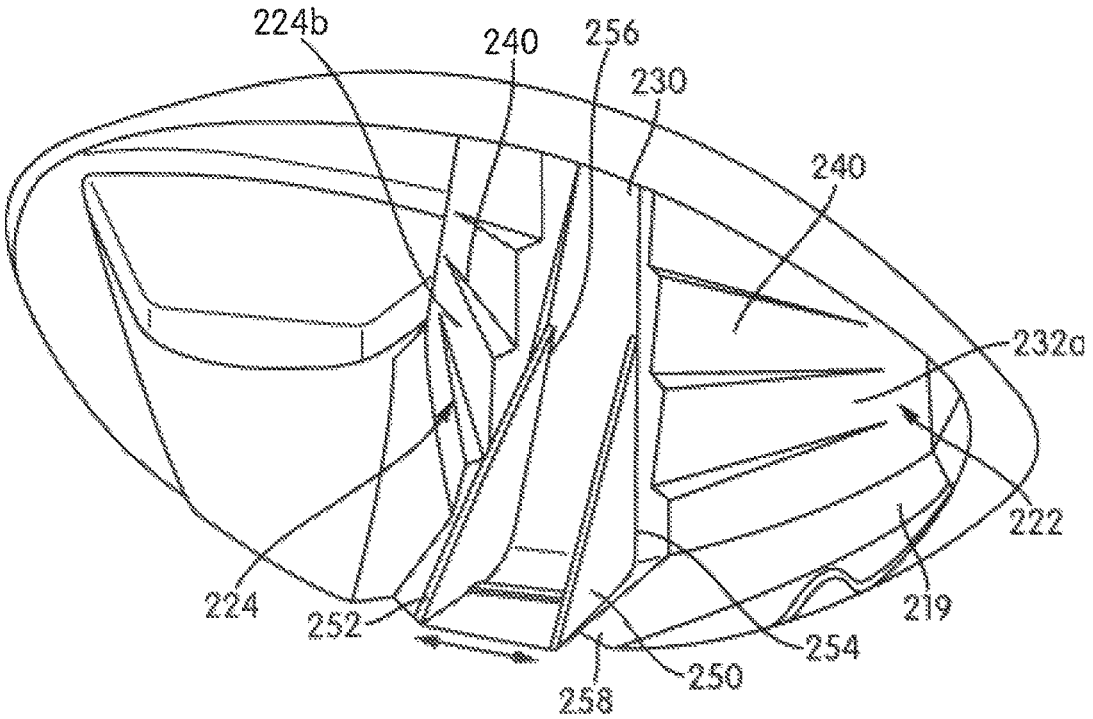
FIG. 9 is a cross-sectional view of the golf club head of FIG. 3.

As can be further appreciated from FIGS. 7-9, the first wall 222*a* has the first external side surface 232 that faces externally from the club head body 202 and into the void 226 in an exemplary embodiment. The first wall 222*a* further has the first internal side surface 232*a* that faces into the internal cavity 219 of the club head body 202. The second wall 224*b* has the second external side surface 234 that faces externally from the club head body 202 and into the void 226 in an exemplary embodiment. The second wall 224*b* further has the second internal side surface 234*b* that faces into the internal cavity 219 of the club head body 202. The walls and surfaces extend from the crown 212 or cover 204 to the sole 214 and generally tie these structures together.

The club head body 202 defines additional internal support structures in the internal cavity 219 to enhance features of the club head 200. The structures may be internal support members, gussets, or fins, positioned in the internal cavity 219 to provide additional support to components of the club head 200. Accordingly, as shown in FIG. 9, the club head 200 includes a first gusset member 250 and a second gusset member 252. In an exemplary embodiment, the first gusset member 250 and the second gusset member 252 are triangle-shaped members, and generally right triangle members in particular, although it is understood that the gussets 250, 252 can have certain contoured outer sides. The gussets 250, 252 may have a constant or variable thickness. The first gusset member 250 is positioned proximate an internal surface of the first leg 222 and an internal surface of the interface area 228. In particular, the first gusset member 250 is positioned proximate a proximal end of the first internal side surface 232*a*. The second gusset member 252 is positioned proximate an internal surface of the second leg 224 and an internal surface of the interface area 228. In particular, the second gusset member 252 is positioned proximate a proximal end of the second internal side surface 234*b*. The first gusset member 250 is in spaced relation to the second gusset member 252. In particular, the first gusset member 250 has one side, or first side, connected proximate a first interface junction 254 of the base support wall 230 and the first leg 222, and has a bottom side, or second side, connected to an internal sole surface 258. Similarly, the second gusset member 252 has one side, or first side, connected proximate a second interface junction 256 of the base support wall 230 and the second leg 224, and has a bottom side, or second side, connected to the internal sole surface 258. The gusset members 250, 252 generally extend from the base support wall 230 towards the ball striking face 208. It is understood that the gusset members 250, 252 can be moved inwards and connected on the inner surface of the base support wall 230.

As further shown in FIG. 9, the gusset members 250, 252 extend upwards on a portion of the base support wall 230 at the interface area 228. This distance can vary and may or may not extend fully to an underside surface of the cover 204 of the club head 200. Similarly, the gusset members 250, 252 are dimensioned to extend along a portion of the internal sole surface 258, which distance can also vary. FIGS. 10 and 11 show additional views of the gusset members 250, 252. In an exemplary embodiment, the gusset members 250, 252 diverge on the internal sole surface 258 as shown by the arrows in FIG. 9 as the members extend towards the ball striking face 208. As shown in FIG. 10, it is understood that the gusset members 250, 252 may extend vertically up the surface of the base support wall 230 at an angle. It is further understood that additional support members could be connected between the gusset members 250, 252 as desired. It has been determined that based on the particular construction of the club head 200, upon ball impact, portions of the club head 200 can flex, such as at the interface area 228. Sound upon ball impact is also affected with the particular construction of the golf club head 200.

The first gusset member 250 and the second gusset member 252 assist in adding stiffness, rigidity and load strength at the interface area 228 and limits flexing as desired to provide the desired performance characteristics including acoustic properties. Increased durability is also achieved. The gusset members 250, 252 do not add significant additional weight to the golf club head 200. With such constructions, weight distribution can be further maximized to be moved towards the rear at the heel 216 and the toe 218. The configuration of the void 226 can then also be maximized. These constructions further adjust sound characteristics of the golf club head 200 upon ball impact to desired frequency levels. It is noted that the sole surface is generally solid at locations where the gusset members engage and extend along the inner surface of the sole 214. Thus, no other weight port structures are positioned at the gusset members in an exemplary embodiment.

It is understood that additional gusset members could be utilized if desired or gusset members having different configurations than shown could also be utilized. For example, multiple gusset support members could span around different locations at the interface area or inner surfaces of the first leg and second leg. The gusset members 250, 252 could also be connected at the internal surfaces 232*a*, 234*b* of the legs rather than at the interface junctions 254, 256. The gusset members 250, 252 could also extend to and be connected to other internal surfaces of the club head. In addition, the gusset members 250, 252 could be dimensioned to extend across the interface face area 228 and against the internal surfaces 232*a*, 234*b* of the legs 222, 224 towards the rear of the golf club head 200. The gusset members 250, 252 are metallic members in one exemplary embodiment but other materials are possible including composite materials. It is further understood that the gusset support members could be cast or otherwise integrally formed with the club head body in the same forming process. The gusset support members can also be formed separately and later connected as described above such as by welding, adhesives or other connection techniques. While the gusset members are shown as triangular members in one exemplary embodiment, the gusset members could take many different shapes and sizes. The gusset members could further have certain cut-out portions or contours as desired.

Figure 13:
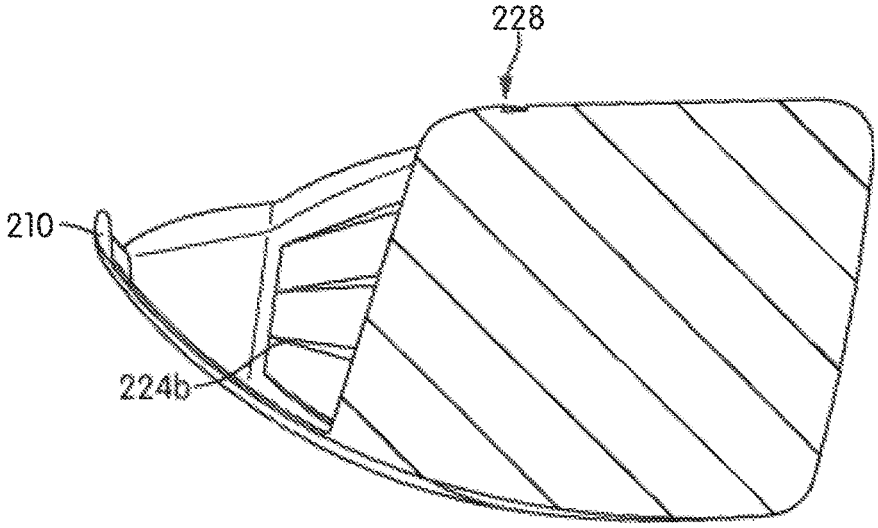
FIG. 13 is a cross-sectional view of the golf club head taken along Line 13-13 of FIG. 8.
Figure 14:
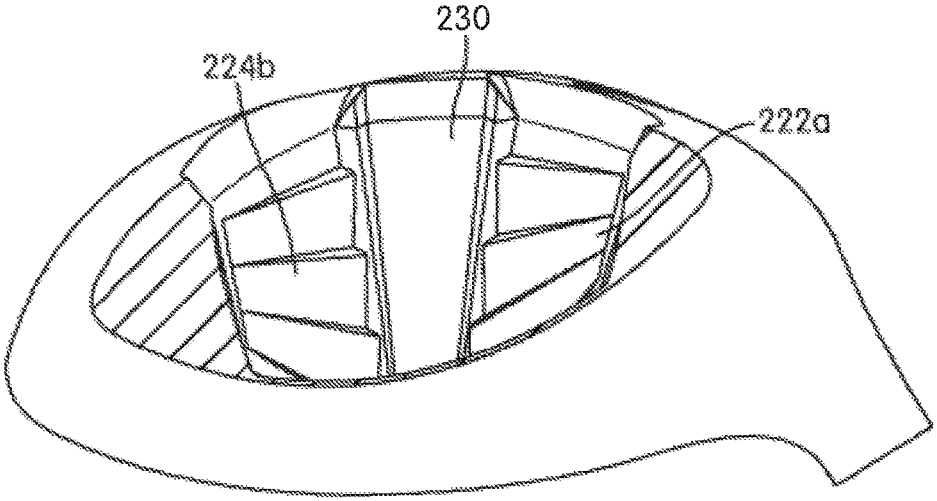
FIG. 14 is a rear partial cross-sectional view of the golf club head of FIG. 3 wherein a portion of the crown is removed.
Figure 15:
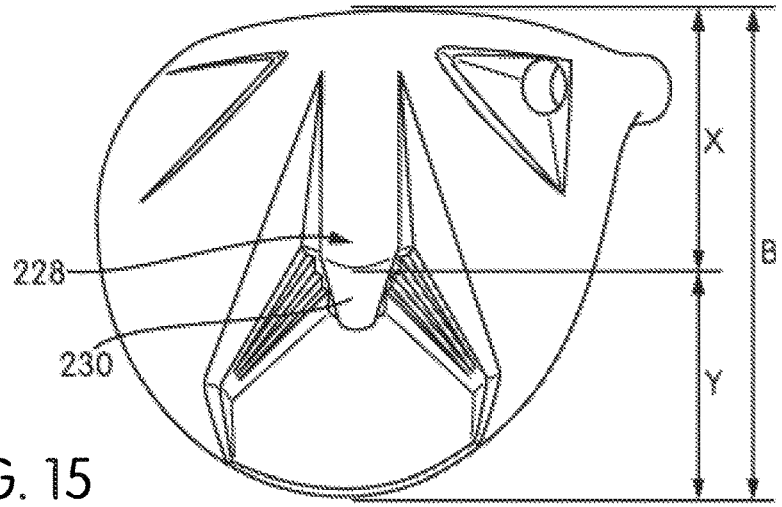
FIGS. 15-17 illustrate further alternative embodiments of the golf club head, similar to the golf club head of FIG. 3, according to one or more aspects described herein.
Figure 16:
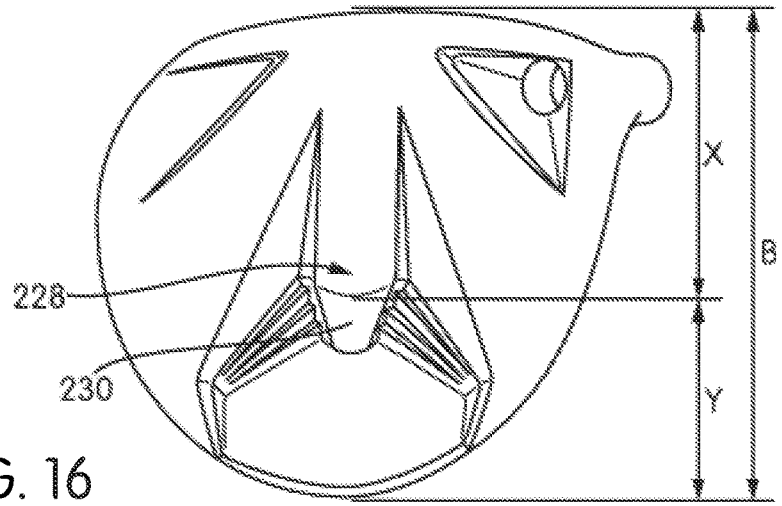
Figure 17:
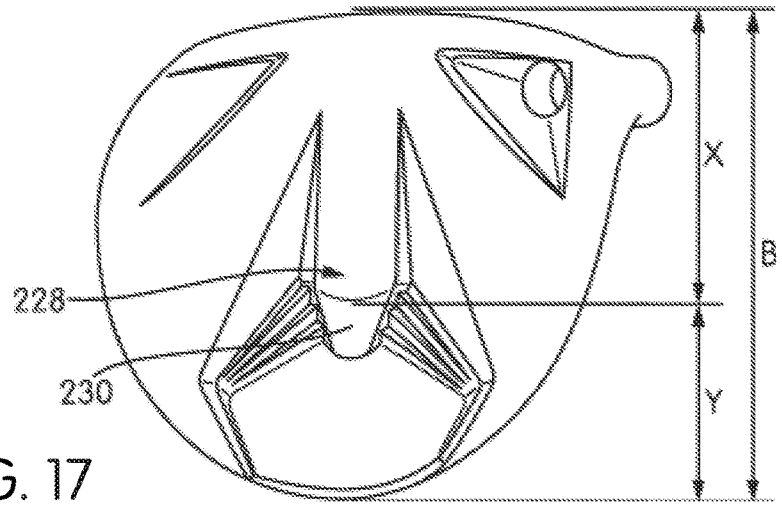

As further shown in FIG. 8, the interface area 228 is positioned at generally a central portion or central region of the club head 200 between the ball striking face 208 and rear 210 of the golf club head 200. The club head 200 has a breadth dimension B generally defined as a distance from the ball striking face 208 to the rear 210 of the club 200. (See, e.g. FIG. 2). As further shown in FIGS. 15-17, the base support wall 230 of the interface area 228, proximate the sole surface, is positioned at approximately "x" distance from the ball striking face 208. Alternatively, the base support wall 230 of the interface area 228, proximate the sole surface, is positioned at approximately "y" distance from the rear 210 of the golf club head 200. Considered in an alternative fashion, the interface area 228 may be positioned at a range of approximately 30%-60% of the breadth B of the club 200, measured from the ball striking face 208, or 40%-70% of the breadth B of the club 200, measured from the ball striking face 208. In a further exemplary embodiment, this range can be approximately 40%-50% of the breadth B of the club 200, measured from the ball striking face 208, or 40%-60% of the breadth B of the club 200, measured from the ball striking face 208. In one exemplary embodiment for a driver type club, the overall breadth is approximately 4.365 inches and the distance from the ball striking face 208 to the support wall 230 is approximately 1.875 inches. In another exemplary embodiment for a driver type club, the overall breadth is approximately 4.45 inches and the distance from the ball striking face 208 to the support wall 230 is approximately 2.6 inches. In one exemplary embodiment for a fairway wood type golf club, the overall breadth is approximately 3.375 inches and the distance from the ball striking face 208 to the support wall 230 is approximately 1.5 inches. In another exemplary embodiment for a fairway wood type golf club, the overall breadth is approximately 3.375 inches and the distance from the ball striking face 208 to the support wall 230 is approximately 1.7 inches. In one exemplary embodiment for a hybrid type golf club, the overall breadth is approximately 2.375 inches and the distance from the ball striking face 208 to the support wall 230 is approximately 1.125 inches. In another exemplary embodiment for a hybrid type golf club, the overall breadth is approximately 2.375 inches and the distance from the ball striking face 208 to the support wall 230 is approximately 1.25 inches. From these recited dimensions, the distance y from the rear 210 of the club 200 to the base support wall 230 can be readily determined. It has been found that these dimensions can further have an effect on the club head body flexing upon ball impact and effect the sound characteristics desired for the golf club head 200. FIGS. 15-17 disclose further alternative embodiments of the golf club head 200. As shown in FIG. 12, the base support wall 230 and interface area 228 are positioned closer to the ball striking face 208. In FIGS. 13 and 14, the base support wall 230 and interface areas 228 are positioned further away from the ball striking face 208 and closer towards the rear 210 of the club head 200. Thus, these embodiments can be utilized depending on the desired characteristics of the club head 200.

As further shown in FIGS. 7-8, it is understood that the outer, bottom surfaces of the base 220 and legs 222, 224 generally define the sole 214 of the club head 200. It is further understood that the length of the base 220 from the ball striking face 208 to the interface area 228 could vary as desired. The first leg and/or base has a first recessed area 260 proximate the heel 216 of the club head 200, and the second leg and/or base has a second recessed area 262 proximate the toe 218 of the club head 200. The first recessed area 260 is further in communication with a bore 264. The bore 264 is dimensioned to receive a releasable adjustable connection mechanism for connecting the shaft to the club head 200 such as via the hosel 104. It is understood that the connection mechanism may be configured to have the ability to adjust loft, face angle and/or lie angle. It is further understood that the connection mechanism could take various different forms and also form a non-adjustable connection that merely connects the shaft to the golf club head in a non-adjustable manner. The releasable adjustable connection mechanism may further be considered an adjustment member, and further exemplary embodiments will be further described below.

As further shown in FIG. 8, the sole 214 has a transition area 290, or transition surface 290 defined therein. The transition area 290 assists as the club head shifts from a void area to a sole area. Generally, the transition area 290 is positioned proximate the interface between the first wall 222*a* and the second wall 224*b* and the respective sole surfaces defined by the first leg 222 and the second leg 224 and further provides a junction area between such structures. The transition area 290 has a first transition surface 292 and a second transition surface 294. The first transition surface 292 is radiused between the first wall 222*a* and a sole surface 222*c* of the first leg 222, thus providing a smooth transition between the more vertical first wall 222*a* and the more horizontal sole surface 222*c*, which is generally transverse to the first wall 222*a*. The first transition surface 292 has a central segment 296 having a proximal segment 298 extending therefrom and further having a distal segment 300 extending from the central segment 296 opposite the proximal segment 298. The central segment 296 is positioned proximate the interface area 228 a generally possesses a maximum width of the first transition surface 292. The proximal segment 298 extends towards the ball striking face 208 and tapers from the central segment 296 towards the ball striking face 208. While the proximal segment 298 tapers to a point, the proximal segment 298 is generally transverse to the ball striking face 208. As further shown, the proximal segment 298 is made up of multiple segments. The distal segment 300 generally extends along the first wall 222*a* and also tapers from the central segment 296 towards the rear 210 of the golf club head 200. The distal segment 300 extends generally to the rear heal area of the golf club head 200. The first transition surface 292 defines a generally linear baseline 302 extending between the proximal segment 298 and the distal segment 300.

The second transition surface 294 is radiused between the second wall 224 and a sole surface 224*c* of the second leg 222, thus providing a smooth transition between the more vertical second wall 224*b* and the more horizontal sole surface 224*c*, which is generally transverse to the second wall 224*a*. Similar to the first transition surface 292, the second transition surface 294 has a central segment 304 having a proximal segment 306 extending therefrom and further having a distal segment 308 extending from the central segment 304 opposite the proximal segment 306. The central segment 304 is positioned proximate the interface area 228 and generally possesses a maximum width of the second transition surface 294. The proximal segment 306 extends towards the ball striking face 208 and tapers from the central segment 304 towards the ball striking face 208. While the proximal segment 306 tapers to a point, the proximal segment 306 is generally transverse to the ball striking face 208. As further shown, the proximal segment 306 is made up of multiple segments. The distal segment 308 generally extends along the second wall 224*b* and also tapers from the central segment 304 towards the rear 210 of the golf club head 200. The distal segment 308 extends generally towards a rear toe area of the golf club head 200. The second transition surface 294 defines a generally linear baseline 310 extending between the proximal segment 306 and the distal segment 308.

The first transition surface 292 and the second transition surface 294 generally provide junction areas between the more vertically-oriented walls 222*a*, 224*b* and the sole surfaces 222*c*, 224*c*. The transition surfaces 292, 294 may generally comprise a convex, or outwardly radiused or contoured surface. The radius, or contour, may vary along the generally curved extent of the surfaces, and may or may not be a constant radius at any single location. It is further understood that the transition surfaces may generally comprise a concave, or inwardly radiused or contoured surface. The radius, or contour, may vary along the generally curved extent of the surfaces, and may or may not be a constant radius at any single location. It is also understood that the surfaces 292, 294 could have a beveled configuration. The transition surfaces 292, 294 could also be a more angled planar surface between the walls and sole surfaces if desired, or have more of a corner type configuration. Combinations of such configurations are also possible. The transition area 290 and surfaces 292, 294 lessen the surface intersections and can provide a more rounded or contoured configuration. These areas further assist in tying the crown 212 to the sole 214. The first transition surface 292 and the second transition surface 294 generally have equal lengths and extend along a majority of the surface of the sole 214 in one exemplary embodiment. It is understood that such length could vary, and the respective lengths of the transition surfaces 292, 294 could be different if desired. The transition surfaces 292, 294 further aid in achieving desired acoustic characteristics of the golf club head.

Figure 18:
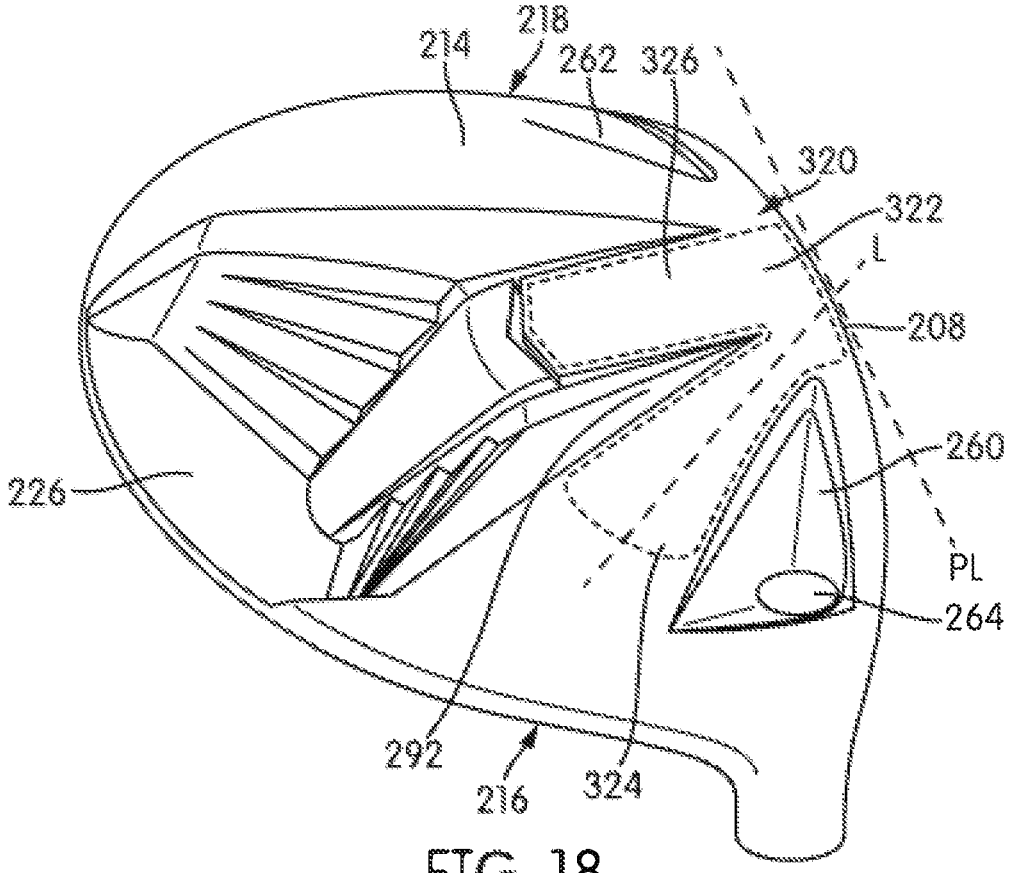
FIG. 18 is a bottom perspective view of the golf club head of FIG. 3 and showing an uninterrupted area.
Figure 19:
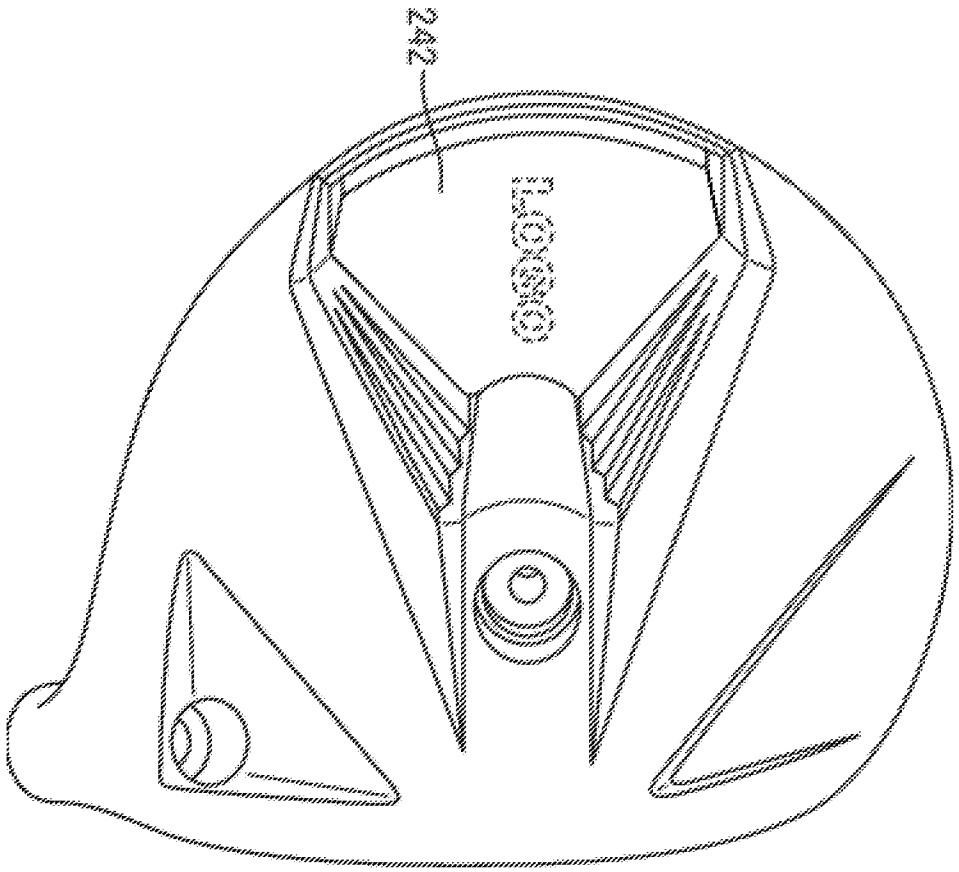
FIG. 19 is a bottom view of the golf club head of FIG. 3 and having a plaque member affixed to the head.

FIG. 18 shows another view of the sole 210 of the golf club head 200. The sole 214 generally has various surface interruptions across the overall surface of the sole 214. The void 226 is provided as well as the first transition surface 292 and the second transition surface 294. The first recessed area 260 having the bore 264 and the second recess area 262 are also provided. These structures provide various surface interruptions on the surface of the sole 214. The sole 214 further provides an uninterrupted area 320 on the surface of the sole 214. The general boundaries of the uninterrupted area 320 are represented by the phantom lines shown in FIG. 18. The uninterrupted area 320 is devoid of any bumps, ridges, projections, protuberances etc. including any indicia markings.

The uninterrupted area 320 generally includes a base area 322 and a first segment 324 extending from the base area 322 and a second segment 326 extending from the base area 322. In one exemplary embodiment, the first segment 324 is spaced from the second segment 326. In particular, the first segment 324 is spaced from the second segment 326 by the first transition surface 292. The base area 322 is generally positioned adjacent the ball striking surface 208 and generally midway between the heel 216 and toe 218. The base area 322 defines a substantially smooth surface and does not have surface interruptions including no indicia markings. The first segment 324 extends from the base area 322 at an angle along the first leg 222. In the exemplary embodiment, the first segment 322 is positioned between the first recessed surface 260 having the bore 264 and the first transition surface 292. The first segment 324 can extend at various lengths along the first leg 222. The first segment 324 has a generally longitudinal axis L that extends at an angle with respect to a plane PL generally defined by the ball striking surface 208 and shown schematically in FIG. 18. The first segment 324 may be considered to define a pathway surface and does not have surface interruptions including no indicia markings. The second segment 326 extends from the base area 322 away from the ball striking surface 208 and towards the void 226. In an exemplary embodiment, the second segment 326 extends to proximate the interface area 228 and is generally transverse to the ball striking face 208. The second segment 326 may be considered a second pathway surface and does not have surface interruptions including no indicia markings. It is understood that the particular location, shape and size of the uninterrupted area 320 can vary. The base member 322 may be maximized to accommodate different lie angles of the golf club. The uninterrupted area 320 generally defines smooth surfaces along the sole 214. Thus, the uninterrupted area 320 has a topography that is generally smooth, constant and unchanged across its extent and void of any indicia or other markings. The uninterrupted area 320 and in particular the first segment 324 and second segment 326 cooperate with the adjustment member 105 to assure desired golf club alignment by the golfer (e.g., when the golfer soles the golf club) when preparing for a golf shot. This will be explained in greater detail below.

FIGS. 3-8 disclose the cover 204. As discussed, in this embodiment, the cover 204 is integrally formed as a portion of the club head body 202 and generally defines the crown 212 of the club head 200. The cover 204 is configured to be connected to and at least cover portions of the club head body 202. The cover 204 may have a certain amount of curvature on an outer, top surface. In the exemplary embodiment shown in FIGS. 3-8, the cover 204 is dimensioned to substantially cover the club head body 202.

The cover 204 will cover the void 226 as well as the first leg 222 and second leg 224. The first leg 222 and the second leg 224 may be considered to depend from the cover 204. With such construction, and as shown generally schematically in FIG. 4, a first segment 270 of the cover 204 may be considered to be positioned over the internal cavity 219, and a second segment 272 of the cover 204 may be considered to be positioned over the void 226. The surface area of the first segment 270 is generally greater than the surface area of the second segment 272 in an exemplary embodiment. In addition, the second segment 272 is a portion of the overall area of the crown 212 or cover 204. The cover 204 has a curved outer periphery at a rear that extends over and to just beyond the distal ends of the first leg 222 and the second leg 224. In certain exemplary embodiments, the cover 204 defines the rear 210 of the club head 200 having an outermost periphery of the club head 200. If the club head body 202 is formed with a recess as discussed above, peripheral portions of the cover 204 are dimensioned to correspond with the shape of the recess on the club head body 202. An underside surface of the cover 204 confronts and is in communication with the void 226. In addition to sensor mountings as shown in other embodiments, other structures could be mounted on this surface. An underside of the cover 204 facing into the void 226 may have a plaque member adhered thereto via adhesive. The plaque has sufficient rigidity and the adhesive has sufficient resilience to promote a durable bond and vibration dampening characteristics. The plaque materials may be fiber-reinforcement plastics, metals, plastics and the like. The adhesives could be epoxies, silicone adhesives or 3M VHB double-sided tape. The plaque could also have indicia thereon facing into the void. One exemplary embodiment of a plaque member 242, or medallion 242, is shown fastened to an underside surface of the cover in the void in FIG. 19. The medallion 242 may have an outer periphery generally corresponding to the perimeter defined by the void 226 at the underside surface of the cover 204. The medallion 242 may have indicia thereon. As discussed, the cover 204 could wrap around the sole surface side the golf club to completely encase the void 226 wherein the void 226 is not seen from a top or a bottom of the club head 200. In an exemplary embodiment, however, the cover 204 extends over the void 226 and legs 222, 224 wherein at an address position; the golf club head 200 has the appearance of a traditional golf club head and wherein the void 226 is not visible.

As further shown in FIGS. 3-9, the cover 204 is integrally formed as a portion of the club head body 202. In one exemplary embodiment, the club head body 202 is formed in a casting manufacturing process. In a further exemplary embodiment, the club head body 202 is cast entirely from titanium. It is understood that other metal materials could be used, or composite materials, or plastic injection molded materials or a combination thereof. With certain materials, additional coating processes may also be used to add additional strength. It is also understood that the ball striking face 208 is separately connected to the golf club head body 202, such as in a welding operation. It is further understood that alternative connection mechanisms between the body 202 and the cover 204 can also be employed if an integral connection is not employed. The cover 204 and the club head body 202 may be connected, joined, fastened or otherwise fixed together (directly or indirectly through intermediate members) via adhesives, cements, welding, soldering or other boding or finishing techniques; by mechanical connectors (such as threads, screws, nuts, bolts or other connectors); interference fits and the like. As can be appreciated, the cover 204 may be considered to generally form the crown of the club head 200. Remaining portions of the club head body 202 define the ball striking surface and the depending legs spaced apart to define the void underneath the cover. The cover may be finished with a particular color visually perceptively different from remaining portions of the golf club head.

It is understood that the structures of the golf club head 200 described herein cooperate to form a club head having enhanced characteristics. The void construction provides the ability to distribute weight more towards the rear at the heel and toe. In further exemplary embodiments, the club head 200 could be structured wherein wall thicknesses of the first leg and second leg can be increased in the manufacturing process to further increase weight towards the rear at the toe and the heel. Wall thicknesses at the distal ends of the legs can be increased to add weight at the rear at the toe and heel. It is further understood that weight members can be internally supported in the legs. Additional structures such as the gusset members provide for the desired amount of rigidity and flexing. The resulting club head provides enhanced performance and sound characteristics.

FIGS. 22-27 disclose another embodiment of the club head according to at least some aspects of the invention, and the club head is also generally designated with the reference numeral 200. Because of the similarities in structure to the embodiment of the club head shown in FIGS. 3-11, the additional features and differences will be described with the understanding that the above description is applicable to the club head 200 shown in FIGS. 22-27. In this embodiment, the golf club head 202 includes a receptacle, or a weight port 280 on a sole surface of the club head 200. The weight port 280 is positioned proximate the interface area 228 and in particular, at the base support wall 230 adjacent the void 226. The weight port 280 may have internal threads or other further connection structure. A weight member 282 is provided and may have multiple parts, outer threads or other connection mechanisms. The weight member 282 may have a certain weight value and may be secured in the weight port 280. The weight member 282 may comprise multiple parts connected together to allow adjustability of weight. Using the weight member 282 in the weight port 270 allows the golfer to customize the swing weight of the golf club as desired. It is understood that internal support members or gussets are not utilized in this embodiment specifically at the weight port 280 although such structures could be incorporated if desired.

Figure 30:
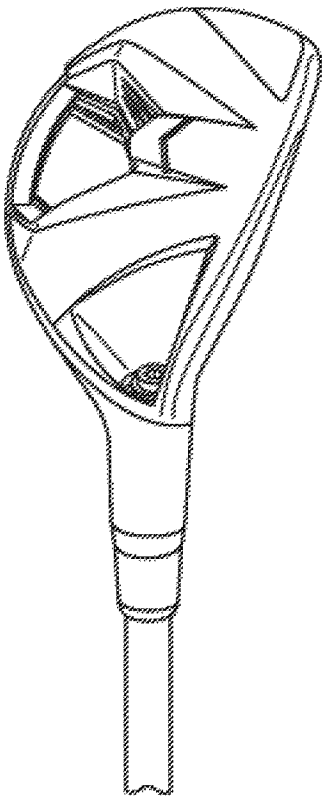
FIGS. 28-30 show bottom perspective views of a driver golf club head, a fairway wood golf club head and a hybrid golf club head.
Figure 29:
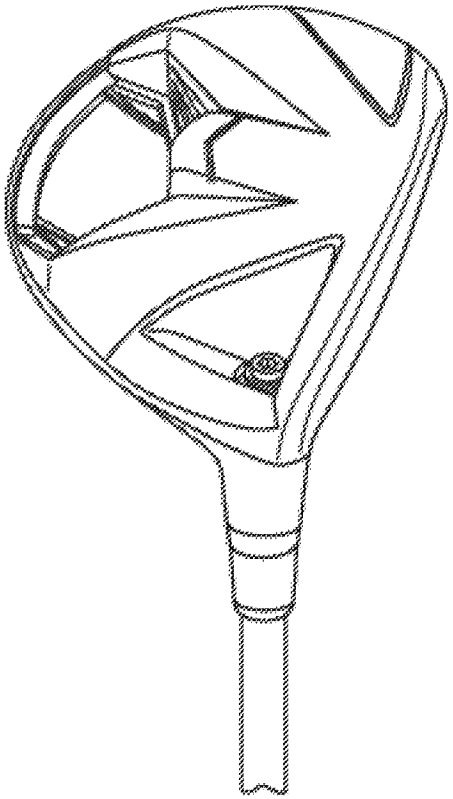
Figure 28:
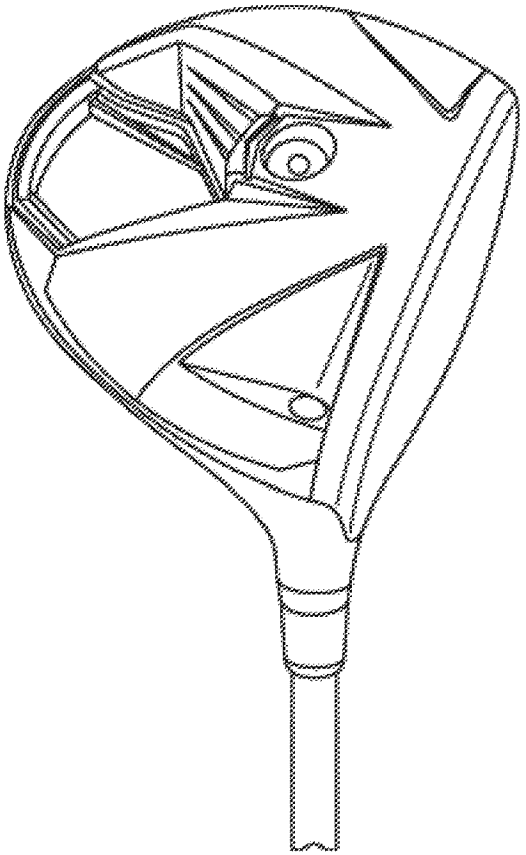

It is understood that the embodiments described herein regarding FIGS. 1-27 may be considered driver-type golf club heads. The principles of the invention further apply to other types of golf club heads including fairway woods and hybrid golf club heads. FIGS. 28-30 discloses the various types of such golf club heads such as the driver golf club head, the fairway wood golf club head and the hybrid golf club head. Each club head defines the void 226 and the respective dimensions of the void, walls, interface areas etc. vary for each type of club head. Each golf club head may include a plaque or medallion member as discussed above.

As discussed, the geometric weighting feature of the golf club heads described herein provides structure that allows for enhanced performance characteristics, including moment of inertia (MOI) properties, center of gravity (CG) properties and acoustic properties.

As discussed, the geometric weighting feature provides for weight to be moved from generally a rear of the sole of the club head to more towards the rear heel of the club head and the rear toe of the club head. In one exemplary embodiment of the invention, approximately 5% of the golf club head mass is moved in this fashion. Such construction provides a high moment of inertia (MOI) about a vertical axis (z-axis) through the center of gravity (CG) of the club head (Izz). Maintaining the higher MOI increases ball speed on off-center ball impacts and decreases the effect of side spin caused by off-center impact.

The geometric weighting feature also allows for enhanced positioning of the CG. The structure further allows for enhanced positioning of the CG such that a desired ball spin is imparted to the ball during impact with the club head 102. In certain exemplary embodiments, the CG is positioned such that a reduced amount of spin is imparted to the ball during impact. In the exemplary embodiments described herein, the CG is located within the internal cavity 219 of the golf club head 200. To achieve such properties, the CG is moved forward wherein the perpendicular distance from the CG to the ball striking face of the head is minimized. The structure of the club head wherein the weight is moved from the rear of the sole to the rear heal and rear toe areas allows for movement of the CG closer to the ball striking face. It has been found that when the perpendicular distance from the ball striking face to the CG is greater (such as when weight is moved to the rear of the golf club head to increase MOI), a wider variation of both ball back spin and ball side spin is produced for impact locations across the ball striking face. The structure of the geometric weighting features provides for an optimal balance of the MOI and CG properties, wherein more efficient control of ball back spin and ball side spin is achieved. As a result, ball carry distance is improved with the golf club head 200.

The geometric weighting feature further provides enhance acoustic properties of the golf club head. The structure provides for a more stiffened construction that promotes a higher natural frequency and a more pleasing sound. In many traditional golf club head designs, the crown of the head is only supported at peripheral edges, which can lead to relatively low natural frequencies and more unpleasant sounds are radiated to the golfer upon ball impact.

As discussed with the present golf club head 200 as well as the other embodiments described herein, the legs have walls that define the void and integrally depend from the crown and attach to the sole in an exemplary embodiment of the invention. Accordingly, in addition to being supported at peripheral edges, the crown is also supported at locations inwardly spaced from the peripheral edges. The walls extend along a considerable distance along the crown, or considerable footprint. The thickness of the walls may be approximately 0.7 mm similar to other structures of the club head body 202 wherein the thickness could vary approximately +/−10%. Such construction provides enhanced sound characteristics as the first flexural frequency of the club head is increased. Due to the increased stiffness provided by the construction of the walls connecting the crown and sole, a smaller portion of the crown emits any significant amplitude upon ball impact. With a higher frequency of the crown mode, and a smaller amount of the crown emitting amplitude, the amount of sound created by the club head is reduced when compared to conventional golf club head designs. The sound created is less intense and at a higher pitch than that of conventional golf club designs. Thus, the walls can be considered as sound reducing structures. The walls depend from the crown and connect to the sole. While inner surfaces of the walls confront the internal cavity 219, outer surfaces of the walls face the exterior of the golf club head. The outer or external surfaces of the walls face into the void and may be considered to form a portion of the exterior of the golf club head. The walls may further be considered to be located within the outermost periphery defined by the golf club head.

Figure 21A:
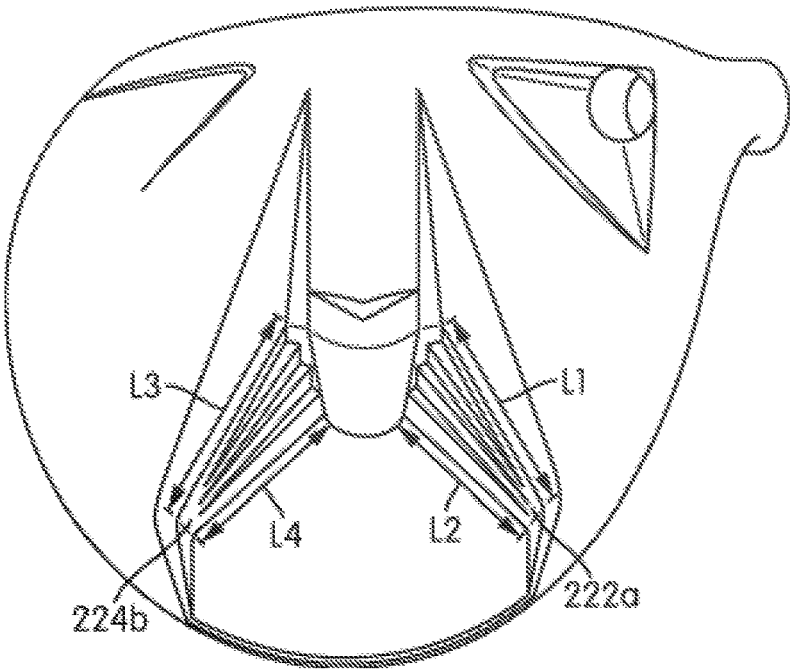
FIGS. 21A-21B are bottom view of the golf club head according to one or more aspects described herein and showing certain lengths and angles.
Figure 21B:
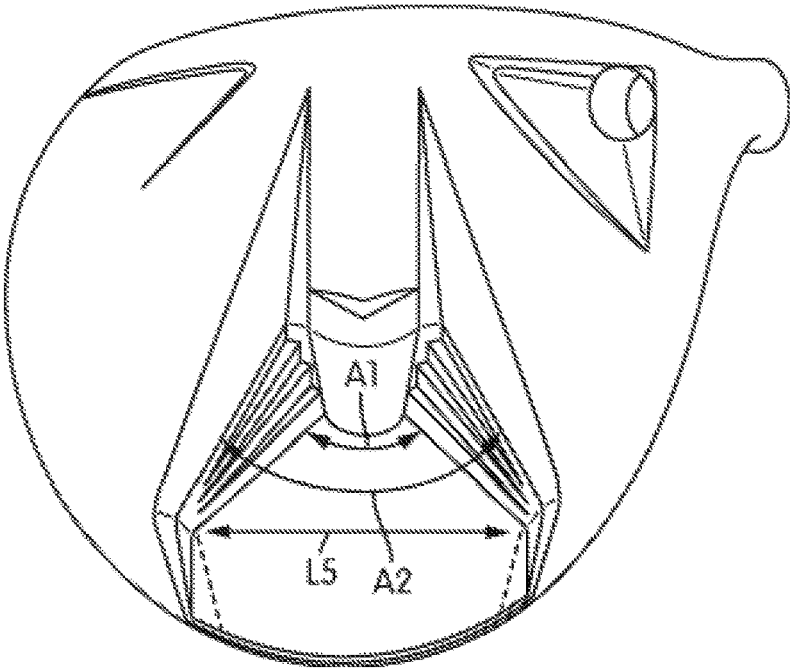
Figure 22:
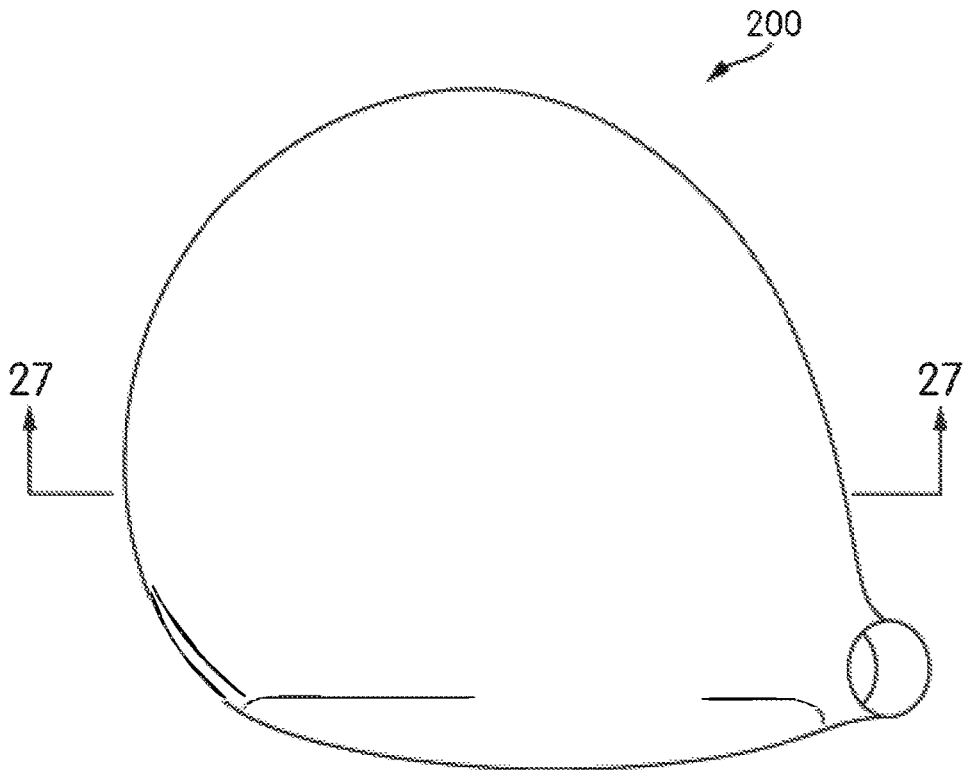
FIG. 22 illustrates another golf club head according to one or more aspects described herein, similar to the golf club head illustrated in FIG. 3.
Figure 23:
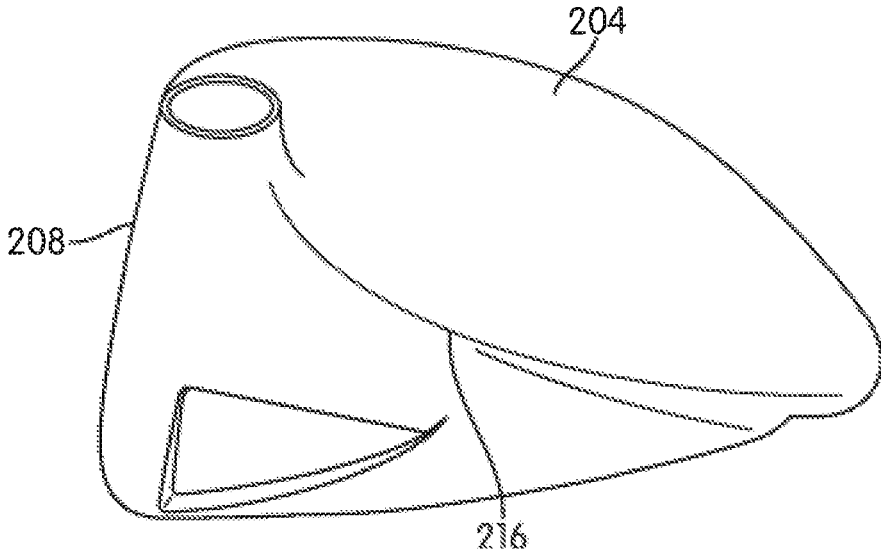
FIG. 23 is a side view of the golf club head of FIG. 22.
Figure 24:
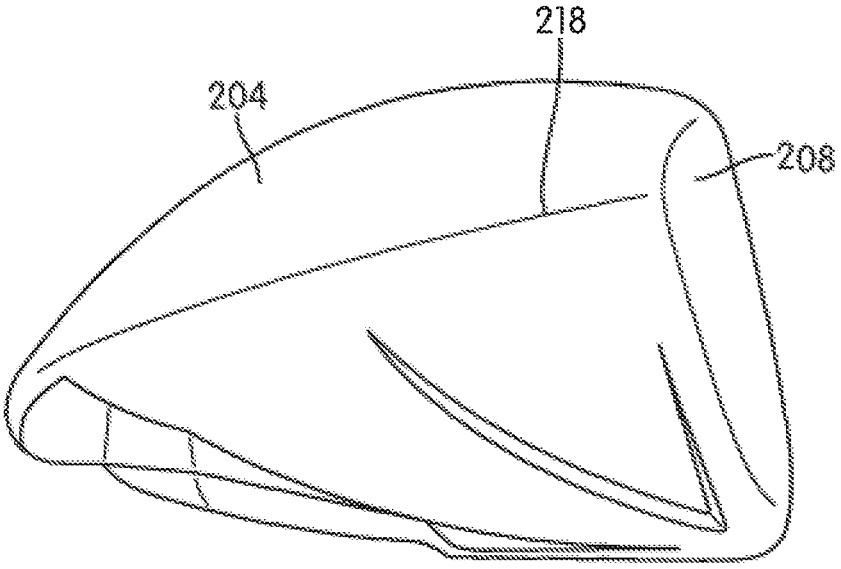
FIG. 24 is an opposite side view of the golf club head of FIG. 22.
Figure 25:
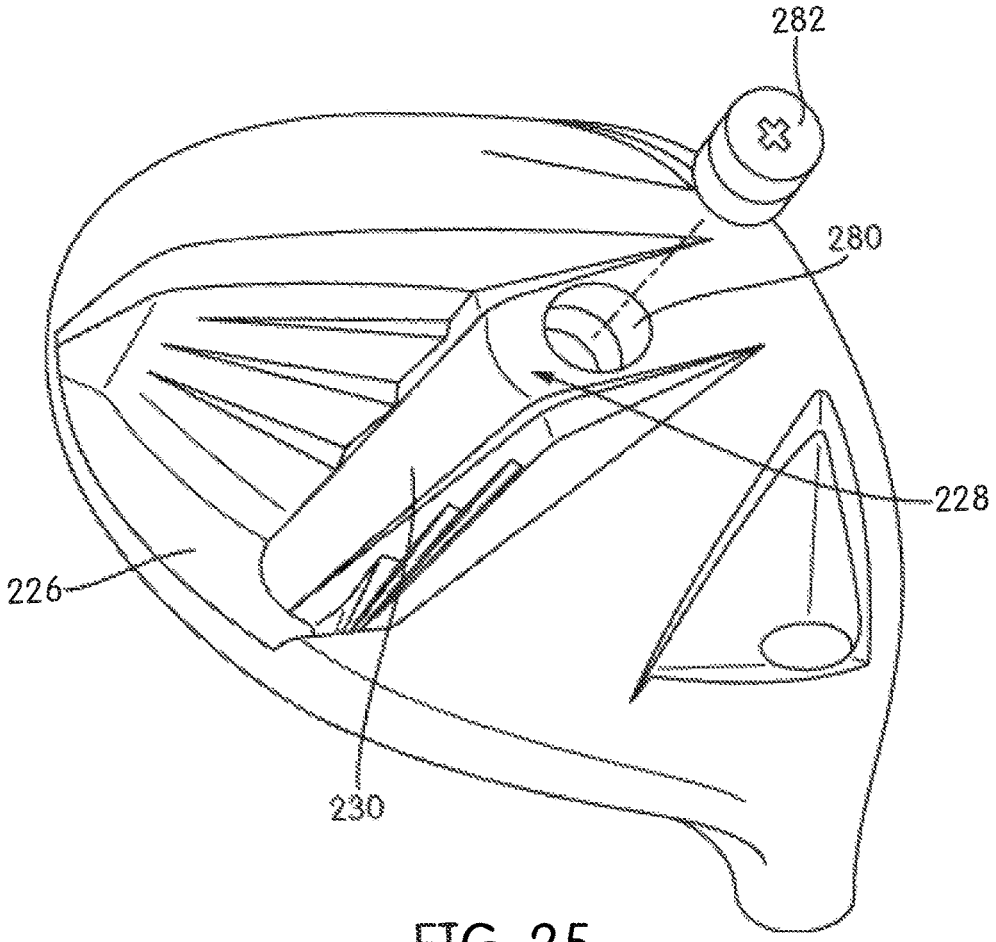
FIG. 25 is a bottom perspective view of the golf club head of FIG. 22, and showing a removeable weight member.
Figure 26:
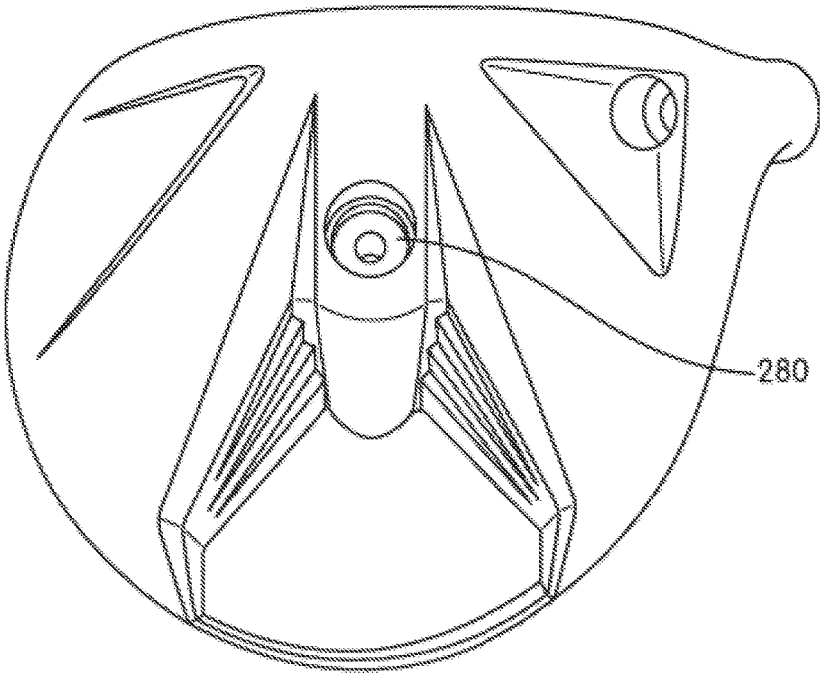
FIG. 26 is a bottom view of the golf club head of FIG. 22.
Figure 27:
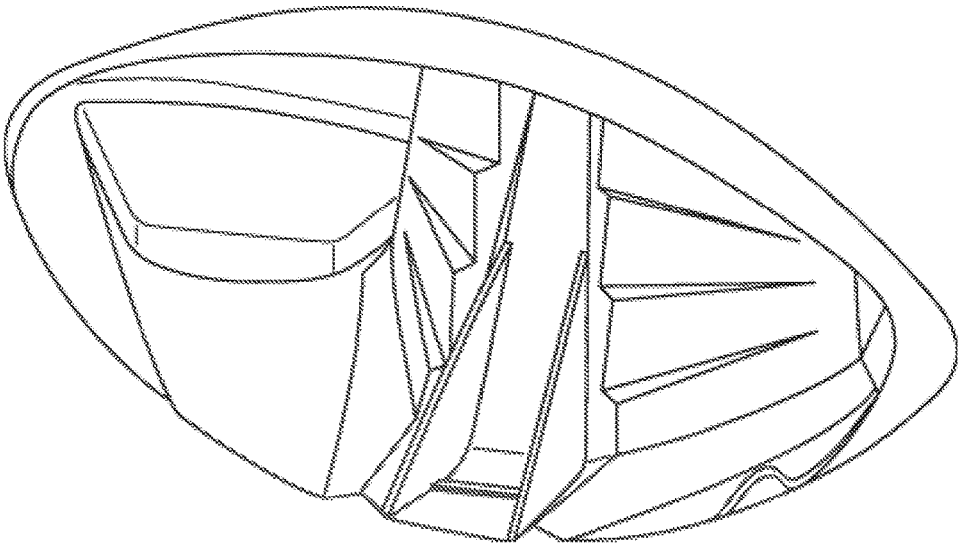
FIG. 27 is a cross-sectional view of the golf club head of FIG. 22, generally taken along line 27-27 in FIG. 22.

It is further understood that the walls have a major length extending from an end proximate the interface area 228 to a point where the distal ends angle inward to the rear of the club head 200. As can be appreciated from FIG. 21A, the first wall 222*a* defines a length L1 at the sole and also defines a length L2 at an underside surface of the crown. The second wall 224*b* defines a length L3 at the sole and also defines a length L4 at an underside surface of the crown. As shown in FIG. 21B, a length L5 represents a maximum void distance between the walls 222*a*, 224*b*. It is understood that the distal ends of the legs 222, 224 can turn inwards and end up being a lesser distance apart such as represented by the phantom lines in FIG. 21B and the embodiment shown in FIG. 17 (it is further understood that any of the club head embodiments described herein may utilized the inwardly turned distal ends as shown in FIG. 17). The respective lengths L1-L5 can vary and also vary over different types of club heads. Table 1 below lists example wall lengths and maximum void distance for different types of golf club heads according to exemplary embodiments of the invention.

It is noted that certain exemplary embodiments of golf club heads according to the present invention are listed in Table 1 as well as additional Tables listing other various data discussed below. The embodiments include: a Driver #1; a Driver #2, a Fairway Wood—3 W; a Fairway Wood—5 W; and a Hybrid. The Driver #1 may be a contemporary tour type driver for an advanced player, and having a volume of approximately 400-430 $cm^3$. The Driver #1 golf club head has the following characteristics: a breadth of approximately 106.6 mm; a length of approximately 114.7 mm; a head height of approximately 65.7 mm; and a face height of approximately 60.5 mm. It is understood that these characteristics are determined based on the USGA Procedure for Measuring the Club Head Size of Wood Clubs, USGA-TPX 3003. The Driver #2 may be a contemporary game improvement type golf club, and having a volume of approximately 430-460 $cm^3$. The Driver #2 golf club head has the following characteristics: a breadth of approximately 114.5 mm; a length of approximately 119.8 mm; a head height of approximately 62.1 mm; and a face height of approximately 59.3 mm. The Fairway Wood—3 W may have a volume of approximately 180-190 $cm^3$. The Fairway Wood—3 W golf club head has the following characteristics: a breadth of approximately 87.8 mm; a length of approximately 101.5 mm; a head height of approximately 42.2 mm; and a face height of approximately 37.7 mm. The Fairway Wood—5 W may have a volume of approximately 170-175 $cm^3$. The Fairway Wood—5 W golf club head has the following characteristics: a breadth of approximately 84.9 mm; a length of approximately 99.7 mm; a head height of approximately 39.3 mm; and a face height of 35.3 mm. The Hybrid golf club may have a volume of approximately 120-125 $cm^3$. The Hybrid golf club head has the following characteristics: a breadth of approximately 62.3 mm; a length of approximately 101.2 mm; a head height of approximately 39 mm; and a face height of 37.8 mm.

TABLE 1

| Club Type | Length L1 (mm) | Length L2 (mm) | Length L3 (mm) | Length L4 (mm) | Length L5 (mm) |
|---|---|---|---|---|---|
| Driver #1 | 38.2 | 31.0 | 42.6 | 29.0 | 60.4 |
| Driver #2 | 33.9 | 27.9 | 30.2 | 24.9 | 64.2 |
| Fairway Wood - 3W | 28 | 24.2 | 30.3 | 21.4 | 53.3 |
| Fairway | 27.4 | 21.4 | 29.2 | 19.1 | 49.5 |

TABLE 1-continued

| Club Type | Length L1 (mm) | Length L2 (mm) | Length L3 (mm) | Length L4 (mm) | Length L5 (mm) |
|---|---|---|---|---|---|
| Wood - 5W | | | | | |
| Hybrid | 23.3 | 22 | 25.5 | 21.4 | 43.5 |

The lengths L1-L4 of the walls 222*a*, 224*b* provide a significant length of connection between the crown 212 and the sole 214. The lengths L2, L4 along an underside surface of the crown 212 further provide a significant length of structure integral with and depending from the crown 212. Such construction provides enhanced and desired acoustic properties. The length L5 representing a maximum distance between the legs in the void can also vary to achieve desired performance characteristics, and be dimensioned with respect to other parameters.

Figure 20A:
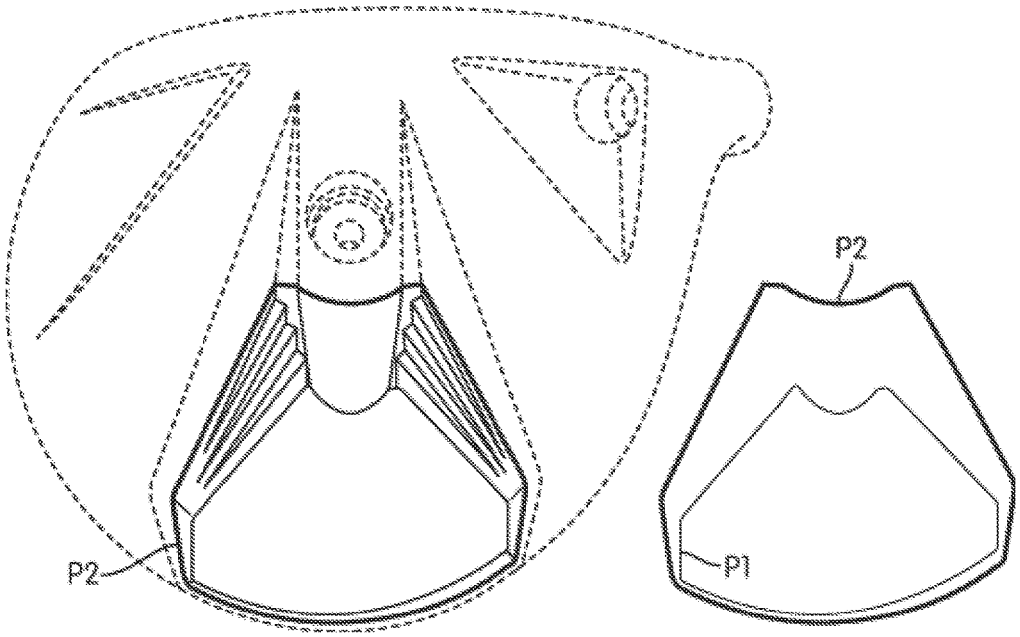
FIGS. 20A-20B are bottom views of the golf club head according to one or more aspects described herein and showing void perimeters.
Figure 20B:
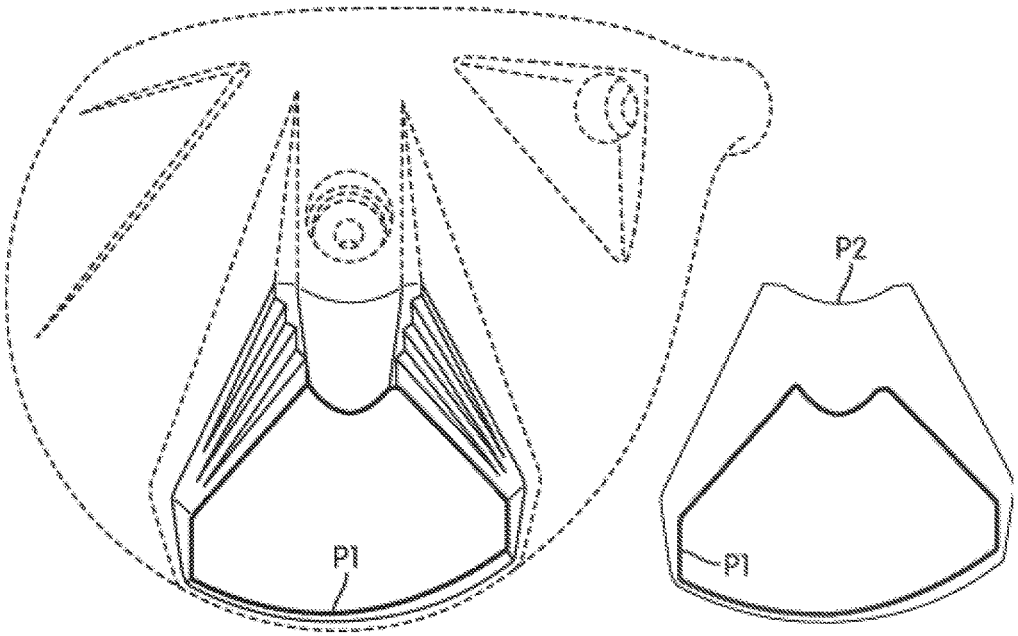

FIGS. 20A-20B disclose additional features of the golf club head 200. As discussed regarding FIG. 8, the golf club head 200 defines the void 226 therein. The first wall 222*a* of the first leg 222 extends from the interface area 228 towards the rear 210 and heel 216 of the golf club head 200. The second wall 224*b* of the second leg 224 extends from the interface area 228 towards the rear 210 and toe 218 of the golf club head 200. As further shown, the first wall 222*a* and the second wall 224*b* extend between and connect the crown 212 and the sole 214. One end of the walls 222*a*, 224*b* are connected to and extend from an underside surface of the crown 212 towards the sole 214. The other ends of the walls 222*a*, 224*b* are connected to the sole 214. The walls 222*a*, 224*b* extend at an angle wherein the walls 222*a*, 224 are inclined and thus taper outwardly from the underside surface of the crown 212 to the sole 214 and away from each other. The walls 222*a*, 224*b* generally diverge as the walls extend from the crown 212 to the sole 214. It is understood that the walls 222*a*, 224*b* are positioned inward from peripheral edges of the club head body 202. While the walls 222*a*, 224*b* taper or extend at some angle, it is understood that the walls 222*a*, 224*b* are generally vertically-oriented. As shown in FIG. 20B, generally at an underside surface of the crown 212, a first void perimeter length P1 is defined generally by the base support wall 230, the walls 222*a*, 224*b* and the arc of the crown between the walls 222*a*, 224*b*. As shown in FIG. 20A, generally at the sole 214, a second void perimeter length P2 is defined generally by the base support wall 230, the walls 222*a*, 224*b* and the arc of the crown between the walls 222*a*, 224*b*. As can be appreciated from the FIGS., as the walls 222*a*, 224*b* incline outwardly from the underside of the crown 212 to the sole 214, the first void perimeter P1 has a length that is smaller than the length of the second void perimeter P2. The second void perimeter P2 is larger in length than the first void perimeter P1. Thus, the void perimeters can be different. The first void perimeter P1 can be considered to be a certain percentage of the second void perimeter P2. The void perimeters P1, P2 can vary such as for other types of golf club heads such as fairway woods and hybrid clubs. It is understood that the walls 222*a*, 224*b* can be sloped at various angles and tapers that will affect the void perimeters and desired performance characteristics of the golf club head 200. Accordingly, the void perimeters P1, P2 can vary based on desired performance characteristics of the golf club head. The void perimeters P1, P2 further define junction areas between major side segments of the perimeters based on the structural configuration of the club head body 202 defining the void. The junctions can take various forms similar as discussed above, including convex or outwardly radiused contours, concave or inwardly radiused contours, bevels or more angled or straight corner configurations.

Table 2 below lists example void perimeter data for different types of golf club heads according to exemplary embodiments of the invention:

TABLE 2

| Club Type | First Void Perimeter P1 (mm) | Second Void Perimeter P2 (mm) | First Void Perimeter P1/Second Void Perimeter |
|---|---|---|---|
| Driver #1 | 169.3 | 197.6 | 85.6% |
| Driver #2 | 159.7 | 186.6 | 85.6% |
| Fairway Wood - 3W | 130.1 | 160.9 | 80.9% |
| Fairway Wood - 5W | 123.8 | 157.6 | 78.6% |
| Hybrid | 111.2 | 127.5 | 87.2% |

As the walls taper outwardly and diverge from an underside surface of the crown to the sole, the first void perimeter P1 is generally smaller than the second void perimeter P2. In exemplary embodiments, the first void perimeter P1 may be within a certain percentage range of the second void perimeter P2. For the Driver #1 golf club head, the first void perimeter may be approximately 80-90% of the second void perimeter and in one particular exemplary embodiment, the first void perimeter is 85.6% of the second void perimeter. For the Driver #2 golf club head, the first void perimeter may also be approximately 80-90% of the second void perimeter and in one particular exemplary embodiment, the first void perimeter is 85.6% of the second void perimeter. For the Fairway Wood—3 W golf club head, the first void perimeter may be approximately 75-85% of the second void perimeter and in one particular exemplary embodiment, the first void perimeter is 80.9% of the second void perimeter. For the Fairway Wood—5 W golf club head, the first void perimeter may also be approximately 75-85% of the second void perimeter and in one particular exemplary embodiment, the first void perimeter is 78.6% of the second void perimeter. For the Hybrid golf club head, the first void perimeter may be approximately 80-90% of the second void perimeter and in one particular exemplary embodiment, the first void perimeter is 87.2% of the second void perimeter. It is further understood that for the various golf club heads according to the present invention, the first void perimeter may be approximately 70-90% of the second void perimeter. With the outwardly tapered walls discussed above, the first void perimeter P1 can be minimized thus also reducing the crown area defined by the first void perimeter P1. This provides for a high modal frequency and a reduced amplitude upon ball impact in this area. The perimeter dimensions also result in less sole area. Controlling the dimensions of the perimeters provides for structural efficiency, and the benefits of the void and stiffening walls are maintained. Thus, the overall characteristics of the void construction is balanced to achieve the desired performance characteristics. It is understood that in other embodiments, the golf club head can be constructed such that the first void perimeter P1 is larger than the second void perimeter P2.

As discussed, the structures of the golf club head 200 define the internal cavity 219 and the void 226. It is understood that the golf club head 200 and other golf club head embodiments described herein have a volume associated therewith. The club head volume may be determined using the United States Golf Association and R&A Rules Limited Procedure For Measuring the Clubhead Size of Wood Clubs. In such procedure, the volume of the club head is determined using the displaced water weight method. It is further understood that according to the procedure the void structure and other concavities may be filled with clay or dough and covered with tape so as to produce a smooth contour over the sole of the club head. Club head volume may also be calculated from three-dimensional modeling of the golf club head if desired. It is further understood that the internal cavity 219 has a volume V1. It is further understood that the void 226 may define a volume V2. The volume of the void 226 is partially defined by the underside surface of the cover and the walls 222*a*, 224*b*. An imaginary continuation of the first wall and second wall as well as the arc of the crown upwards defines the outer boundary of the void 226, wherein such imaginary continuations produce a smooth contour over the sole. The volume V2 of the void 226 may be dimensioned to be a certain percentage of the volume V1 of the internal cavity 219. As discussed, the location of the interface area 228 can vary as well as the angle between the legs 222, 224. Such variations can affect the respective volumes V1, V2 of the internal cavity 219 and void 226, which will further affect the performance characteristics of the golf club head 200 as desired.

Table 3 below lists example volume data for different types of golf club heads according to exemplary embodiments of the invention:

TABLE 3

| Club Type | Internal Cavity Volume V1 ($cm^3$) | Void Volume V2($cm^3$) | Void Volume V2/Internal Cavity Volume |
|---|---|---|---|
| Driver #1 | 342 | 74 | 21.6% |
| Driver #2 | 377 | 63 | 16.7% |
| Fairway Wood - 3W | 155 | 30 | 19.4% |
| Fairway Wood - 5W | 144 | 27 | 18.8% |
| Hybrid | 105 | 18 | 17.1% |

It is understood that the volume V2 of the void 226 may be within a certain percentage range of the volume V1 of the internal cavity 219. For the Driver #1 golf club head, the void volume may be 20-25% of the internal cavity volume, and in one exemplary embodiment the void volume is 21.6% of the internal cavity volume. For the Driver #2 golf club head, the void volume may be 15-20% of the internal cavity volume, and in one exemplary embodiment the void volume is 16.7% of the internal cavity volume. For the Fairway Wood—3 W golf club head, the void volume may be 15-20% of the internal cavity volume, and in one exemplary embodiment the void volume is 19.4% of the internal cavity volume. For the Fairway Wood—5 W golf club head, the void volume may be 15-20% of the internal cavity volume, and in one exemplary embodiment the void volume is 18.8% of the internal cavity volume. For the Hybrid golf club head, the void volume may be 15-20% of the internal cavity volume, and in one exemplary embodiment the void volume is 17.1% of the internal cavity volume. It is further understood that for the various golf club heads according to the present invention, the void volume may be 15-25% of the internal cavity volume or even 15-20% of the internal cavity volume in further embodiments. The respective volumes are dimensioned to achieve the desired performance characteristics of the golf club.

As previously indicated, the legs 222, 224 and walls 222*a*, 224*b* extend from one another at an angle. The walls 222*a*, 224 taper outwardly from an underside surface of the crown to the sole. As such and as shown in FIG. 21, an angle A1 is defined at an underside surface of the crown. An angle A2 is defined generally at the sole. Table 4 below lists example angle A1, A2 data for different types of golf club heads according to exemplary embodiments of the invention:

TABLE 4

| Club Type | Angle A1 (°) | Angle A2 (°) |
|---|---|---|
| Driver #1 | 89.8 | 52.4 |
| Driver #2 | 112.6 | 75.1 |
| Fairway Wood - 3W | 118.1 | 70.9 |
| Fairway Wood - 5W | 122.8 | 70.8 |
| Hybrid | 95.8 | 73.3 |

Table 1 contains data regarding representative lengths regarding the walls as well as maximum cavity distance, while Table 4 contains data regarding the angles between the walls. It is understood that the lengths and angles can be dimensioned in various relationships to achieve desired performance characteristics.

As discussed, the crown of the golf club head generally covers the legs and void in exemplary embodiments of the invention. The crown, or cover, has a segment 272 (shown schematically in FIG. 4) that confronts the void 226. This segment has a certain surface area Area 1. The crown may have an overall surface area, Area 2, that may generally include portions of the hosel area generally facing the remaining portions of the crown. Table 5 below lists example crown surface area data, Area 1, Area 2 for different types of golf club heads according to exemplary embodiments of the invention:

TABLE 5

| Club Type | Area 1 ($mm^2$) | Area 2 ($mm^2$) | Area 1/Area 2 |
|---|---|---|---|
| Driver #1 | 2035.2 | 13382.4 | 15.2% |
| Driver #2 | 1832.9 | 13751.3 | 13.3% |
| Fairway Wood - 3W | 1090 | 7660 | 14.2% |
| Fairway Wood - 5W | 983.1 | 6947.1 | 14.2% |
| Hybrid | 803 | 4899.6 | 16.4% |

Thus, the surface area of the segment of the crown confronting the void may be a certain percentage of the overall surface area of the crown. For the Driver #1 golf club head, the surface area of the crown over the void may be 10-20% of the overall surface area of the crown, and in one exemplary embodiment the surface area of the crown over the void is 15.2% of the overall surface area of the crown. For the Driver #2 golf club head, the surface area of the crown over the void may also be 10-20% of the overall surface area of the crown, and in one exemplary embodiment the surface area of the crown over the void is 13.3% of the overall surface area of the crown. For the Fairway Wood—3 W and 5 W golf club heads, the surface area of the crown over the void may be 10-20% of the overall surface area of the crown, and in one exemplary embodiment the surface area of the crown over the void is 14.2% of the overall surface area of the crown. For the Hybrid golf club head, the surface area of the crown over the void may be 10-20% of the overall surface area of the crown, and in one exemplary embodiment the surface area of the crown over the void is 16.4% of the overall surface area of the crown. It is further understood that for the various golf club heads according to the present invention, the surface area of the crown over the void may be 10-25% of the overall surface area of the crown or even 10-20% of the overall surface area of the crown.

While specific dimensions, characteristics, and/or ranges of dimensions and characteristics are set forth in the various tables above and other paragraphs herein, those skilled in the art will recognize that these dimensions and ranges are examples of the invention. Many variations in the ranges and the specific dimensions and characteristics may be used without departing from this invention, e.g., depending on the type of club, user preferences, user swing characteristics, and the like. Such data may also vary due to other desired club parameters as well as shaft selection. In certain exemplary embodiments, the data described herein may vary in the range of +/−10%. It is further understood that from the data disclosed herein, further parameters, relationships, percentages etc. can readily be determined and recognized by a person skilled in the art. In addition, a golf club head structure need not have dimensions or characteristics that satisfy all of various data values described herein to fall within the scope of this invention.

Figure 31:
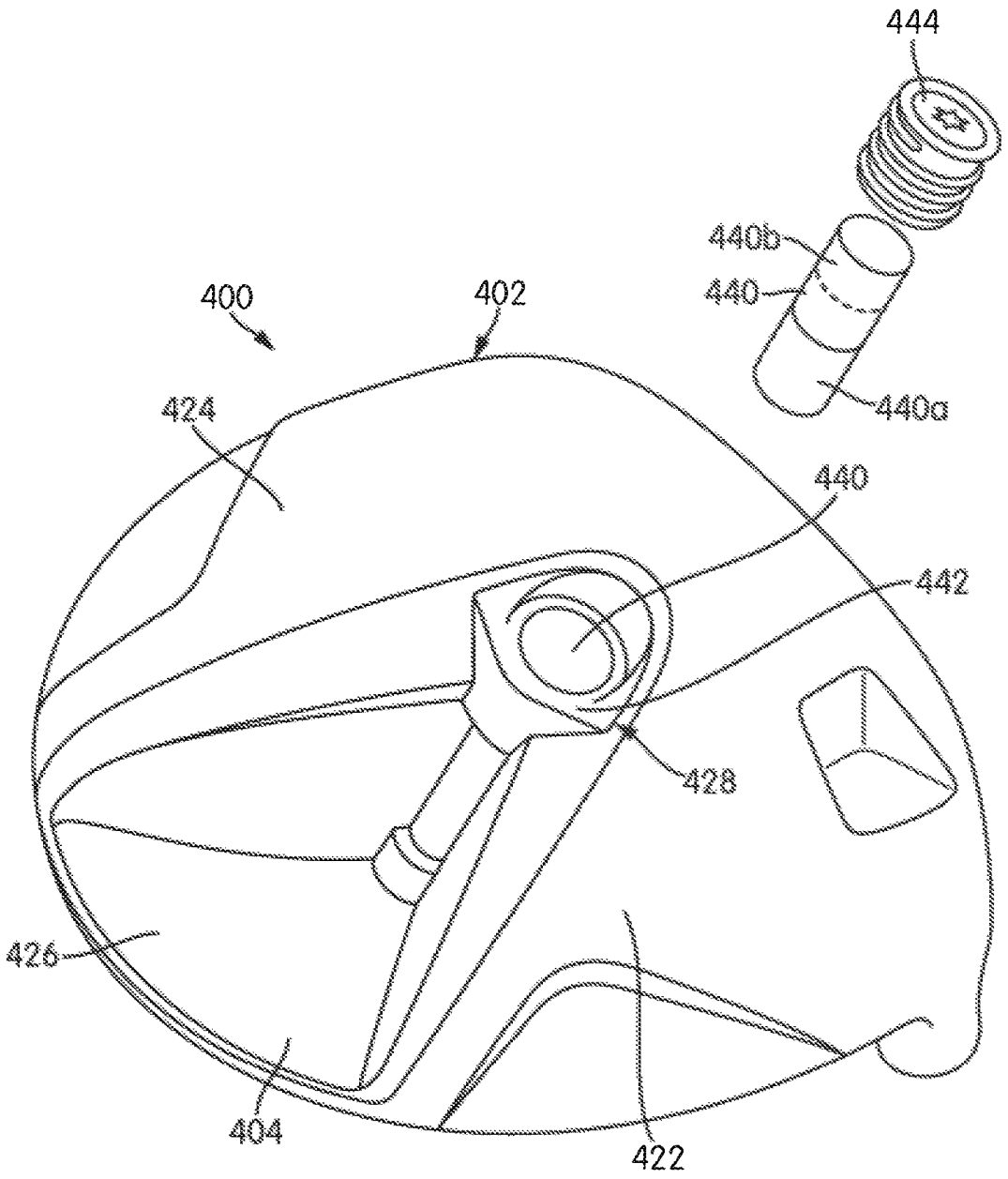
FIG. 31 illustrates another golf club head having a void in the club head body and an adjustable weight arrangement according to one or more aspects described herein.

FIG. 31 illustrates another golf club head according to the present invention, generally designated with the reference numeral 400. As discussed with other embodiments, the golf club head 400 has the body 402 and a cover 404. The body 402 has a first leg 422 and second leg 424 that are spaced by a void 426. The void 426 is generally v-shaped similar to other embodiments. The golf club head 400 further defines an interface area 428. The cover 404 is integral with or otherwise connected to the body 402. The first leg 422 and second leg 424 converge toward one another to the interface area 428. It is understood that the golf club head 400 in FIGS. 31-33 may also have other structures and features as discussed herein with respect to other embodiments of the club head.

The golf club head 400 utilizes a weight assembly to further enhance performance of the club head 400. The weight assembly or weight is operably associated with the interface area 428. In an exemplary embodiment, the interface area 428 of the head 400 supports a receptacle or receiver 442 in the form of a receiving tube 442 in an exemplary embodiment. A weight 440 of the weight assembly is configured to be received by the receiving tube 442. FIG. 31 shows the weight 440 both in the tube 442 and further in an exploded configuration. The weight 440 may, in some examples, be received in the receiving tube 442 incorporated into the golf club head 400 and, in some arrangements, arranged at the base of the v-shaped void 426 formed in the golf club head 400. Thus, as shown in FIG. 31, the interface area 428 supports the receiving tube 442 generally at the junction of the first leg 422 and the second leg 424. The first leg 422 and the second leg 424 converge to the receiving tube 442. The receiving tube 442 generally has a height that extends from an underside of the cover 404 to proximate the sole surface of the club head body 402. The receiving tube 442 may have varying heights as desired and be mounted have one or both ends spaced away from the underside of the crown or sole. It is understood that the weight 440 may have one end 440*a* that is heavier than an opposite end 440*b* wherein the weight 440 can be flipped as desired. Thus, differing weighting characteristics and arrangements are possible to alter the performance characteristics of the club head 400. A threaded fastener 444 can also be provided to mate with internal threads in the receiving tube 442 to secure the weight 440 in the receiving tube 442.

The receiving tube 442 and weight 440 may have corresponding shapes such that the weight 440 may slide into the receiving tube 442. In some examples, the weight 440 and receiving tube 442 may be cylindrical, square, rectangular, etc. The receiving tube 442 may have a longitudinal axis and the weight may have a longitudinal axis. The longitudinal axes may generally correspond when the weight 440 is received in the tube 442. In the embodiment shown in FIG. 31, the longitudinal axis of the tube 442 is generally vertical and generally parallel to the ball striking face with the understanding that the ball striking face may have a certain amount of loft. The receiver tube 442 may be integrally formed with one or more portions of the golf club head 400 or may be formed as a separate portion and connected to the golf club head 400 using known methods of connection, such as adhesives, mechanical fasteners, snap fits, and the like.

In the example shown in FIG. 31, the receiving tube 442 is generally vertical in arrangement (e.g., in a vertical position when the golf club head is in an at address position). However, various other tube arrangements, positions, etc. may be used without departing from the invention. Some other arrangements, positions, etc. will be described more fully below.

The receiving tube 442 may receive the weight 440 which may be a single weighted member or may have ends with different weighting characteristics or weight values. For instance, the weight 440 may have one end 440*a* heavier than an opposite end 440*b*. In some arrangements, the heavier end may be positioned towards the top of the golf club head to provide a first weight arrangement or alternatively, towards the bottom of the golf club head to provide a second weight arrangement. The different weight arrangements can affect performance of the club head 400. The v-shaped void 426 may permit easier access to the body of the golf club head 400, weights 440, etc. to more easily adjust weight from a high position to a low position. Other structures can be operably associated with the interface area at the void 426 to removably support weight members thereon.

Additionally or alternatively, the weight member 440 may include multiple weights or portions of the weight 440 that can be releasably fastened to one another; e.g. three pieces with one piece being heaviest (e.g., shown in phantom lines in FIG. A). The different weights may also have different weight values. In some examples, the heavy member can be at either end or at a middle of the member. Various other combinations of weight members may be used without departing from the invention. The overall height of the weight member 440 along with the length of the threaded fastener 444 may generally correspond to the height of the receiver tube 442 so that the weight 440 fits snugly in the tube 442 and does not slide within the tube during use. It is understood that the tube 442 and/or the weight 440 may have shock absorbing features if desired.

In some arrangements, the base of the v-shaped void 426 may be angled and the receiving tube 442 may conform to the angle. Thus, the weight member 440 may be adjusted in a hybrid fashion, e.g., high/low, fore/aft, by adjusting the weight 440 within the receiving tube 442. Multiple receiving tubes 442 can also be utilized in vertical, horizontal or angular configurations. The receiving tube(s) may also be positioned at locations spaced away from the interface area 428 including along surfaces of the first leg 422 and the second leg 424.

The position of the weight 440 and receiving tube 442 at the base of the v-shaped void 426 may aid in adjusting the center of gravity near a central region of the golf club head 400. Weight in the tube 442 can be focused in the tube 442 to provide a low center of gravity or a high center of gravity. The weight 440 can also be configured to provide a more neutral center of gravity. The insertion or removal of weight 440 may add or remove additional weight from the overall weight of the golf club head 400 and may add or remove weight from the central region, thereby adjusting the performance characteristics of the golf club head 400. Such weighting characteristics provided by the weight 440 in the tube 442 can further impact golf ball trajectory by providing a change in ball spin. It has been determined that this weighting feature can provide a change of approximately 500-600 rpm in ball spin. Utilizing the adjustable weight 440 in the tube 442 to affect ball spin as well as considering launch angle and ball speed, a golfer can customize the golf club to achieve desired ball trajectory, distance and other characteristics. The adjustable weighting feature can further be used to customize the club head 400 to produce a desired ball spin for a particular golf ball being used.

The weight assembly utilized in FIG. 31 can also take certain alternative forms. For example, the club head body can be formed such that the first leg and the second leg define the v-shaped void therebetween. In this embodiment, the void extends completely from a crown of the club head to a sole of the club head. The sides of the legs facing into the void, or walls, may be closed with material defining side surfaces or the sides of the legs could have an open configuration. A cover member can be provided that is also v-shaped to correspond to the v-shaped void. The cover member has a top portion and depending legs as well as structure defining the receiving tube therein. The receiving tube is configured to receive the weights as described above. The cover member is positioned in the v-shaped void wherein the top portion of the cover member is attached to the crown of the club head body. The depending legs of the cover member confront the legs of the club head body and may also be connected to the legs of the club head body. As such, a club head body is formed similar to the club head shown in FIG. 31. In one exemplary embodiment, the club head body is a cast metal body such as titanium. The cover member is formed in a plastic injection molding operation. The plastic cover member reduces the overall weight of the club head as opposed to such corresponding structures also being made from metal such as titanium. Coating operations could be utilized on the plastic cover member to provide a metallic appearance and to further strengthen the member. It is further understood that in the various embodiments described herein utilizing additional weight members, the weight members may be of a material heavier than the remainder of the golf club head or portions of the head. In other exemplary embodiments, the weight member(s) may be made of the same material as the remainder of the golf club head or portions thereof. In certain exemplary embodiments, the weight member may be formed from steel, aluminum, titanium, magnesium, tungsten, graphite, or composite materials, as well as alloys and/or combinations thereof.

Figure 32:
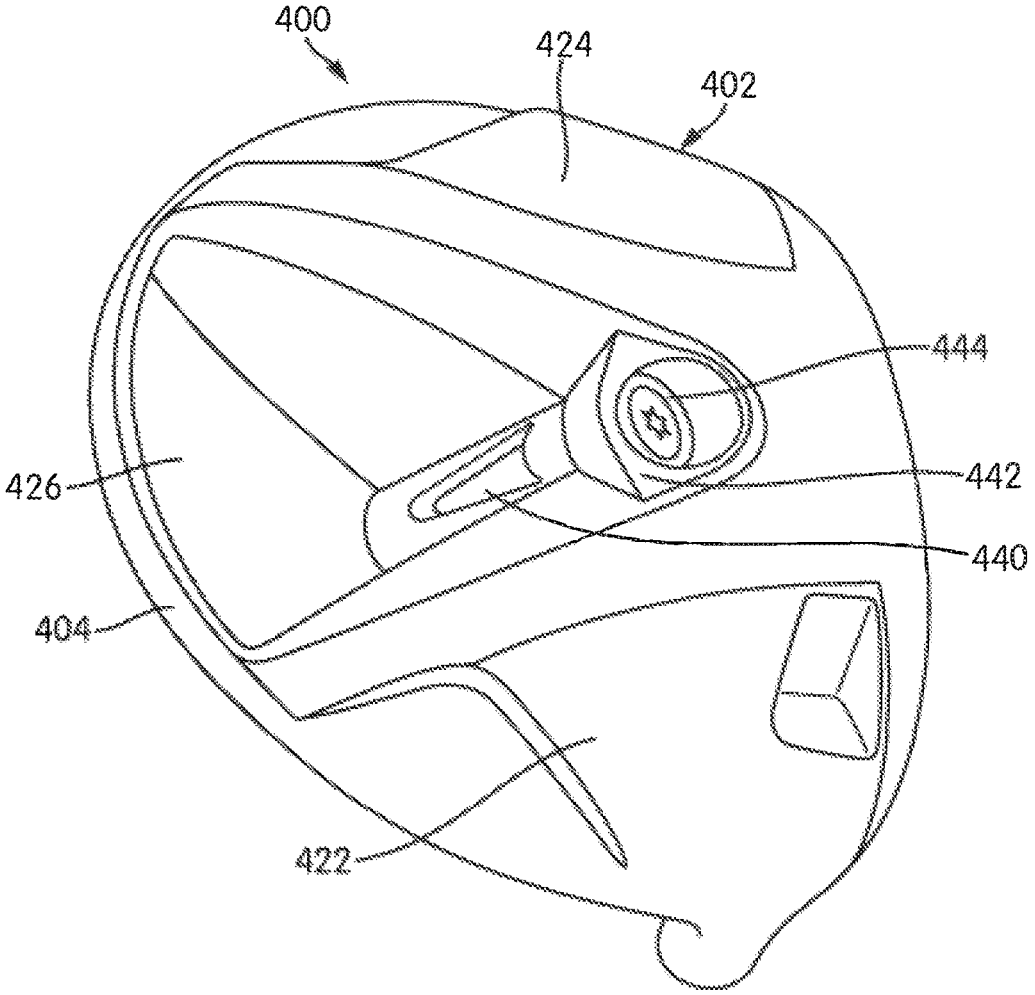
FIGS. 32 and 33 illustrate yet another golf club head arrangement having a void in the club head body and an adjustable weight arrangement according to one or more aspects described herein.
Figure 33:
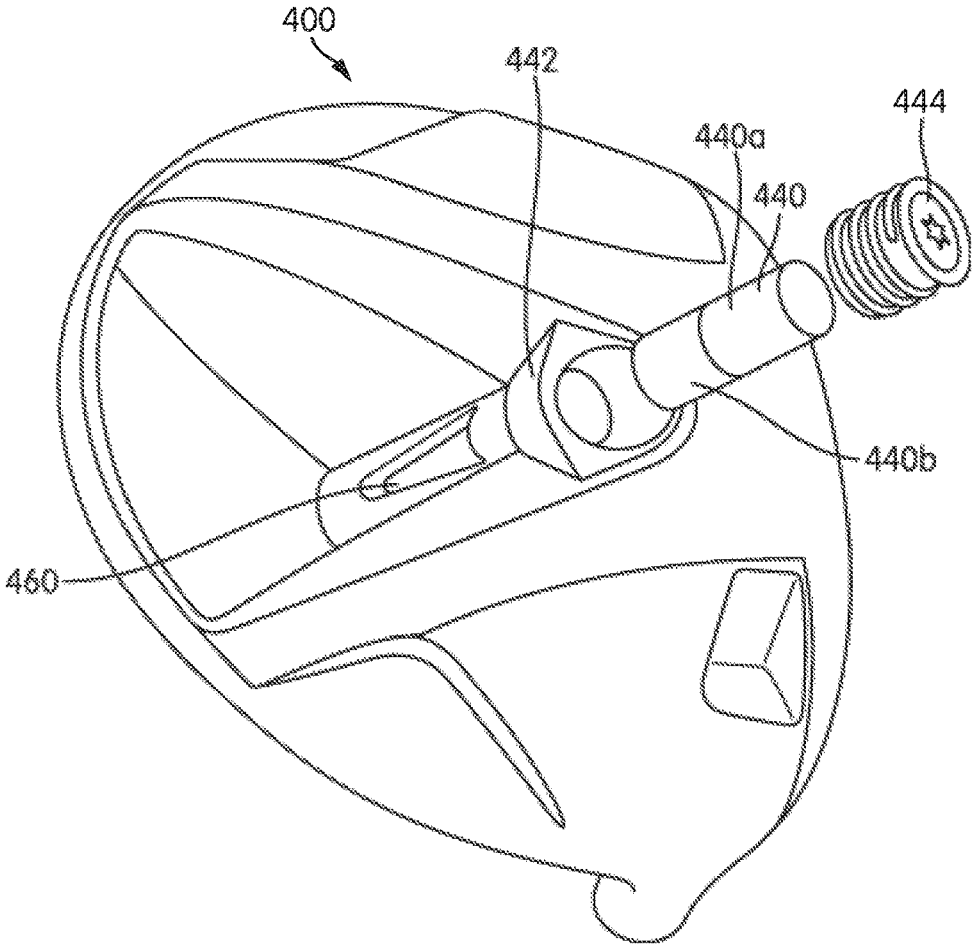

FIGS. 32 and 33 illustrate another weight arrangement similar to FIG. 31. Similar reference numerals will be utilized to designate similar components. The golf club head 400 may include club head body 402 defining the v-shaped void 426 in the rear of the golf club head 400. The club head body has the pair of spaced legs 422, 424 defining the void 426 wherein the legs 422, 424 converge and an interface area 428 is defined in the club head body 402. Further, the golf club head 400 may include a weight 440 arranged in the interface area or generally at or proximate a central region of the golf club head (e.g., at the base of the v-shaped void 426). The weight assembly or weight is operably associated with the interface area. Similar to the arrangement of FIG. 31, the weight may be cylindrical and may be received in a receiver such as a receiving tube 442 in an exemplary embodiment.

Similar to the arrangement discussed above regarding FIG. 31, the weight may have ends having different weighting characteristics or weight values. For instance, one end 440*a* may be heavier than the other end 440*b*. The additional weight may be due to end 440*a* being a larger portion of the weight 440 (as shown in FIG. 32) or the material used to form the weight may differ for each end. The weight 440 may be removed from the receiving tube 442 and rotated or flipped to adjust the weight distribution associated with the weight 440. That is, the heavier end may be proximal an upper portion of the receiving tube 442 (e.g., proximal the sole of the golf club head) or the weight 440 may be reversed so that the heavier end is proximal the top or crown of the golf club head 400.

Additionally or alternatively, the weight may be comprised of multiple weight portions having varying weight characteristics, as described above. For instance, portions 440*a* and 440*b* may be separate portions of the weight 440 that may be connected together in multiple configurations to adjust the weight distribution and thereby adjust the performance characteristics of the golf club head 400. Although two weight portions are shown in FIG. 32, three or more portions may be used to form the weight 440 as desired.

In some examples, the receiving tube 442 may include a fastener 444 to secure the weight 440 within the receiving tube 442. For instance, a screw or other threaded fastener 444 may be inserted into the receiving tube 442 after the weight 440 has been inserted to maintain the position of the weight 440. The receiving tube 442 has mating threads to receive the threaded fastener 444. In order to remove or adjust the weight, the fastener 444 may be removed and the weight 440 may then be removed. Similar to the arrangements discussed above, access to the weight 440 and fastener 444 may be via the void 426 formed in the rear of the golf club head 400. It is understood that the weight 440 could be secured in the tube 440 in several other alternative embodiments.

Additionally or alternatively, the weight 440 may be threaded or connected to a threaded fastener 450 such that adjustment of the thread moves the weight 440 within the receiving tube 442. For instance, turning of the threaded fastener 450 may move the fastener 450 up or down within the receiving tube 442. A weight 440 connected to the fastener 450 may then also move up and down with the threaded fastener 450. As further shown in FIGS. 32 and 33, an exposed surface of the receiving tube 442 may have a window 460 to allow one to see the weight 440 in the tube 442 from the exterior of the club head. The weight(s) 440 may be provided with indicia to allow for easy determination of the particular weighting arrangement provided. The indicia can be provided in a variety of different forms including, but not limited to, wording and colors or a combination thereof.

Although the above-described arrangements including a receiving tube generally illustrate an exterior of the receiving tube being exposed, the receiving tube may be enclosed within a rear portion of the golf club head without departing from the invention. For example, the interface area of the golf club head may completely enclose the receiving tube or some other structure to receive a weight member.

It is further understood that an adjustment member 105 may be utilized in exemplary embodiments of the present invention. The adjustment member 105 is operably connected to the golf club head and capable of adjusting certain parameters of the golf club head, such as loft angle, face angle and/or lie angle. Other parameters could also be adjusted. It is understood that the adjustment member 105 could be utilized in any of the embodiments described herein.

FIGS. 34A-46C disclose one exemplary embodiment of an adjustment member, generally designated with the reference numeral 105, utilized with the club heads of the present invention. The adjustment member 105 is a hosel-based member that is capable of adjusting two parameters such as loft angle and face angle. The adjustment member 105 is received in the hosel 104 of the golf club head 200 and cooperates with further connection structure in the bore 264 of the golf club head 200 (FIG. 8) as will be described in greater detail below.

FIGS. 34A-46C illustrate an adjustment member 105 or releasable connection 104 between golf club heads and shafts in accordance with examples of this invention. In these figures, the golf club head is shown generally schematically, and it is understood that any of the golf club heads 100, 200, 400 described in FIGS. 1-33 above can be utilized with the adjustment member 105 described herein.

Figure 35A:
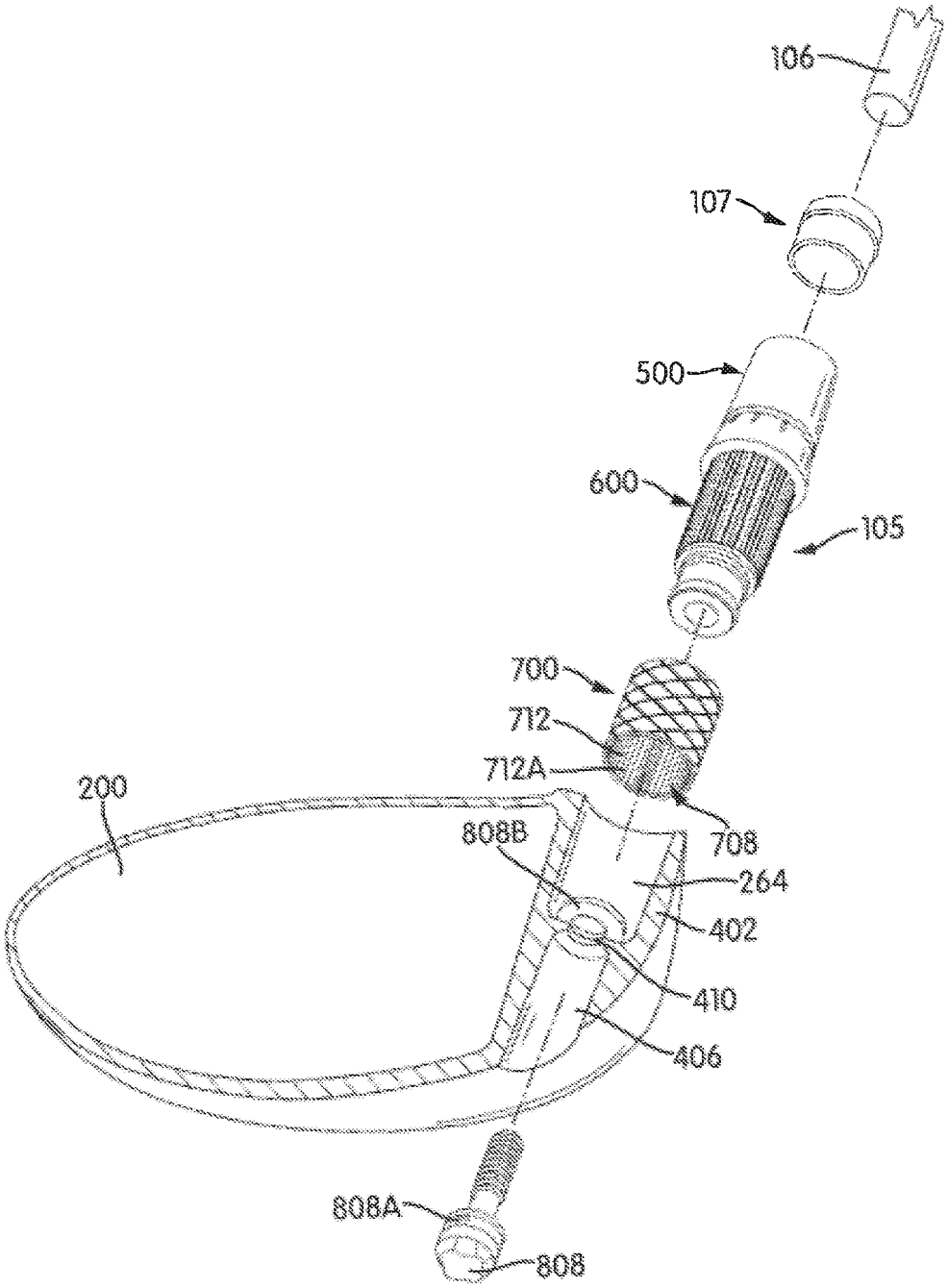

FIG. 35A illustrates an exploded view of the adjustment member/releasable connection 105. As illustrated in FIG. 35A, this releasable connection 105 between the golf club head 200 and the shaft 106 includes a shaft adapter 500, a hosel adapter 600, and a hosel ring 700. Generally, the hosel ring 700 is configured to engage a club head chamber or bore 264 in the golf club head 200, the hosel adapter 600 is configured to engage in the locking ring 700 and the golf club head 200, the shaft adapter 500 is configured to engage in the hosel adapter 600, and the shaft 106 is configured to engage the shaft adapter 500. The details of the engagement of these example components/parts will be explained in more detail below.

The releasable connection 105, as described below, includes two different sleeves, the shaft adapter 500 and the hosel adapter 600. These two different sleeves provide the ability to adjust two different club head parameters independently. Additionally, in accordance with aspects of this invention, one sleeve may be utilized, wherein either the shaft adapter 500 or the hosel adapter 600 may be eliminated such that only one club head parameter may be adjusted independently of the other parameters or characteristics with substantially no change (or minimal change) in the other parameters or characteristics of the golf club head 200. In another embodiment, one of either the shaft adapter 500 or the hosel adapter 600 may include an off-axis or angled bore and the other of the shaft adapter 500 or the hosel adapter 600 may not include an off-axis or angled bore. Additionally, in accordance with aspects of this invention, the two different sleeves 500, 600 may be utilized with off-axis or angled bores, however they may provide the ability to adjust one club head parameter independently with substantially no change (or minimal change) in the other parameters or characteristics of the golf club head. With this embodiment, only one club head parameter may be adjusted independently of the other parameters or characteristics. For each of these adjustments, whether adjusting two different club head parameters independently or adjusting one club head parameter, there may be substantially no change (or minimal change) in the other parameters or characteristics of the golf club head.

In this exemplary embodiment, neither the shaft adapter 500 nor the hosel adapter 600 need to be removed from the club head 200 to rotate the shaft adapter 500 and/or the hosel adapter 600 to various configurations. The shaft adapter 500 and the hosel adapter 600 are captive within the releasable connection 105 (See e.g., FIGS. 41A-44). In one exemplary embodiment to achieve this captive feature, the shaft adapter 500 may include a stop ring 501. The stop ring 501 may be in the form of a compression o-ring. The stop ring 501 may also be other mechanical features without departing from this invention, such as c-clips. This stop ring 501 allows the hosel adapter 600 to disengage from the shaft adapter 500 without being removed from the club head 200 and thereby allows the hosel adapter 600 and/or the shaft adapter 500 to be rotated without being removed from the club head 200. Other embodiments may be contemplated without utilizing the captive feature and wherein the shaft adapter 500 and/or hosel adapter 600 may need to be removed from the club head 102 in order to rotate and/or change the configuration of the club head 200.

Figure 35B:
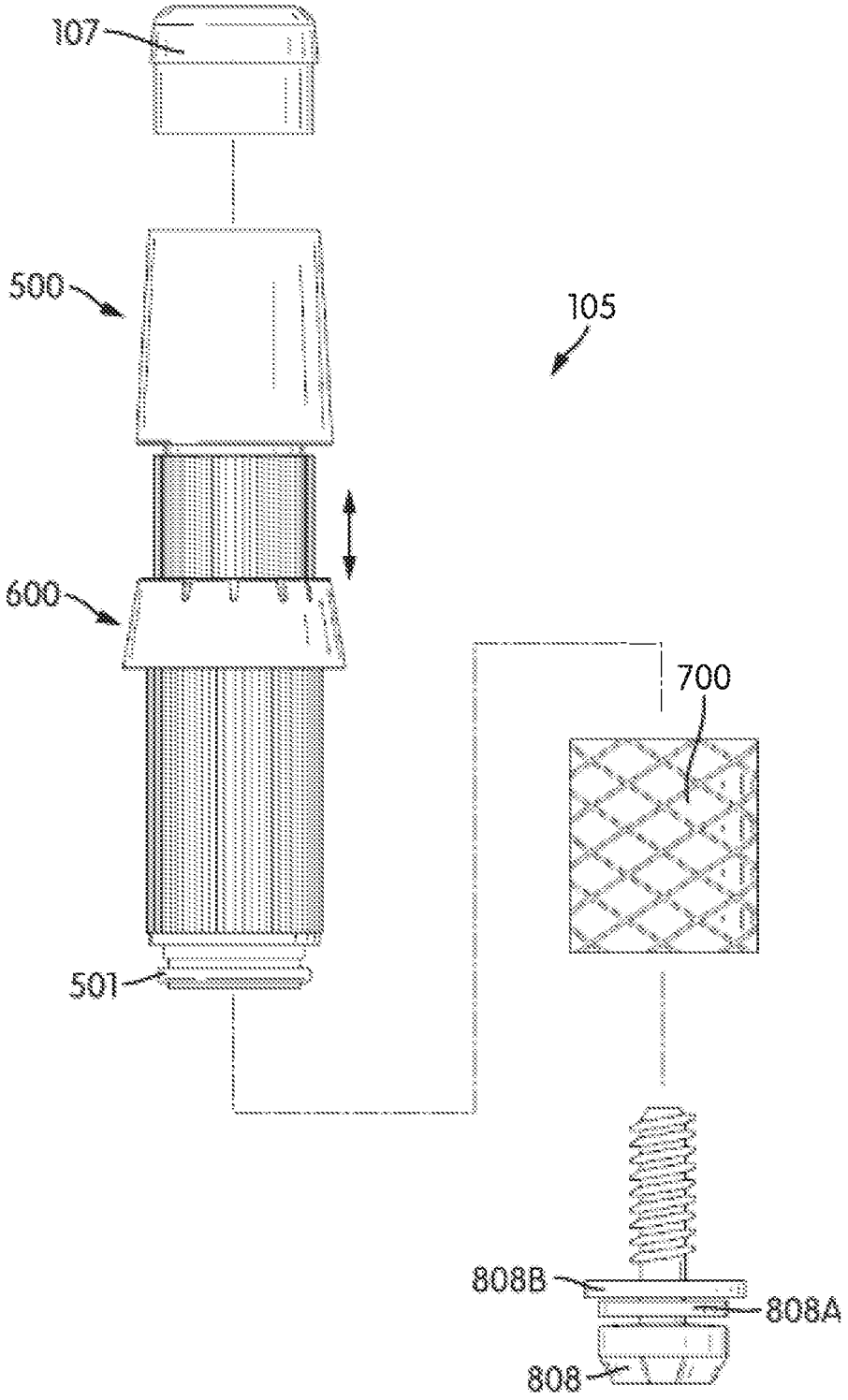

FIGS. 35A and 35B illustrate an exploded view of the releasable connection 105. Generally, the hosel ring 700 is configured to engage the club head bore 264 in the golf club head 200, the hosel adapter 600 is configured to engage in the hosel ring 700 and the golf club head 200, the shaft adapter 500 is configured to engage in the hosel adapter 600, and the shaft 106 is configured to engage the shaft adapter 500. The details of the engagement of these example components/parts will be explained in more detail below.

As illustrated in FIGS. 36A through 36D, the shaft adapter 500 includes a generally cylindrical body 502 having a first end 504 and an opposite second end 506. The first end 504 defines an opening to an interior cylindrical chamber 508 for receiving the end of the golf club shaft 106. The second end 506 includes a securing structure (e.g., a threaded hole 510 in this example structure) that assists in securely engaging the shaft adapter 500 to the club head body 202 as will be explained in more detail below. Additionally, the second end 506 includes a stop ring 505. The stop ring 505 may extend radially from the second end 506 of the shaft adapter 500. The stop ring 505 may be capable of stopping and holding the hosel adapter 600 engaged with the shaft adapter 500, but thereby allowing the adjustment and rotation of the hosel adapter 600 and/or the shaft adapter 500 without being removed from the golf club head 200. The stop ring 505 may be integral to the shaft adapter 500, i.e. formed and/or as part of the shaft adapter 500, extending radially from the second end 506 of the shaft adapter 500. Additionally, the stop ring 505 may be a separate compression o-ring that fits into a channel 507 that extends radially around the second end 506 of the shaft adapter 500. The separate stop ring 505 (compression o-ring) may be rubber or a metal material.

As shown, at least a portion of the first end 504 of the shaft adapter 500 includes a first rotation-inhibiting structure 512. While a variety of rotation-inhibiting structures may be provided without departing from this invention, in this example structure, the rotation-inhibiting structure 512 constitutes splines 512*a* extending along a portion of the longitudinal axis 526 of the exterior surface of the shaft adapter 500. The splines 512*a* of the shaft adapter 500 may prevent rotation of the shaft adapter 500 with respect to the member into which it is fit (e.g., a hosel adapter, as will be explained in more detail below). A variety of rotation-inhibiting structures may be used without departing from the invention. The interaction between these splines and the hosel adapter cylindrical interior will be discussed in more below. Other configurations of splines may be utilized without departing from this invention.

The first rotation-inhibiting structure 512 may extend along a length of the shaft adapter 500 such that the hosel adapter 600 can be disengaged from the first rotation-inhibiting structure 512 and be rotated while still captive on the shaft adapter 500.

Figure 36A:
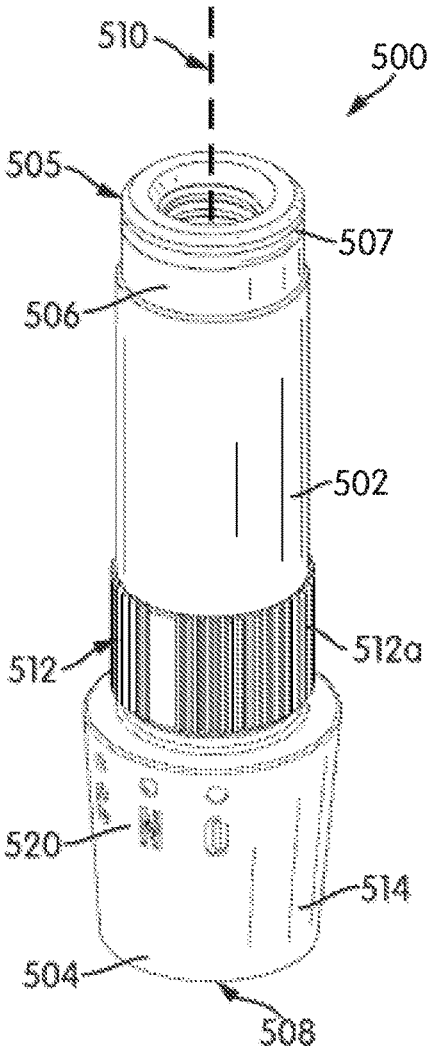
Figure 36B:
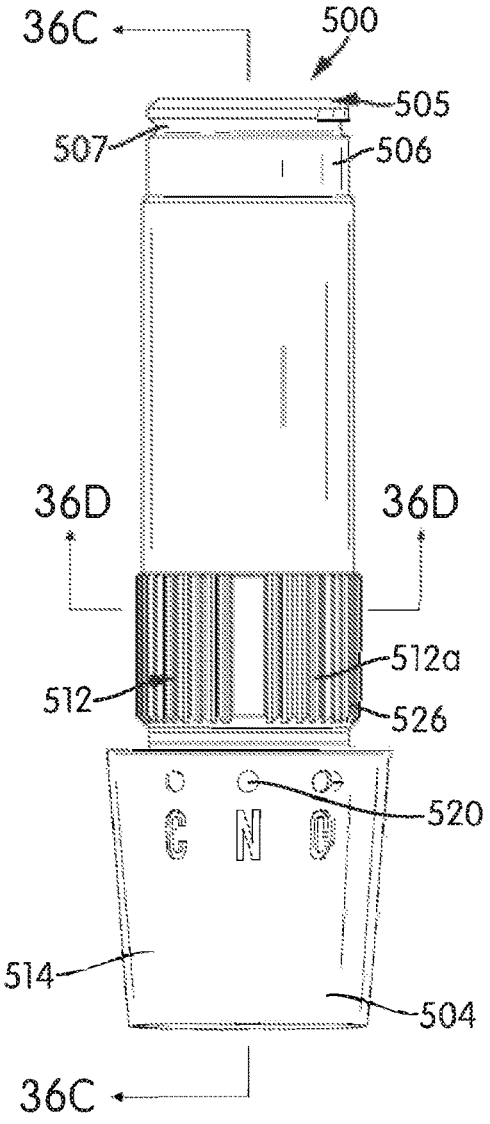

FIGS. 36A and 36B further illustrate that the first end 504 of the shaft adapter 200 includes an expanded portion 514. The expanded portion 514 provides a stop that prevents the shaft adapter 500 from extending into the hosel adapter 600 and the club head body 202 and provides a strong base for securing the shaft adapter 500 to the hosel adapter 600 and the club head body 202. Also, the exterior shape of the first end 504 may be tapered to provide a smooth transition between the shaft 106, the hosel adapter 600, and the golf club head 200 and a conventional aesthetic appearance.

Figure 36C:
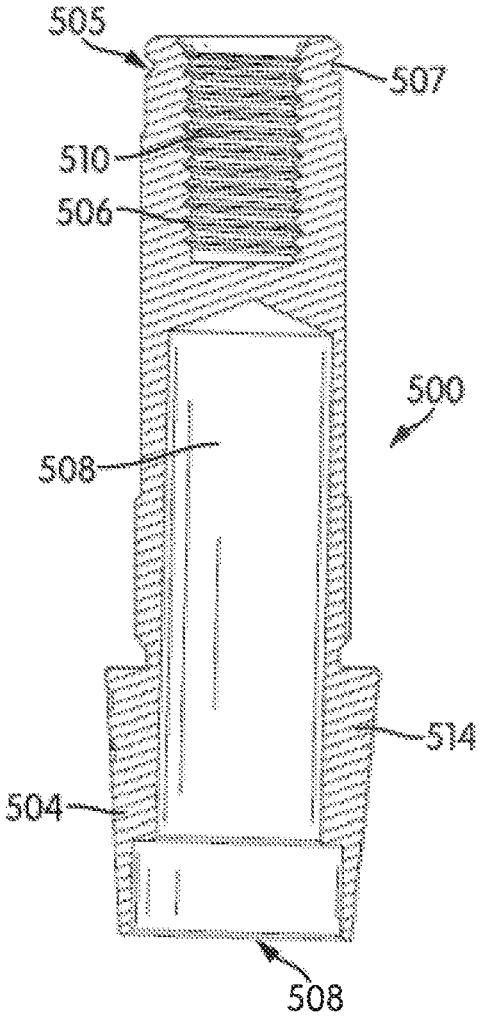
Figure 36D:
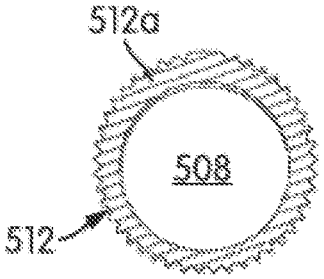

Other features of this example shaft adapter 500 may include an "off-axis" or angled bore hole or interior chamber 508 in which the shaft 106 is received as illustrated for example in FIG. 36C. More specifically, in this illustrated example, the outer cylindrical surface of the shaft adapter 500 extends in a first axial direction, and the interior cylindrical surface of the bore hole 508 extends in a second axial direction that differs from the first axial direction, thereby creating a shaft adapter offset angle. In this manner, while the shaft adapter 500 exterior maintains a constant axial direction corresponding to that of the interior of the hosel adapter 600 and the openings, the shaft 106 extends away from the club head 200 and the hosel adapter 600 at a different and adjustable angle with respect to the club head 200, the hosel adapter 600, and the ball striking face 208 of the club head 200. In this given example, the shaft position and/or angle corresponds to a given face angle of the golf club head 200. One rotational position may be neutral face, one rotational position may be open face, and one rotational position may be closed face. Other rotational positions may be utilized without departing from this invention. The shaft position and/or face angle may be adjusted, for example, by rotating the shaft adapter 500 with respect to the hosel adapter 600 and the club head hosel 104.

While any desired shaft adapter offset angle may be maintained between the first axial direction and the second axial direction, in accordance with some examples of this invention, this shaft adapter offset angle or face angle adjustment may be between 0.25 degrees and 10 degrees, and in some examples between 0.5 degrees and 8 degrees, between 0.75 degrees and 6 degrees, or even between 1 degree and 4 degrees. In more specific examples of the invention, the shaft adapter offset angle or face angle adjustment may by approximately 1.5 degrees offset or 2.0 degrees offset.

FIGS. 37A through 37E illustrate the example hosel adapter 600 in accordance with this invention. As shown, the hosel adapter 600 is generally cylindrical in shape. The hosel adapter 600 has a first end 604 and an opposite second end 606. The first end 604 defines an opening to a borehole 608 for receiving the shaft adapter 500. Within the first end 604 and along the interior sides of the borehole 608, the first end 604 includes a second rotation-inhibiting structure 612 configured to engage the first rotation-inhibiting structure 512 on the shaft adapter 500 (e.g., in an interlocking manner with respect to rotation).

Figure 37A:
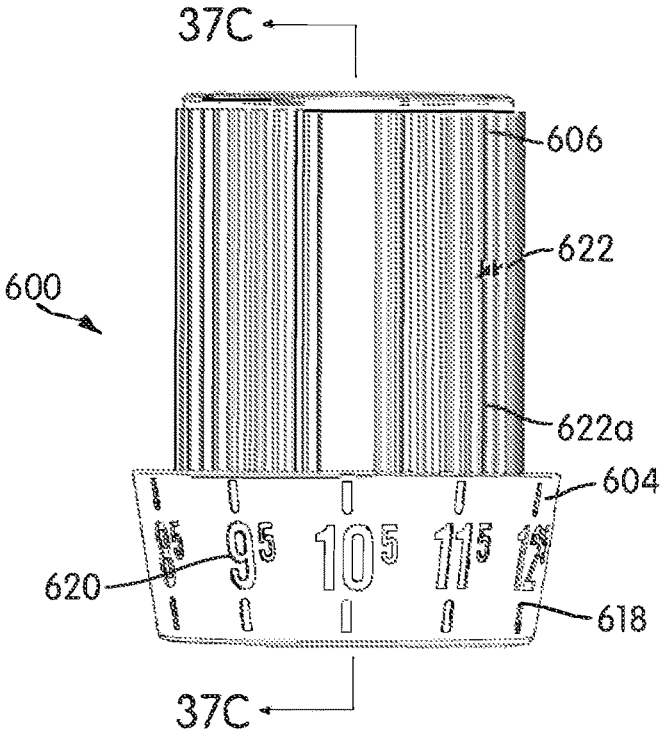
Figure 37B:
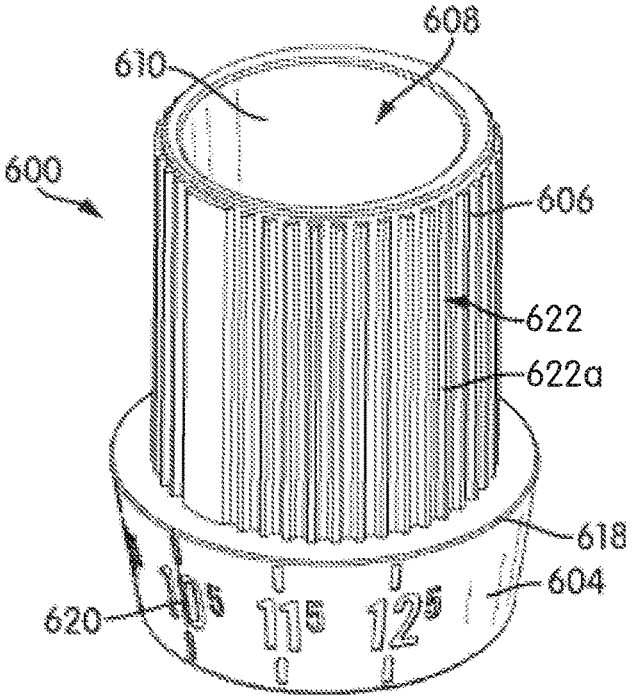
Figure 37C:
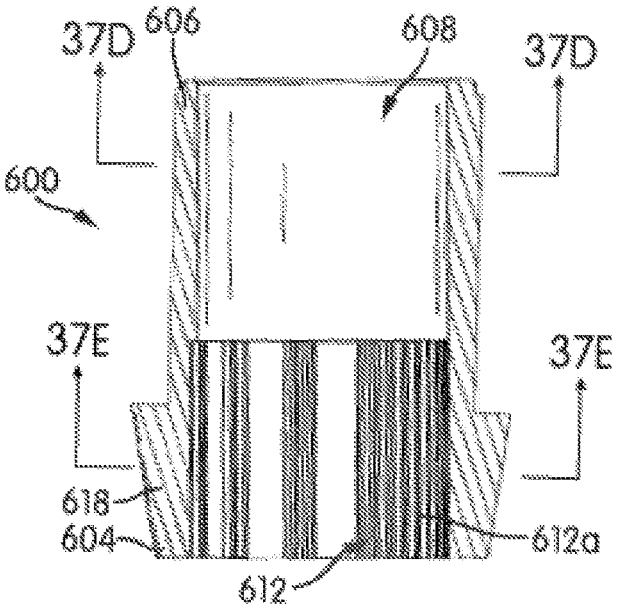
Figure 37D:
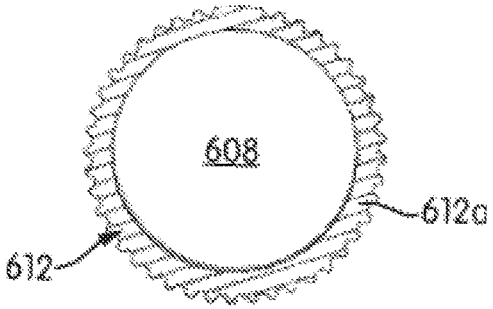
Figure 37E:
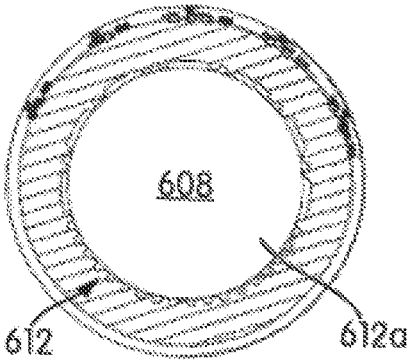

As illustrated in FIG. 37C, at least a portion of the interior of the first end 604 of the hosel adapter 600 includes the second rotation-inhibiting structure 612. While a variety of rotation-inhibiting structures may be provided without departing from this invention, in this example structure, the second rotation-inhibiting structure 612 constitutes splines 612*a* extending along the interior longitudinal axis. The splines 612*a* of the hosel adapter 600 may prevent rotation of the shaft adapter 500 with respect to the hosel adapter 600 into which it is fit (and ultimately with respect to the golf club head). The splines 612*a* of the hosel adapter 600 and the splines 512*a* of the shaft adapter 500 may be configured to interact with each other to thereby limit the number of rotations of the shaft adapter 500 within the hosel adapter 600. This will be explained in more below.

Other features of this example hosel adapter 600 may include an "off-axis" or angled bore hole or interior chamber 608 in which the shaft adapter 200 is received as illustrated for example in FIG. 37C. More specifically, in this illustrated example, the outer cylindrical surface of the hosel adapter 600 extends in a first axial direction, and the interior cylindrical surface of the bore hole 308 extends in a second axial direction that differs from the first axial direction, thereby creating a hosel adapter offset angle. In this manner, while the hosel adapter 600 exterior maintains a constant axial direction corresponding to that of the interior of the club head chamber or bore 264 and hosel ring 700 and the openings, the shaft adapter 500 (and thereby the shaft 106) extends away from the club head 200 at a different and adjustable angle with respect to the club head 200, the hosel adapter 600, and the ball striking face 208 of the golf club head 200. In this given example, the shaft position and/or angle corresponds to a given loft angle. The rotational positions for loft angle may be defined by loft angles starting from approximately 7.5 degrees to 12.5 degrees. Similar configurations of loft angles starting lower and higher may also be utilized without departing from this invention. The club head position and/or loft angle may be adjusted, for example, by rotating the hosel adapter 600 with respect to the hosel ring 700 and the club head 200.

While any desired hosel adapter offset angle may be maintained between the first axial direction and the second axial direction, in accordance with some examples of this invention, this hosel adapter offset angle or face angle adjustment may be between 0.25 degrees and 10 degrees, and in some examples between 0.5 degrees and 8 degrees, between 0.75 degrees and 6 degrees, or even between 1 degree and 4 degrees. In more specific examples of the invention, the hosel adapter offset angle or face angle adjustment may by approximately 1 degree or one-half degree offset.

The second end 606 of the hosel adapter 600 defines a second opening 610 for receiving a securing member 808. Generally, the second opening 610 is sized such that the securing member 808 is able to freely pass through the second opening 610 to engage the threaded hole 510 in the shaft adapter 500. Alternatively, if desired, the securing member 808 also may engage the hosel adapter 600 at the second opening 610 (e.g., the second opening 610 may include threads that engage threads provided on the securing member 808). The securing member 808 may also include a spherical washer 808A and a screw retention device 408B.

Figure 38A:
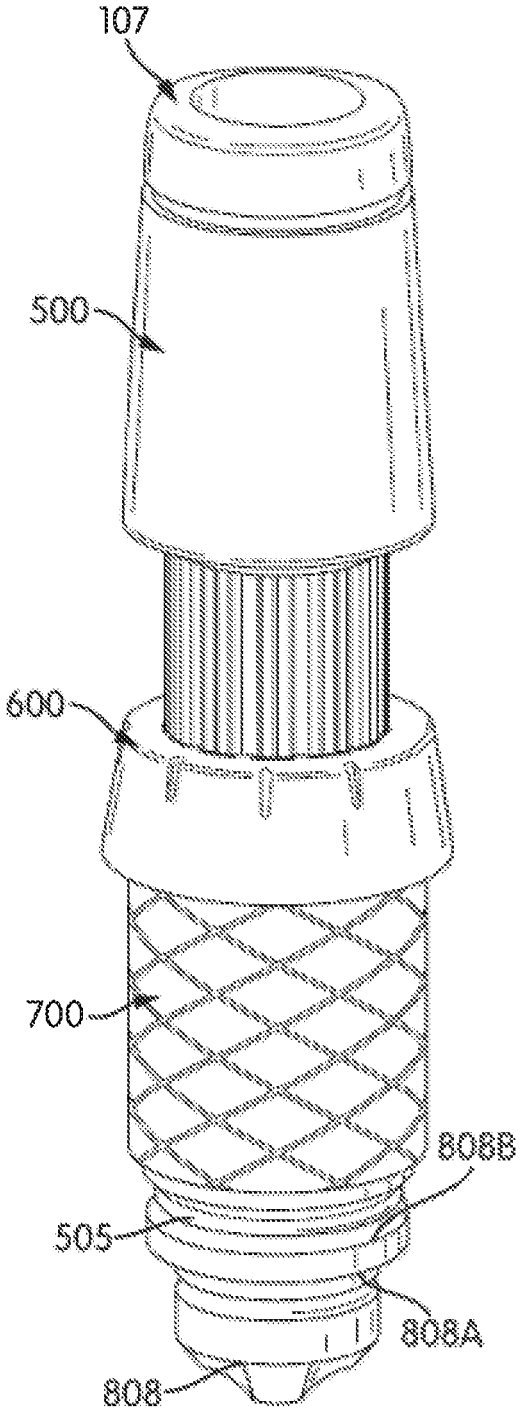
Figure 38B:
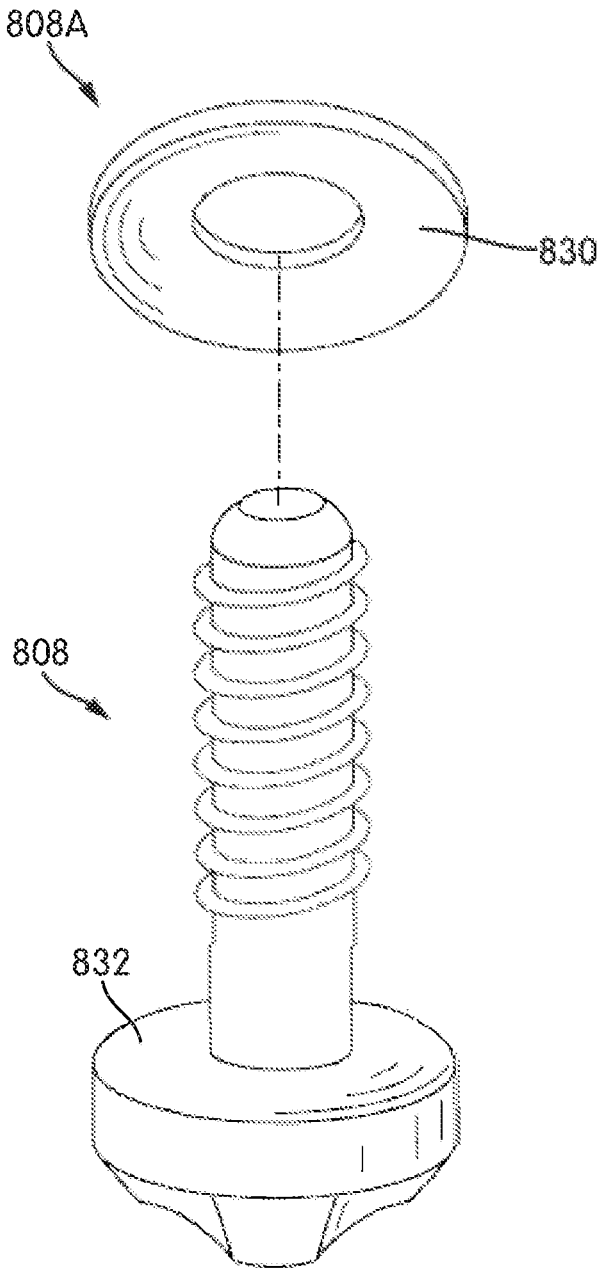
Figure 39:
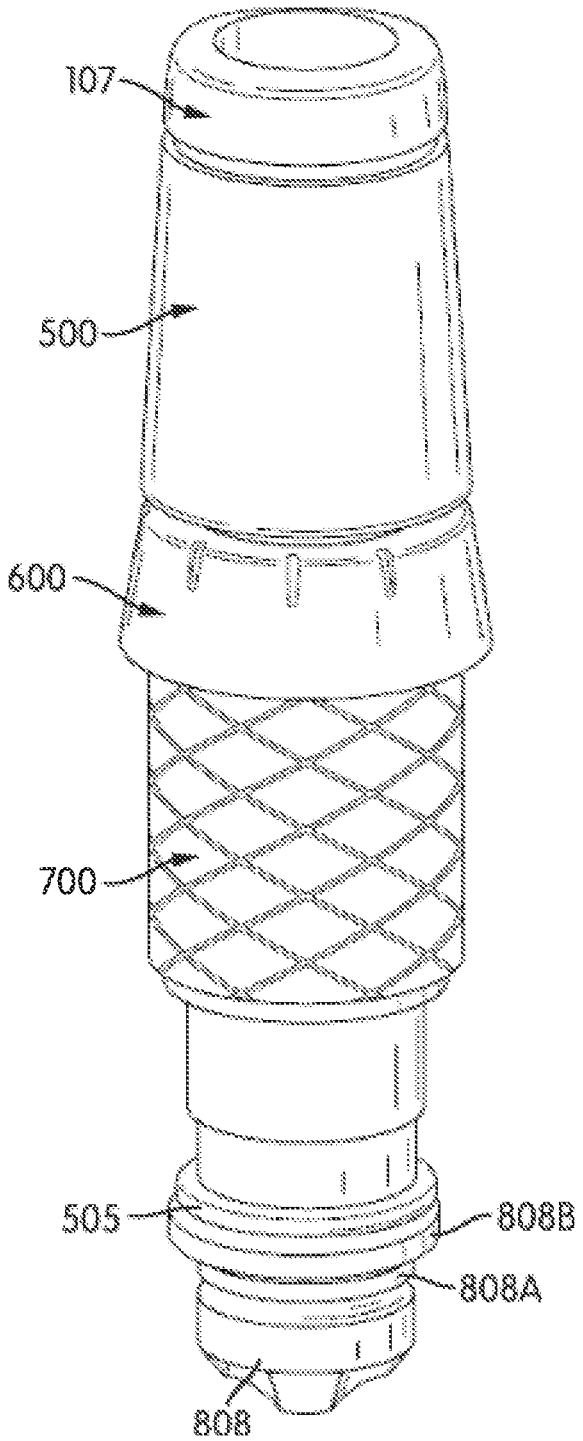
Figure 40:
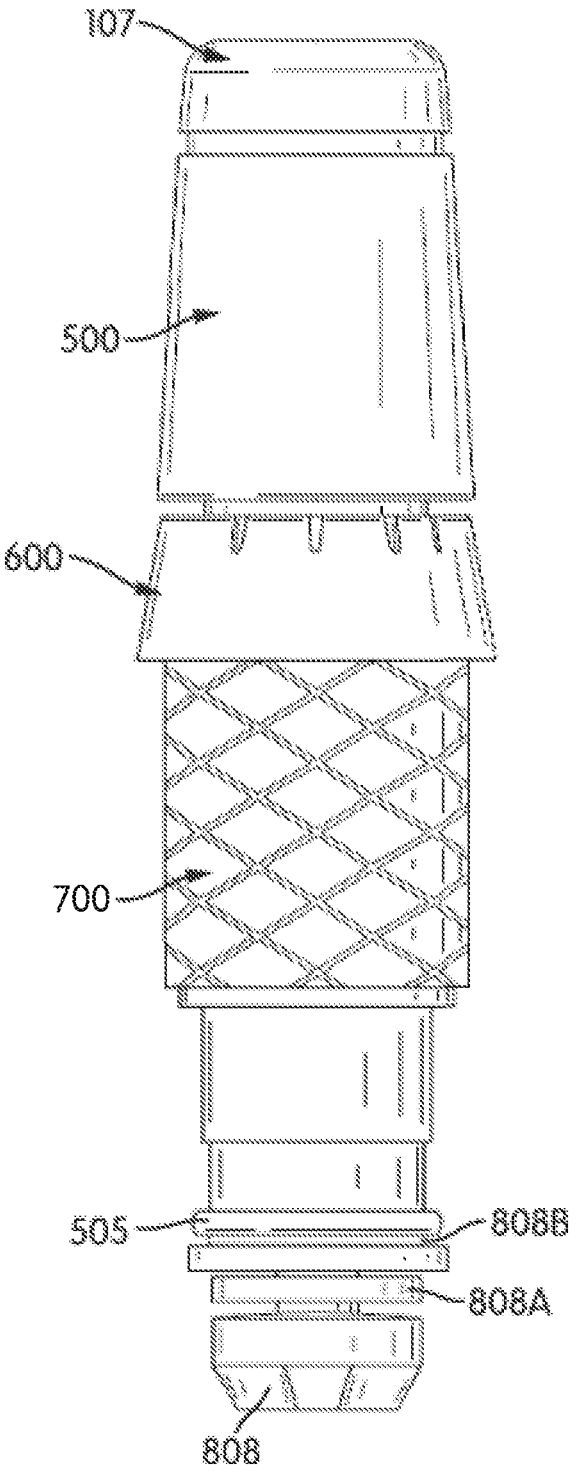

As illustrated in FIG. 38B, the spherical washer 808A may have a convex surface 830 on the side that mates or engages the head of the threaded bolt member 808. Additionally, the head of the threaded bolt member 808 may have a concave surface 832 that mates with the convex surface 830 of the spherical washer 808A. This convex-concave surface 830-832 mating assists with and allows the misalignment from the rotation of the off-axis sleeves may cause for the threaded bolt member 808 and the rest of the releasable connection 105.

As illustrated in FIG. 35A, the securing system may also include a screw retention device 808B. The screw retention device 808B may be located in the club head chamber 264. Additionally, the screw retention device 808B may be sized such that the screw retention device is bigger than a mounting plate 810 positioned in the bore 264. The screw retention device 808B retains the threaded bolt member 808 and not allowing the threaded bolt member 808 to fall out of the club head 200.

The hosel adapter 600 may also be non-rotatable with respect to the golf club head 200. As illustrated in FIGS. 37A and 37B, the exterior of the first end 604 along an exterior surface 602 of the hosel adapter 300 includes a third rotation-inhibiting structure 622 configured to engage a fourth rotation-inhibiting structure 712 on the hosel ring 700 (e.g., in an interlocking manner with respect to rotation). As shown, at least a portion of the first end 604 of the hosel adapter 600 includes the third rotation-inhibiting structure 622 on the exterior surface 602 of the hosel adapter 600. While a variety of rotation-inhibiting structures may be provided without departing from this invention, in this example structure, the rotation-inhibiting structure 622 constitutes splines 622*a* extending along the longitudinal axis of the exterior surface of the hosel adapter 600. The splines 622*a* on the exterior surface of the hosel adapter 600 may prevent rotation of the hosel adapter 600 with respect to the member into which it is fit (e.g., a club head or hosel ring 700, as will be explained in more detail below). The third rotation-inhibiting structure 622 may extend along the overall longitudinal length of the hosel adapter 600.

FIGS. 37A and 37B further illustrate that the first end 604 of the hosel adapter 600 includes an expanded portion 618. The expanded portion 618 provides a stop that prevents the hosel adapter 600 from extending into the club head body 202 and provides a strong base for securing the hosel adapter 600 to the club head body 202. Also, the exterior shape of the first end 604 may be tapered to provide a smooth transition between the shaft 106 and the club head 200 and a conventional aesthetic appearance.

The hosel adapter 600 may be made from any desired materials and from any desired number of independent parts without departing from this invention. In this illustrated example, the entire hosel adapter 600 is made as a unitary, one-piece construction from conventional materials, such as metals or metal alloys, plastics, and the like. In at least some example structures according to this invention, the hosel adapter 600 will be made from a titanium, aluminum, magnesium, steel, or other metal or metal alloy material. Additionally, the hosel adapter 600 may be made from a self-reinforced polypropylene (SRP), for example PrimoSpire® SRP. The bore and/or surface structures (e.g., splines 612*a*, splines 622*a*, and expanded portion 618) may be produced in the material in any desired manner without departing from the invention, including via production methods that are commonly known and/or used in the art, such as by drilling, tapping, machining, lathing, extruding, grinding, casting, molding, etc. The shaft adapter 500 and hosel adapter 600 and any of the other parts could be metal or plastic, or any other suitable materials in any combination. For example, the hosel adapter 600 may be a high-strength plastic while the shaft adapter 500 is made of a metal. Other combinations may utilized without departing from the invention.

Exemplary hosel rings 700 are illustrated in FIGS. 35A and 35B. As shown, the hosel ring 700 is generally cylindrical in shape. Along the interior sides of the borehole 708, the hosel ring 700 includes a fourth rotation-inhibiting structure 712 configured to engage the third rotation-inhibiting structure 622 on the hosel adapter 600 (e.g., in an interlocking manner with respect to rotation). At least a portion of the interior of the hosel ring 700 includes the fourth rotation-inhibiting structure 712. While a variety of rotation-inhibiting structures may be provided without departing from this invention, in this example structure, the fourth rotation-inhibiting structure 712 constitutes splines 712*a* extending along the interior longitudinal axis. The splines 712*a* of the hosel ring 700 may prevent rotation of the hosel adapter 600 with respect to the club head 200 into which it is fit. The splines 712*a* of the hosel ring 700 and the exterior splines 622*a* of the hosel adapter 600 may be configured to interact with each other to thereby limit the number of rotations of the hosel adapter 600 within the hosel ring 700. This interaction will be explained more below.

The hosel ring 700 may also be non-rotatable with respect to the golf club head 200. In an exemplary embodiment, the hosel ring 700 may secured to the club head chamber 264 by any means known and/or used in the art, such as adhesive, glue, epoxy, cement, welding, brazing, soldering, or other fusing techniques, etc. FIG. 35A illustrates the hosel ring 700 secured to the club head 200 in the club head chamber 264. Additionally, the hosel ring 700 may be an integral part of the club head 200, wherein the hosel ring 700 may be molded into the club head chamber 264.

The hosel ring 700 may be made from any desired materials and from any desired number of independent parts without departing from this invention. In this illustrated example, the entire hosel ring 700 is made as a unitary, one-piece construction from conventional materials, such as metals or metal alloys, plastics, and the like. In at least some example structures according to this invention, the hosel ring 700 will be made from a titanium, aluminum, magnesium, steel, or other metal or metal alloy material. The bore and/or surface structures (e.g., splines 712*a*) may be produced in the material in any desired manner without departing from the invention, including via production methods that are commonly known and/or used in the art, such as by drilling, tapping, machining, lathing, extruding, grinding, casting, molding, etc.

FIGS. 38A through 40 illustrate the adjustment member/releasable connection 105 showing all of the components fitted together. Additionally, as illustrated in FIGS. 35A, 35B, 38A, 39, and 40, the adjustment member/releasable connection 105 may also include a shaft ring 107. The shaft ring 107 may provide an additional smooth transition from the shaft 106 to the shaft adapter 500.

The adjustment of the rotational position of the shaft adapter 500 (and the attached shaft 106) and hosel adapter 600 will be explained in more detail below in conjunction with FIG. 35A. Changing the rotational position of the shaft adapter 200 with respect to the hosel adapter 600 may adjust one or more of various parameters, such as loft angle, face angle, or lie angle of the overall golf club. In the exemplary embodiment as illustrated in FIGS. 35A-40, changing the rotational position of the shaft adapter 200 with respect to the hosel adapter 600 may adjust the face angle. Other parameters of the club head 200 may be designed to be adjustable, such as inset distance, offset distance, to fade bias, to draw bias, etc.). Additionally, changing the rotational position of the hosel adapter 600 with respect to the hosel ring 700 and the club head 200 may adjust one or more of the various parameters of the overall golf club. In the exemplary embodiment as illustrated in FIGS. 35A through 40, changing the rotational position of the hosel adapter 600 with respect to the hosel ring 700 and the club head 200 may adjust the loft angle. In these specific embodiments, the shaft adapter 500 and the hosel adapter 600 have independent off-axis bores which enable them to independently adjust the face angle (shaft adapter 500) and the loft angle (hosel adapter 600).

To enable users to easily identify the "settings" of the golf club head 200 (e.g., the club head body 202 position and/or orientation with respect to the shaft 106), any or all of the shaft 106, the shaft adapter 500, hosel adapter 600, and/or the club head 200 may include markings or indicators or other indicia. FIGS. 36A and 36B show an indicator 520 on the shaft adapter 500 (e.g., on the expanded portion 514). FIGS. 37A and 37B show an indicator 620 on the hosel adapter 300 (e.g., on the expanded portion 318). By noting the relative positions of the various indicators, a club fitter or other user can readily determine and know the position of the shaft 106 with respect to the club head body 202 and its ball striking face 208. If desired, the indicators (e.g., indicators 520, or 620) may be associated with and/or include specific quantitative information, such as a specifically identified loft angle and face angle.

Golf club adjustability design has generally included having mating parts and cooperating engagement surfaces allowing for specific adjustability of the golf club head 200. However, these current designs offer many possible adjustable combinations regarding loft angles, face angles, and lie angles. While this adjustability provides some benefits to the golfers, a large number of options to the golfer can also be confusing and cumbersome to the golfer. In certain exemplary embodiments, the present design and specifically the spline configurations of the various rotation-inhibiting structures, provide a limited set of adjustability options that is more user-friendly for the golfer. For example, the adjustability may be limited to only three different adjustable loft angles and three different adjustable face angles. The loft angles may vary from 7.5 degrees to 12.5 degrees. The face angles may be generally referred to as Neutral, Open, and Closed. Therefore, each club head will have a finite number of rotatable positions, such as a total of nine different face angle and loft angle configurations. The configuration of the rotation-inhibiting structures limit the rotational positions of the shaft adapter 500 and the hosel adapter 600, providing more simple, streamlined adjustment features for the golfer. Thus from the figures and descriptions herein, the various spline configurations having engagement surfaces structured such that certain positions are allowed to provide desired adjustment while additional positions are prevented (e.g. the respective splines cannot fit together) to specifically limit the adjustability options. Thus, the respective spline configurations of the shaft adapter 500, hosel adapter 600 and hosel ring 700 define surfaces that prevent cooperative mating and engagement among the components.

Another exemplary option set is using four different adjustable loft angles and three different adjustable face angles, thereby creating a club head with a total of twelve different face angle and loft angle configurations. Another exemplary option set is using five different adjustable loft angles and three different adjustable face angles, thereby creating club head with a total of fifteen different face angle and loft angle configurations. Another exemplary option set is using seven different adjustable loft angles and three different adjustable face angles, thereby creating club head with a total of twenty-one different face angle and loft angle configurations. Other configurations of adjustable face angles and loft angles may be utilized without departing from this invention. It is understood that the respective spline configurations are modified to provide such different configurations discussed.

Figure 41A:
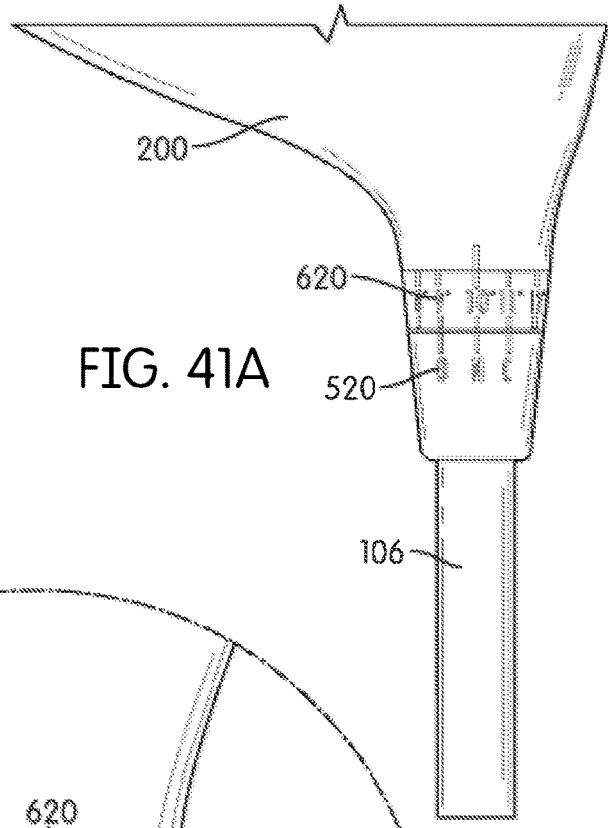
Figure 41B:
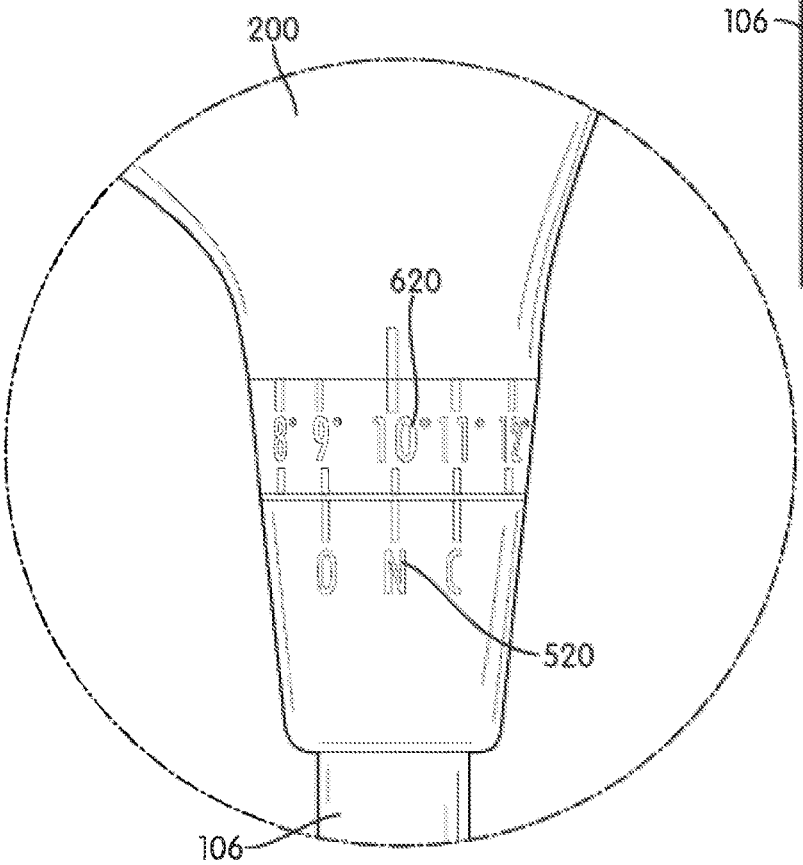
Figure 42A:
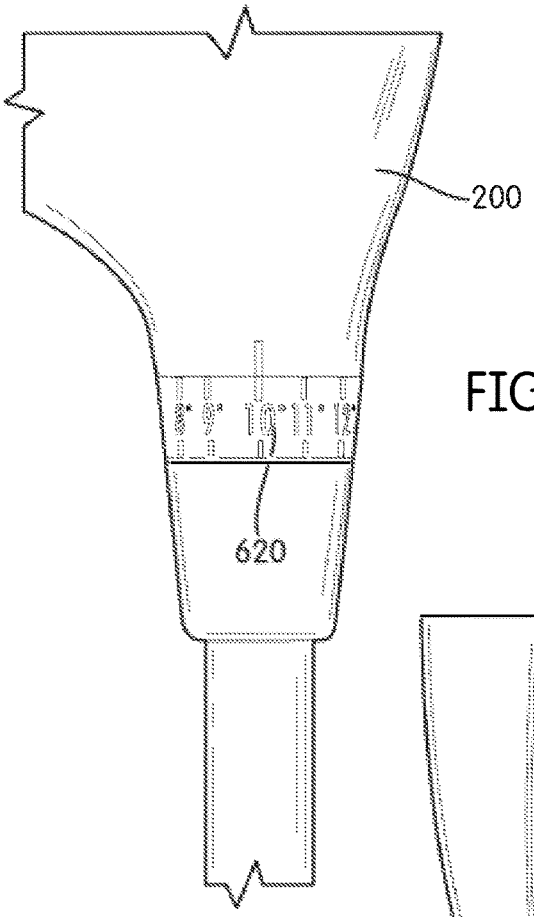
Figure 42B:
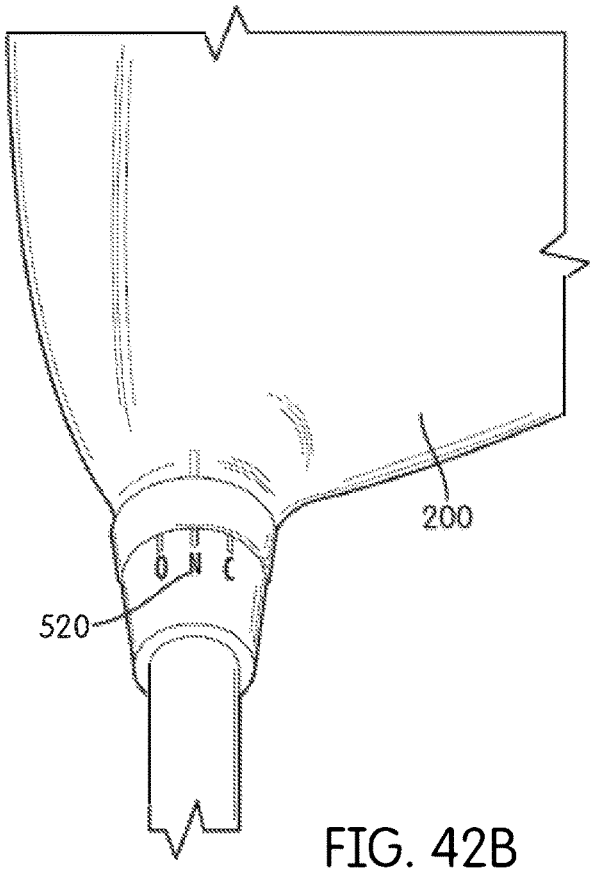
Figure 43:
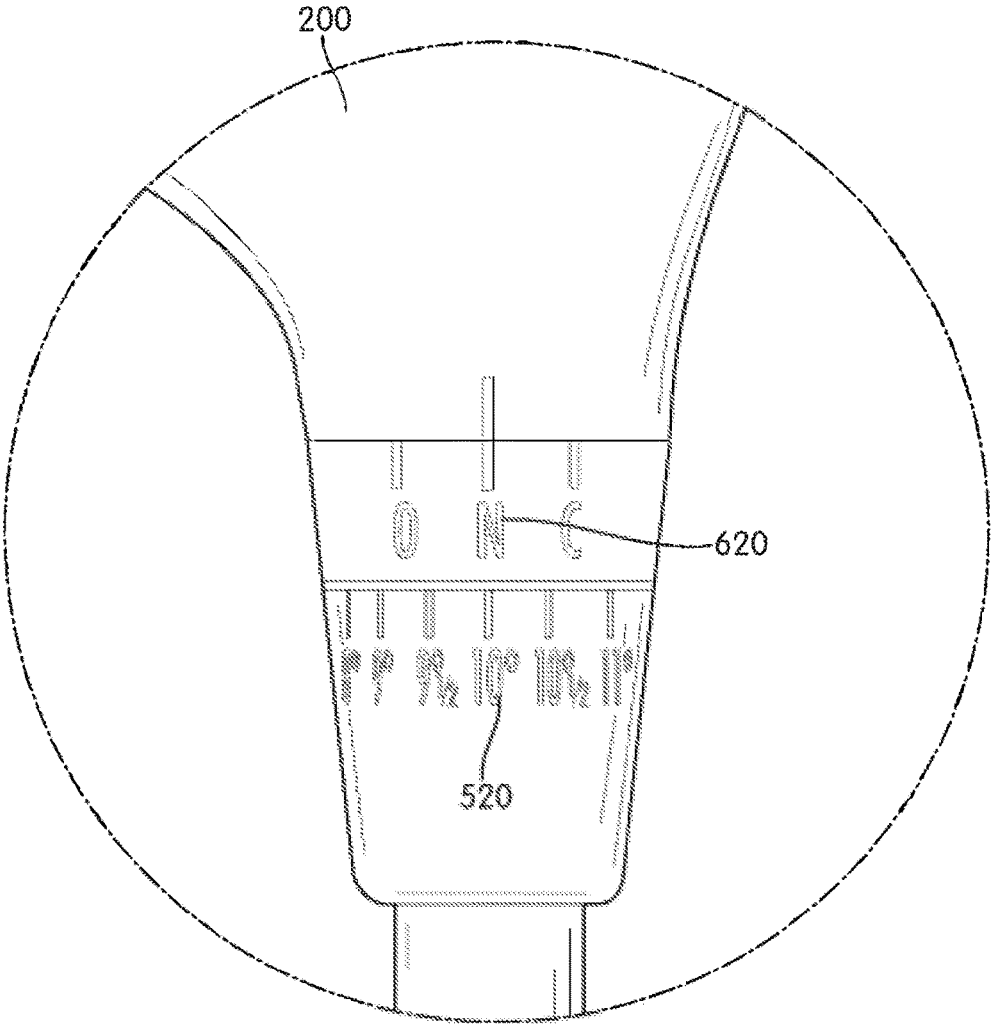
Figure 44:
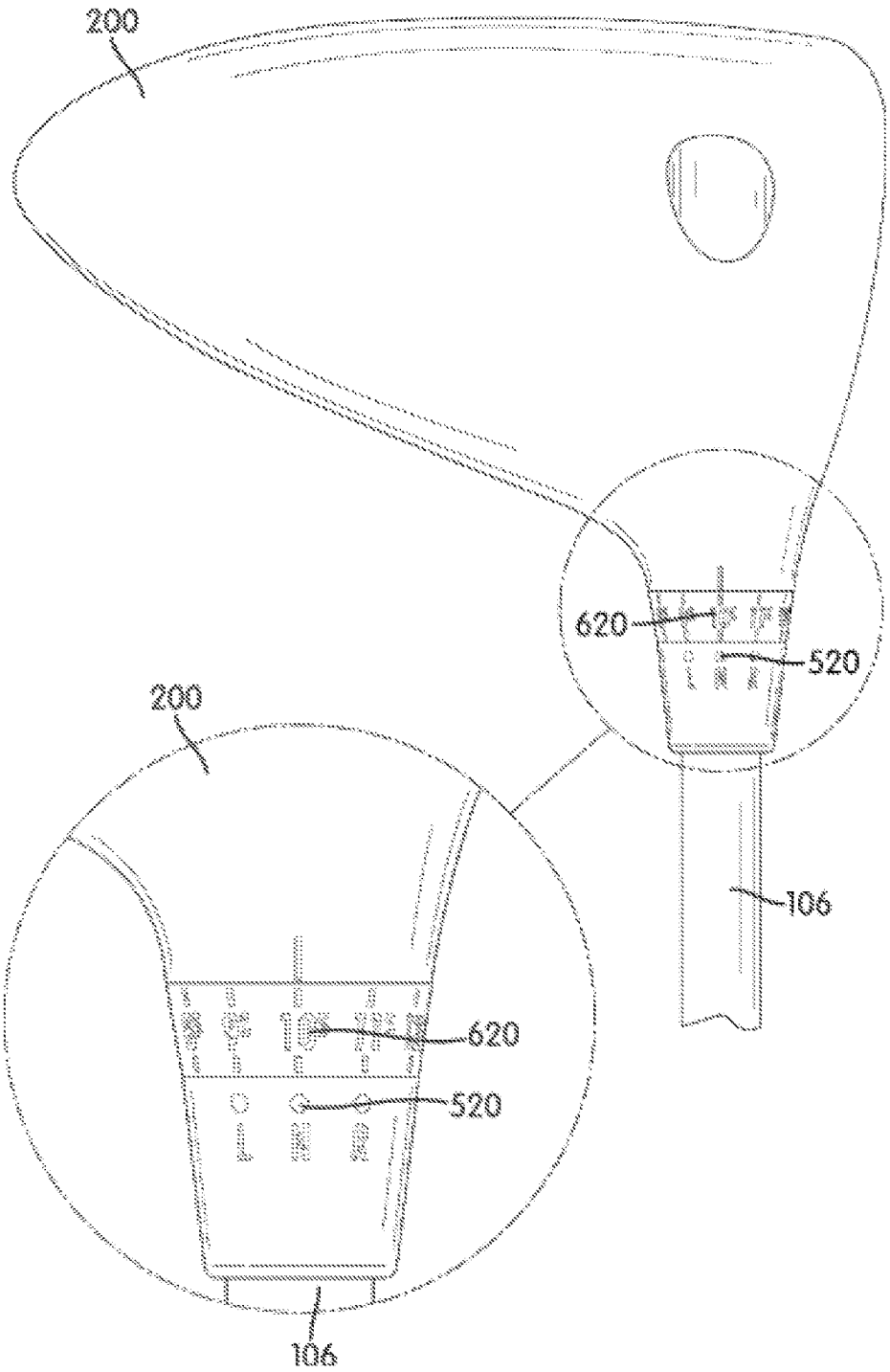
Figure 45A:
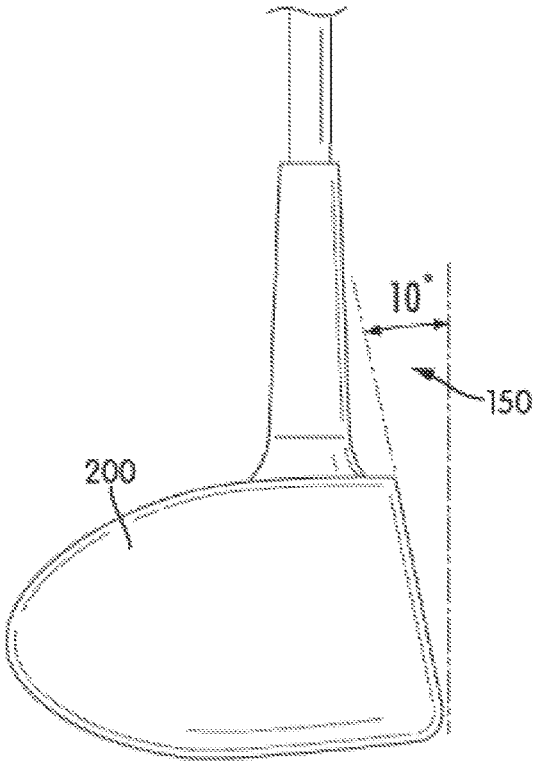
Figure 45B:
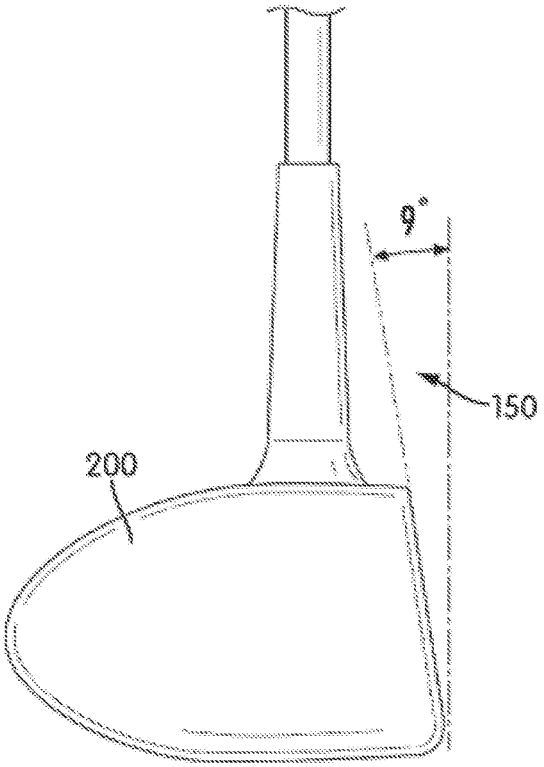
Figure 45C:
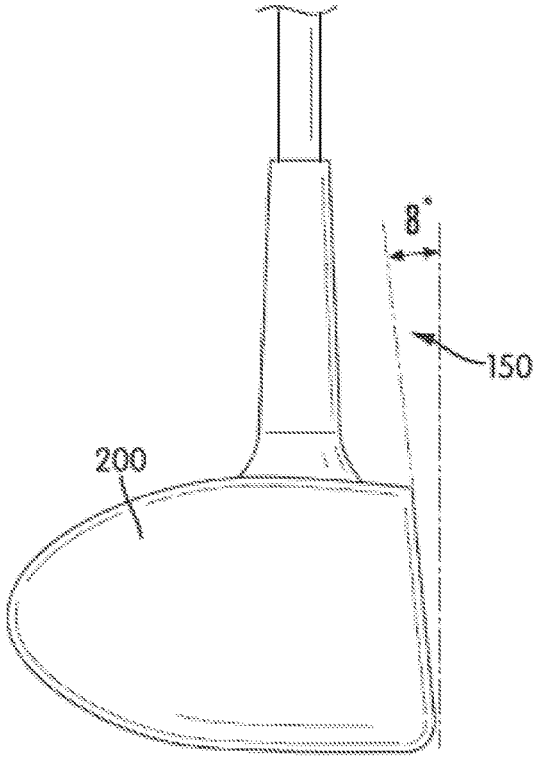
Figure 45D:
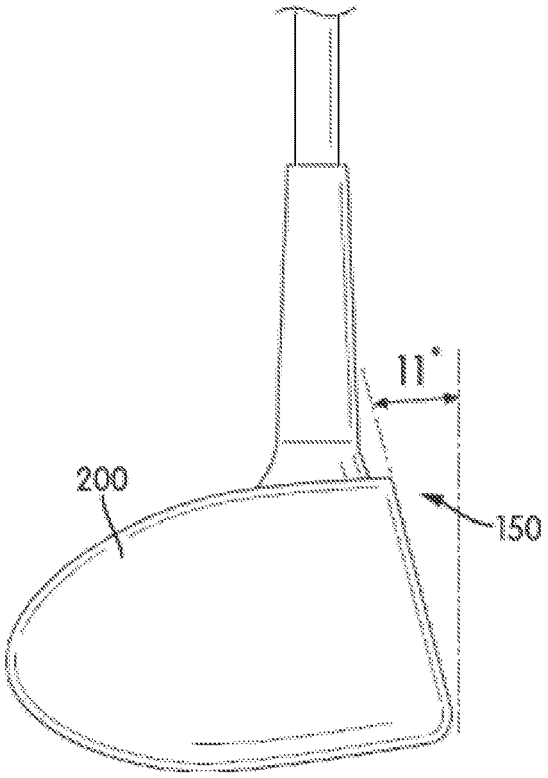
Figure 45E:
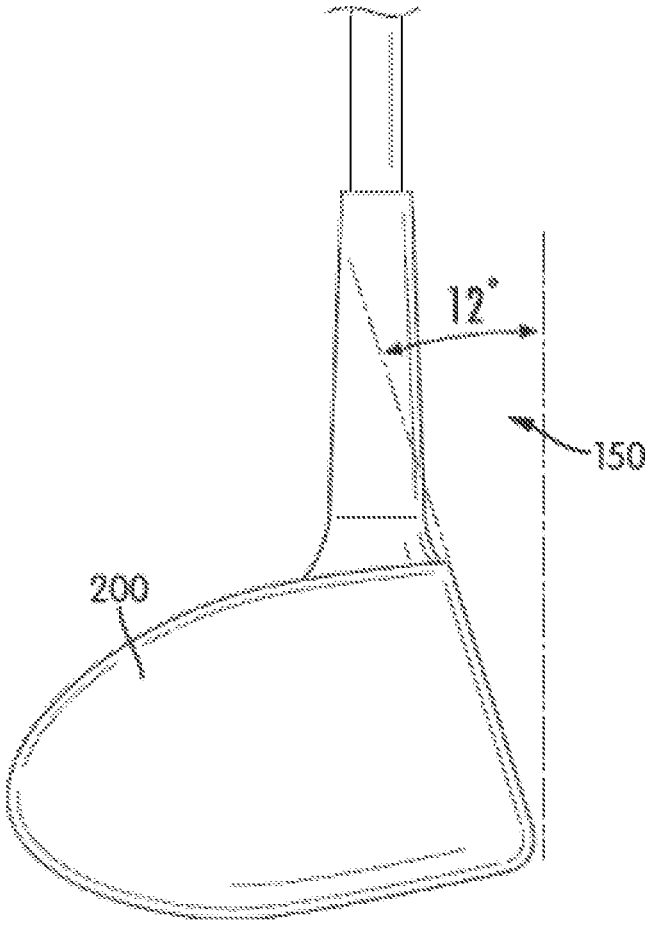
Figure 46A:
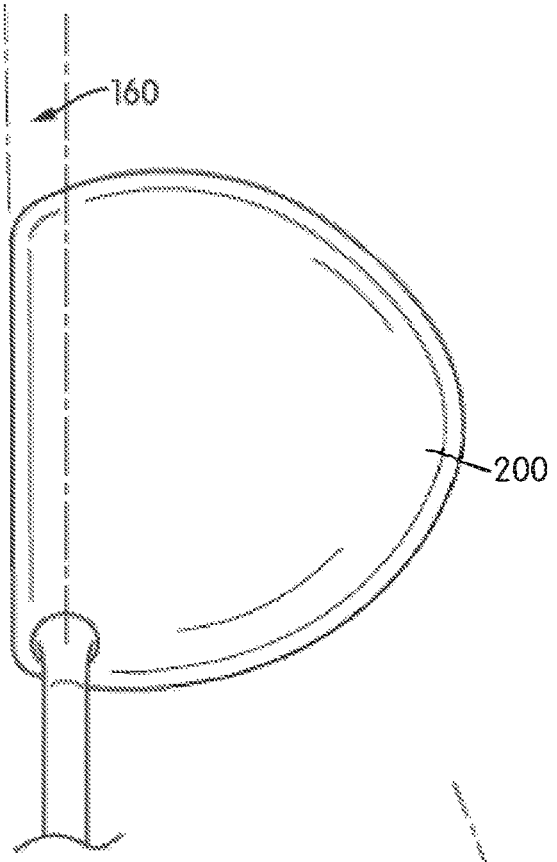
Figure 46B:
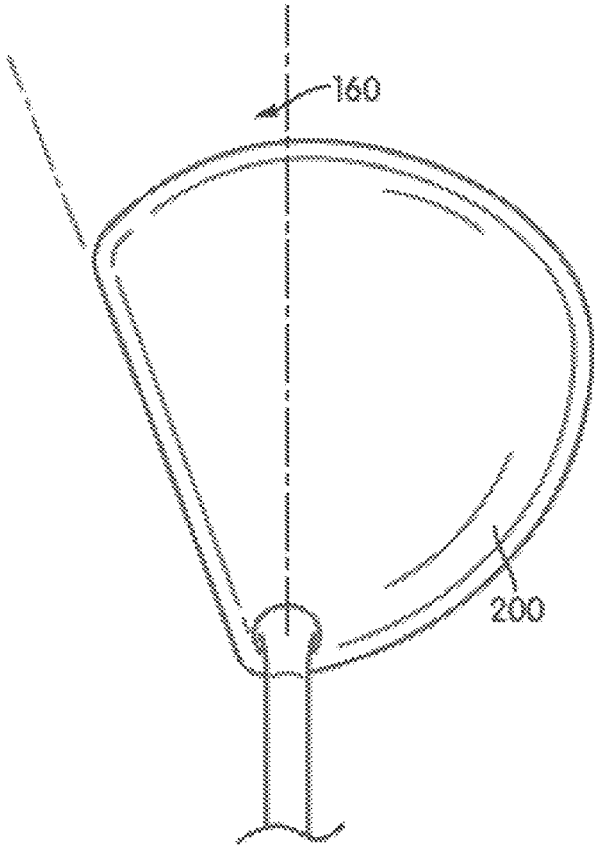
Figure 46C:
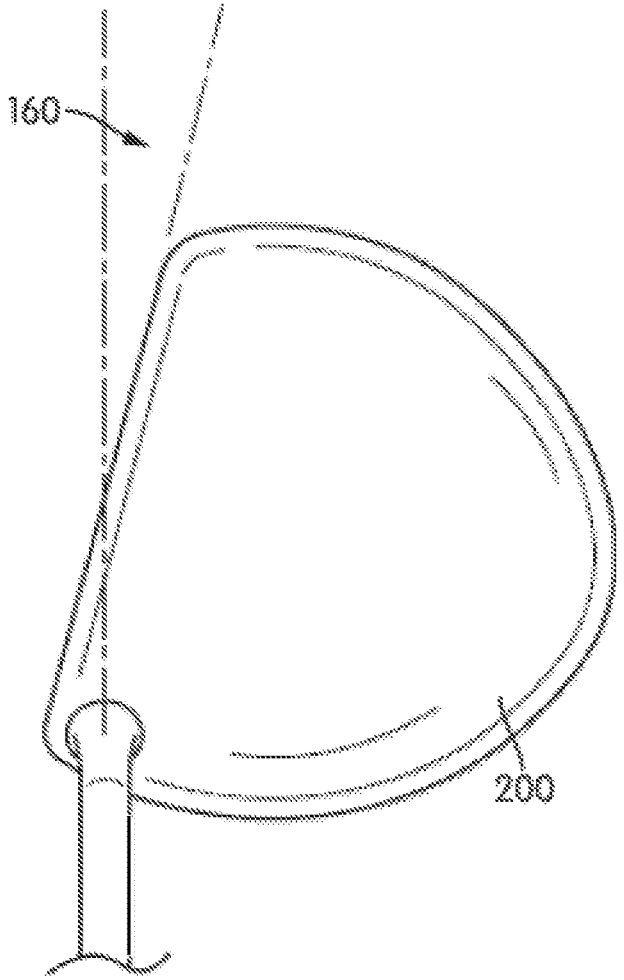

The exemplary embodiment in FIGS. 41A and 41B illustrates a spline configuration that allows five loft angles and three face angles of adjustability. The adjustable loft angles may include 8 degrees, 9 degrees, 10 degrees, 11 degrees, and 12 degrees. FIGS. 45A through 45E show example loft angles 150 for this given club head such as the golf club head 200 shown in FIGS. 1-21. The adjustable face angles may include Open ("O"), Neutral ("N") and Closed ("C"). FIGS. 32A through 32C show example face angles 160 for this given club head. The exemplary embodiment in FIG. 44 illustrates a spline configuration that allows five loft angles and three face angles of adjustability. This spline configuration allows for the adjustability of loft angles that may include 8.5 degrees, 9.5 degrees, 10.5 degrees, 11.5 degrees, and 12.5 degrees. The adjustable face angles may include Open or Left ("L"), Neutral ("N"), and Closed or Right ("R"). The exemplary embodiment in FIG. 29 illustrates a spline configuration with seven loft angles and three face angles of adjustability. This spline configuration includes adjustable loft angles that may include 8 degrees, 9 degrees, 9.5 degrees, 10 degrees, 10.5 degrees, 11 degrees, and 12 degrees (not shown). The adjustable face angles may include Open ("O"), Neutral ("N") and Closed ("C"). FIGS. 28A through 30 illustrated other example embodiments of the adjustability options without departing from this invention.

It should be understood that a "Neutral" face angle may be a reference point/reference face angle and not an actual "neutral" face angle of the face or club head. For example, "Neutral" may represent a 1-degree closed face angle of the face. Using a 2-degree face angle adjustment, "Closed" would have a 3-degree closed face and "Open" would have a 1-degree open face. In another example, "Neutral" may represent a 3-degree open face angle of the face. Using a 2-degree face angle adjustment, "Closed" would have a 1-degree open face and "Open" would have a 5-degree open face.

The spline configuration of the embodiment illustrated in FIGS. 35A-40 will be now be described to illustrate how the invention provides for and limits the rotational movement of the shaft adapter 500 and hosel adapter 600 and adjustable face angle and loft angle positions as described above. The embodiment in FIGS. 35A-40 illustrates a three loft angle and three face angle adjustability spline configuration. The internal splines 612*a* of the hosel adapter 600 and the splines 512*a* of the shaft adapter 500 may be configured to engage with each other to thereby limit the number of rotations of the shaft adapter 500 within the hosel adapter 600, which in turn thereby defines a concrete number of configurations for the golf club head 200. Additionally, the splines of the hosel ring 700 and the exterior splines 622 of the hosel adapter 600 may also be configured to engage with each other to thereby limit the number of rotations of the hosel adapter 600 within the hosel ring 700. For example, the spline configuration of the hosel ring 700 and the exterior splines 622 of the hosel adapter 600 may be limited to being rotated in three different rotational positions (e.g., three different loft angles). In other embodiments, the spline configuration of the shaft adapter 500 and the hosel adapter 600 will provide for and limit the rotational movement of the shaft adapter 500 and hosel adapter 600 for other additional adjustable face angles and loft angles positions.

Figure 34A:
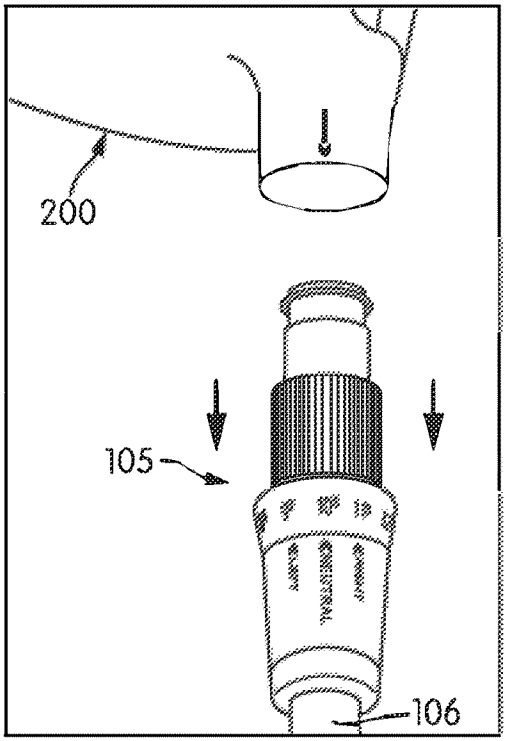
FIGS. 34A-46C illustrate various views of an example adjustment member capable of being utilized with the golf club heads described herein.
Figure 34B:
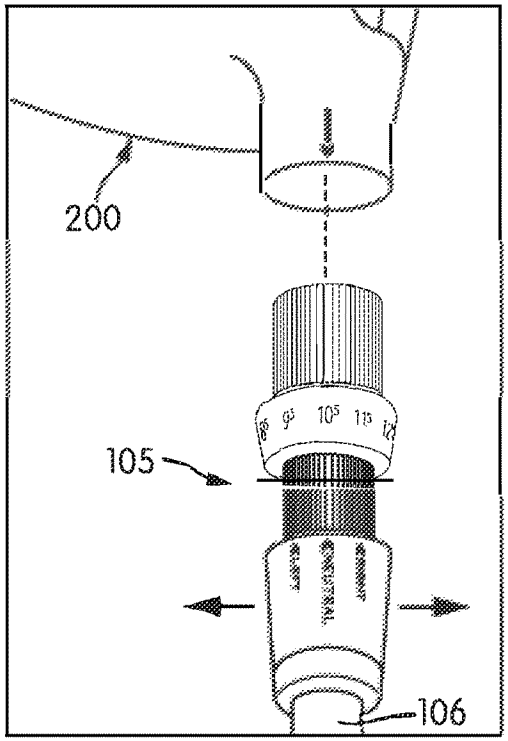
Figure 34C:
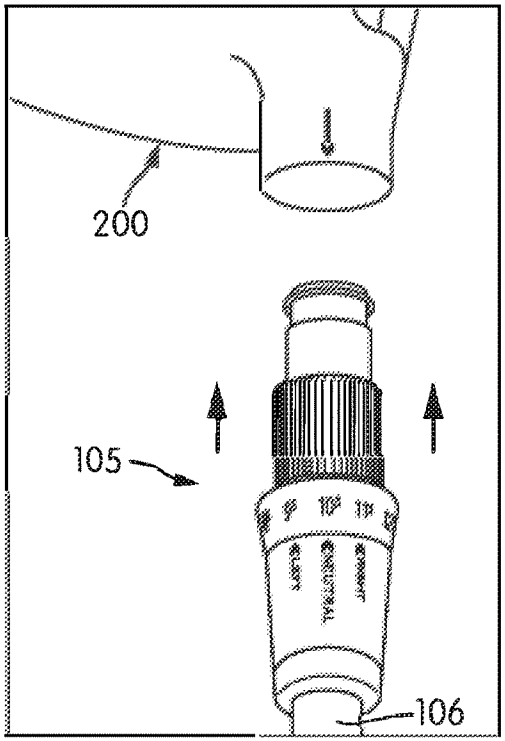

Accordingly, the adjustment member 105 allows adjustment of parameters such as loft angle and face angle in exemplary embodiments of the invention. Such club head parameter adjustment affects the overall position of the golf club head, for example, with respect to the golf club shaft 106. FIGS. 34A-34C show how the adjustment member 105 can be manipulated to adjust loft angle and face angle. The adjustment member 105 may be loosened in the club head wherein the shaft adapter and hosel adapter can be turned to the desired settings and then re-tightened in the club head. While FIGS. 34A-34C show the adjustment member 105 removed from the hosel to adjust, it is understood that the adjustment member 105 is capable of being loosened but remain in connection to the club head in the bore while still allowing the shaft adapter and hosel adapter to be turned to adjust the settings. Such adjustment can also affect the golf club position such as when the golfer "soles" the golf club when addressing a golf ball in preparation for making a golf shot, e.g., when the golfer rests the golf club head on the ground when preparing to strike the golf ball. Thus, depending on the configuration of the golf club head based on the selected positions of the adjustment member, the way the golf club soles can be affected. As discussed above, FIG. 18 shows that the sole surface of the golf club head 200 has the uninterrupted area 320. The uninterrupted area 320 minimizes any affect that the adjustments via the adjustment member 105 have when the golfer soles the golf club head at address. For example, if the sole 214 has surface interruptions at certain locations, certain adjustments via the adjustment member 105 may impact how the golf club head is positioned at address. The uninterrupted surfaces of the sole 214 lessen or eliminate any such impact. Thus, the uninterrupted area 320 cooperates with the adjustment member 105 such that the golf club head will sole corresponding to the configuration set by the golfer via the adjustment member 105. By minimizing or eliminating the effects on soling from the adjustment member, the golfer can improve the ability to square the golf club to the golf ball at address.

Several different embodiments of the golf club head of the present invention have been described herein. The various embodiments have several different features and structures providing benefits and enhanced performance characteristics. It is understood that any of the various features and structures may be combined to form a particular club head of the present invention. It is further understood that the various types of golf club heads disclosed herein could be grouped together based on certain parameters and provided as a kit or set of clubs.

The structures of the golf club heads disclosed herein provide several benefits. The unique geometry of the golf club head provides for beneficial changes in mass properties of the golf club head. The geometric weighting feature provides for reduced weight and/or improved weight redistribution. The void defined in the club head can reduce overall weight as material is removed from a conventional golf club head wherein a void is defined in place of such material that would normally be present. The void also aids in distributing weight throughout the club head to order to provide improved performance characteristics. The void provides for distributing weight to the rear corners of the club head, at the toe and the heel. Increases in moment of inertia have been achieved while optimizing the location of the center of gravity of the club head. This can provide a more forgiving golf club head as well as a golf club head that can provide more easily lofted golf shots. In certain exemplary embodiments, the weight associated with the portion of the golf club head removed to form the void may be approximately 4-15 grams and more particularly, 8-9 grams. In other exemplary embodiments, this weight savings may be redistributed to other areas of the club head such as towards the rear at the toe and the heel. In certain exemplary embodiments, approximately 2% to 7.5% of the weight is redistributed from a more traditional golf club head design. In still further examples, the void may be considered to have a volume defined by an imaginary plane extending from the sole surfaces and rear of the club and to cooperate with the side surfaces of the legs and underside portion of the cover. The internal cavity may also have a certain volume. The volumes are dimensioned to influence desired performance characteristics. It is further understood that certain portions of the club head can be formed from alternative materials to provide for weight savings or other weight redistribution. In one exemplary embodiment, the walls defining the void may be made from other materials such as composites or polymer based materials.

As discussed, the weight can be redistributed to more desired locations of the club head for enhanced performance. For example, with the centrally-located void and the legs extending outwardly towards the rear on the heel side and the toe side, more weight is located at such areas. This provides more desired moment of inertia properties. In the designs described herein, the moment of inertia (MOI) about a vertical axis (z-axis) through the center of gravity of the club head (Izz) can range from approximately 1500 gm-cm$^2$ to 5900 gm-cm$^2$ depending on the type of golf club. In an exemplary embodiment for a driver type golf club, the moment of inertia about a vertical axis (z-axis) through the center of gravity of the club head (Izz) can range from approximately 3800 gm-cm$^2$ to 5900 gm-cm$^2$, and in a further exemplary embodiment, the Izz moment of inertia can range from 4300 gm-cm$^2$ to 5200 gm-cm$^2$. In an exemplary embodiment of a fairway wood type golf club, the moment of inertia about a vertical axis (z-axis) through the center of gravity of the club head (Izz) can range from approximately 2000 gm-cm$^2$ to 3500 gm-cm$^2$, and in a further exemplary embodiment, the Izz moment of inertia can range from 2200 gm-cm$^2$ to 3000 gm-cm$^2$. In an exemplary embodiment of a hybrid type golf club, the moment of inertia about a vertical axis (z-axis) through the center of gravity of the club head (Izz) can range from approximately 2000 gm-cm$^2$ to 3500 gm-cm$^2$, and in a further exemplary embodiment, the Izz moment of inertia can range from 2200 gm-cm$^2$ to 3000 gm-cm$^2$, and in a further exemplary embodiment, the Izz moment of inertial can range from 1800 gm-cm$^2$ to 2800 gm-cm$^2$. In a particular embodiment utilizing the adjustable connection mechanism in the hosel, the Izz moment of inertia is approximately 4400 gm-cm$^2$ to 4700 gm-cm$^2$. These values can vary. With such moment of inertia properties, improved ball distance can be achieved on center hits. Also, with such moment of inertia properties, the club head has more resistance to twisting on off-center hits wherein less distance is lost and tighter ball dispersion is still achieved. Thus, a more forgiving club head design is achieved. As a result, golfers can feel more confident with increasing their golf club swing speed.

In addition, the center of gravity of the club head is positioned at a location to enhance performance. In the structures of the exemplary embodiments of the golf club head, the center of gravity is positioned outside of the void location of the club head, and inside the internal cavity or internal volume of the club head. In certain exemplary embodiments, the center of gravity is located between an inner surface of the ball striking face and an inner surface of the base support wall, or within the internal cavity.

In addition, the geometry and structure of the golf club head provides enhanced sound characteristics. With the structure of the crown, geometric weighting feature as well as the internal support members as described above such as in FIGS. 29-44, it has been determined that the first natural frequency of the golf club head, other than the six rigid body modes of the golf club head, is in the range of 2750-3200 Hz. In additional exemplary embodiments, the first natural frequency of the golf club head is at least 3000 Hz. It has been found that golf club head structures providing such a frequency of less than 2500 Hz tend to be displeasing to the user by providing undesirable feel including sound and/or tactical feedback. The structures provided herein provide for increased frequencies at more desirable levels.

In addition, the moveable weight mechanisms employed herein provide additional options for distributing weight providing further adjustability of moment of inertia and center of gravity properties. For example, embodiments described herein providing weights that can be further moved towards the rear of the club head at the heel and toe can provide more easily lofted golf shots. Weights can also be more towards the front of the club head to provide more boring shots, such as those desired in higher wind conditions. Weights can also be positioned more towards a crown or sole of the golf club head in certain embodiments. Such moveable weighting features provide additional customization. Finally, various adjustable connection mechanisms can be used with the club heads to provide club head adjustability regarding face angle, loft angle and/or lie angle. Such adjustable connection mechanisms are further disclosed, for example, in U.S. Ser. No. 13/593,058, which application is incorporated by reference herein. Other adjustable mechanisms could also be used. A further embodiment utilizing the adjustable connection mechanism described above allows the golfer to adjust parameters of the golf club such as loft angle of the golf club. Certain golfers desire a lower loft angle setting such as but not limited to 7.5 degrees, 8 degrees, or 8.5 degrees or even 9 degrees. Such low loft angle settings may provide lower ball spin at ball impact. The moveable weight mechanisms, such as shown in FIGS. 31-33 could be utilized to place a heavier weight low towards a sole of the golf club head. This weighting configuration can provide for increased ball spin at the low loft angle settings. Certain other golfers may desire a higher loft setting such as but not limited to 11 degrees, 11.5 degrees, 12 degrees or 12.5 degrees. Such high loft angle settings may provide higher ball spin at ball impact. The moveable weight mechanism could be utilized to place a heavier weight high towards the top of the golf club head. This weighting configuration can provide for reduced ball spin at the high loft angle settings. Additional moveable weight mechanisms could provide combinations of high/low and fore/aft weighting configurations to affect performance characteristics and provide particular desired launch conditions at particular loft angle settings.

As discussed, the golf club head 200 has the strategically positioned uninterrupted area 320. The surfaces of the interrupted area that are void of surface interruptions allow a golfer to consistently sole the golf club corresponding to the golf club head configurations selected by the golfer via the adjustment member 105.

Thus, while there have been shown, described, and pointed out fundamental novel features of various embodiments, it will be understood that various omissions, substitutions, and changes in the form and details of the devices illustrated, and in their operation, may be made by those skilled in the art without departing from the spirit and scope of the invention. For example, it is expressly intended that all combinations of those elements and/or steps which perform substantially the same function, in substantially the same way, to achieve the same results are within the scope of the invention. Substitutions of elements from one described embodiment to another are also fully intended and contemplated. It is the intention, therefore, to be limited only as indicated by the scope of the claims appended hereto.

What is claimed is:

1. A golf club head comprising:

a body defining a ball striking face, a crown, and a sole, the body further having a first leg extending away from the ball striking face and a second leg extending away from the ball striking face, wherein a void is defined between the first leg and the second leg, the crown extending over the void, the body further defines an internal cavity defined at least in part by an inner surface of the ball striking face, an underside surface of the crown, and an internal surface of the sole, and a first wall having a first inner surface facing into the internal cavity, and a first outer surface facing into the void, and a second wall having a second inner surface facing into the internal cavity and a second outer surface facing into the void, and wherein the first wall and the second wall have respective distal ends, wherein the distal ends extend toward one another, wherein the sole further comprises one or more transition surfaces, wherein a first transition surface is positioned proximate to the sole and the first outer surface of the first wall, wherein a second transition surface is positioned proximate to the sole and the second outer surface of the second wall, wherein a center of gravity of the golf club head is located within the internal cavity.

2. The golf club head of claim 1, wherein the first leg and the second leg converge towards one another to an interface area, the interface area positioned proximate a central location of the club head.

3. The golf club head of claim 2, wherein the interface area defines a third wall having a third inner surface facing into the internal cavity and a third outer surface facing into the void, wherein the third wall is substantially vertical.

4. The golf club head of claim 2, wherein the golf club head defines a breadth dimension and the interface area is positioned at a range of 40%-60% of the breadth dimension, measured from the ball striking face.

5. The golf club head of claim 1, wherein a moment of inertia through a center of gravity of the golf club head about a vertical axis is in a range between 4300 $g*cm^2$ and 5200 $g*cm^2$.

6. The golf club head of claim 1, wherein the void is not visible at an address position, and wherein the void is visible from an underside of the club head.

7. The golf club head of claim 1, further comprising a first gusset member positioned proximate the first inner surface of the first wall, and wherein the first gusset member has a first side connected proximate the first inner surface of the first wall and a second side connected on an internal sole surface, and further comprising a second gusset member positioned proximate the second inner surface of the second wall, wherein the second gusset member has a first side connected proximate the second inner surface of the second wall and a second side connected on the internal sole surface.

8. The golf club head of claim 1, wherein the internal cavity defines a first volume and wherein the void defines a second volume, wherein the second volume of the void is approximately 15%-25% of the first volume of the internal cavity.

9. A golf club head comprising:

a body defining a ball striking face, a crown and a sole, the body further having a first leg extending away from the ball striking face and a second leg extending away from the ball striking face wherein a void is defined between the first leg and the second leg, the crown extending over the void, the body further defining an internal cavity defined at least in part by an inner surface of the ball striking face, an underside surface of the crown, and an internal surface of the sole, the first leg having a first wall having a first inner surface facing into the internal cavity and a first outer surface facing into the void, the second leg having a second wall having a second inner surface facing into the internal cavity and a second outer surface facing into the void; and wherein the sole further comprises one or more transition surfaces, wherein a first transition surface is positioned proximate to the sole and the first outer surface of the first wall, wherein a second transition surface is positioned proximate to the sole and the second outer surface of the second wall, wherein the first leg and the second leg converge towards one another to an interface area, wherein the body defines a rear and wherein the void has a first width proximate the interface area and a second width proximate the rear, the second width being greater than the first width;

wherein the internal cavity defines a first volume and wherein the void defines a second volume, wherein the second volume of the void is approximately 15%-25% of the first volume of the internal cavity; and wherein the golf club head has a third volume in a range between 430 cc and 460 cc.

10. The golf club head of claim 9, wherein the void is not visible at an address position, and wherein the void is visible from an underside of the club head.

11. The golf club head of claim 9, further comprising a first gusset member positioned proximate the first inner surface of the first wall, and wherein the first gusset member has a first side connected proximate the first inner surface of the first wall and a second side connected on an internal sole surface, and further comprising a second gusset member positioned proximate the second inner surface of the second wall, wherein the second gusset member has a first side connected proximate the second inner surface of the second wall and a second side connected on the internal sole surface.

12. The golf club head of claim 9, wherein the first wall and the second wall have respective distal ends and wherein the distal ends extend toward one another.

13. The golf club head of claim 9, wherein the golf club head defines a breadth dimension and the interface area is positioned at a range of 40%-60% of the breadth dimension, measured from the ball striking face.

14. The golf club head of claim 9, wherein a center of gravity of the club head is located within the internal cavity.

15. The golf club head of claim 9, wherein the golf club head has a first natural frequency, other than six rigid body modes, is in a range between 2750 Hz and 3200 Hz.

16. The golf dub of claim 9, wherein the first wall and the second wall have respective distal ends and wherein the distal ends extend toward one another.

17. A golf dub head comprising:

a body defining a ball striking face, a crown and a sole, the body further having a first leg extending away from the ball striking face, and a second leg extending away from the ball striking face, wherein a void is defined between the first leg and the second leg, the crown extending over the void, the body further defining an internal cavity defined at least in part by an inner surface of the ball striking face, an underside surface of the crown, and an internal surface of the sole, the first leg having a first wall having a first inner surface facing into the internal cavity and a first outer surface facing into the void, the second leg having a second wall having a second inner surface facing into the internal cavity and a second outer surface facing into the void;

wherein the sole further comprises one or more transition surfaces, wherein a first transition surface is positioned proximate to the sole and the first outer surface of the first wall, wherein a second transition surface is positioned proximate to the sole and the second outer surface of the second wall, wherein the first leg and the second leg converge towards one another to an interface area, wherein the interface area defines a substantially vertically oriented third wall having a third inner surface facing into the internal cavity and a third outer surface facing into the void; and wherein a moment of inertia through a center of gravity of the golf dub head about a vertical axis is in a range between 4300 $g*cm^2$ and 5200 $g*cm^2$.

18. The golf club head of claim 17, wherein the golf club head defines a breadth dimension and the interface area is positioned at a range of 40%-60% of the breadth dimension, measured from the ball striking face.

19. The golf club head of claim 18, wherein the void is not visible at an address position, and wherein the void is visible from an underside of the club head.

* * * * *